US009827801B2

(12) United States Patent
Taguchi et al.

(10) Patent No.: US 9,827,801 B2
(45) Date of Patent: Nov. 28, 2017

(54) SHEET BINDING APPARATUS, SHEET BINDING METHOD AND SHEET POST-PROCESSING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Hiroyuki Taguchi, Shizuoka (JP); Shoichi Dobashi, Shizuoka (JP); Yasunobu Terao, Shizuoka (JP); Mikio Yamamoto, Shizuoka (JP); Jun Ishii, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/229,236

(22) Filed: Aug. 5, 2016

(65) Prior Publication Data

US 2016/0339731 A1 Nov. 24, 2016

Related U.S. Application Data

(62) Division of application No. 14/464,767, filed on Aug. 21, 2014, now Pat. No. 9,669,644.

(30) Foreign Application Priority Data

Aug. 30, 2013 (JP) ..... 2013-180289
May 16, 2014 (JP) ..... 2014-102632

(51) Int. Cl.
*B42C 19/02* (2006.01)
*B42B 4/00* (2006.01)
(Continued)

(52) U.S. Cl.
CPC ..... *B42C 19/02* (2013.01); *B42B 4/00* (2013.01); *B42C 1/12* (2013.01); *B42C 9/0081* (2013.01)

(58) Field of Classification Search
CPC ..... B42C 9/0081; B42C 19/02; B42C 1/12; B42C 9/00; B42C 1/00; B42C 1/125; B42C 9/0006; B42C 9/0056; B42B 4/00
(Continued)

(56) References Cited

U.S. PATENT DOCUMENTS 5,437,476 A 8/1995 Hutchinson
5,441,374 A * 8/1995 Kosanke ..... B42C 9/0062 242/562.1
(Continued)

FOREIGN PATENT DOCUMENTS

JP 2001-171258 6/2001
JP 2002-211163 7/2002
(Continued)

OTHER PUBLICATIONS

Chinese Office Action for Chinese Patent Application No. 201410371646.0 dated Apr. 5, 2016.
(Continued)

*Primary Examiner* — Patrick H Mackey
(74) *Attorney, Agent, or Firm* — Amin, Turocy & Watson LLP

(57) ABSTRACT

In accordance with one embodiment, a sheet binding apparatus comprises a pasting section and a control section. The pasting section is capable of selectively carrying out pasting processing on at least one of a plurality of different given pasting target areas on sheets to be pasted. The control section controls the execution of the pasting processing based on the pasting section so that pasting target areas of a first sheet and a second sheet other than the first sheet within
(Continued)

a plurality of sheets to be subjected to binding processing are different.

8 Claims, 51 Drawing Sheets

(51) Int. Cl.
*B42C 1/12* (2006.01)
*B42C 9/00* (2006.01)

(58) Field of Classification Search
USPC ..... 412/8, 37; 270/52.18, 58.07
See application file for complete search history.

(56) References Cited

U.S. PATENT DOCUMENTS 6,592,056 B2 7/2003 Yamakawa et al.
6,631,897 B1 * 10/2003 Silverbrook ..... B42C 1/12 270/58.12
8,616,151 B2 12/2013 Hoshino
8,709,190 B2 * 4/2014 Hunkeler ..... B42C 9/0081 156/227
8,800,481 B2 8/2014 Hoshino
9,346,648 B2 * 5/2016 Osada ..... B65H 37/04
2015/0174941 A1 * 6/2015 Osada ..... B42C 9/0081 412/37
2015/0251475 A1 * 9/2015 Taguchi ..... B42C 9/0081 412/8
2015/0251869 A1 * 9/2015 Taguchi ..... B65H 37/02 412/11
2015/0306896 A1 10/2015 McDonald
2016/0207296 A1 * 7/2016 Terao ..... B42C 1/12
2016/0279998 A1 * 9/2016 Taguchi ..... B42C 9/0081

FOREIGN PATENT DOCUMENTS

JP 2004-284762 10/2004
JP 2009-214296 9/2009
JP 2009202485 A * 9/2009
JP 2013-112527 6/2013

OTHER PUBLICATIONS

Non-Final Office Action for U.S. Appl. No. 14/464,767 dated Sep. 30, 2016, 21 pages.
Japanese Office Action for Japanese Patent Application No. 2014-102632 dated Jul. 4, 2017.

* cited by examiner

TRANSITION OF DRIVING STATE OF PRESSING MECHANISM D

FIG.40

| ROTATION ANGLE | ANTICLOCKWISE | CLOCKWISE |
|---|---|---|
| ROTATE FOR 90 DEGREES | PUNCH PROTRUDES (b) | STAMP PROTRUDES (d) |
| ROTATE FOR 180 DEGREES | PUNCH RETRACTS (a) | STAMP RETRACTS (c) |
| ROTATE FOR 270 DEGREES | STAMP PROTRUDES (d) | PUNCH PROTRUDES (b) |
| ROTATE FOR 360 DEGREES | STAMP RETRACTS (c) | PUNCH RETRACTS (a) |

SHEET BINDING APPARATUS, SHEET BINDING METHOD AND SHEET POST-PROCESSING APPARATUS

CROSS-REFERENCE TO RELATED APPLICATIONS

This application is a Division of application Ser. No. 14/464,767 filed on Aug. 21, 2014, the entire contents of which are incorporated herein by reference.

The present application is based upon and claims the benefit of priorities from Japanese Patent Application No. 2013-180289 filed on Aug. 30, 2013 and Japanese Patent Application No. 2014-102632 filed on May 16, 2014, the entire contents of which are hereby incorporated by reference.

FIELD

Embodiments described herein relate to a technology in which a plurality of sheets is bound by pasting.

BACKGROUND

Conventionally, there is known a post-processing apparatus which carries out various post-processing on a sheet subjected to an image forming processing in an image forming apparatus.

In the conventional post-processing apparatuses, there is a post-processing apparatus which has a function of binding a sheet bundle including a plurality of sheets by stapling.

However, the sheet bundle bound by stapling cannot be fed through a shredder as it is. Further, in a case where staple needles are removed from the stapled sheet bundle to reuse the sheets in the image forming apparatus, there is a problem that the holes drilled by stapling adversely affect the conveyance of sheets in the image forming apparatus, which may cause sheet jam.

BRIEF DESCRIPTION OF THE DRAWINGS

FIG. 40 is a diagram illustrating the relation between the rotation angle of an action shaft of the first cam and the positions of the punch head and the stamp for coating;

DETAILED DESCRIPTION

In accordance with one embodiment; a sheet binding apparatus comprises a pasting section and a control section. The pasting section is capable of selectively carrying out pasting processing on at least one of a plurality of different given pasting target areas on sheets to be pasted. The control section controls the execution of the pasting processing based on the pasting section so that pasting target areas of a first sheet and a second sheet other than the first sheet within a plurality of sheets to be subjected to binding processing are different.

Embodiments are described below with reference to the accompanying drawings.

A First Embodiment

First, a sheet binding apparatus and a post-processing apparatus (the so-called finisher) provided with the sheet binding apparatus according to the first embodiment are described.

<Entire Apparatus Description>

Figure 1:
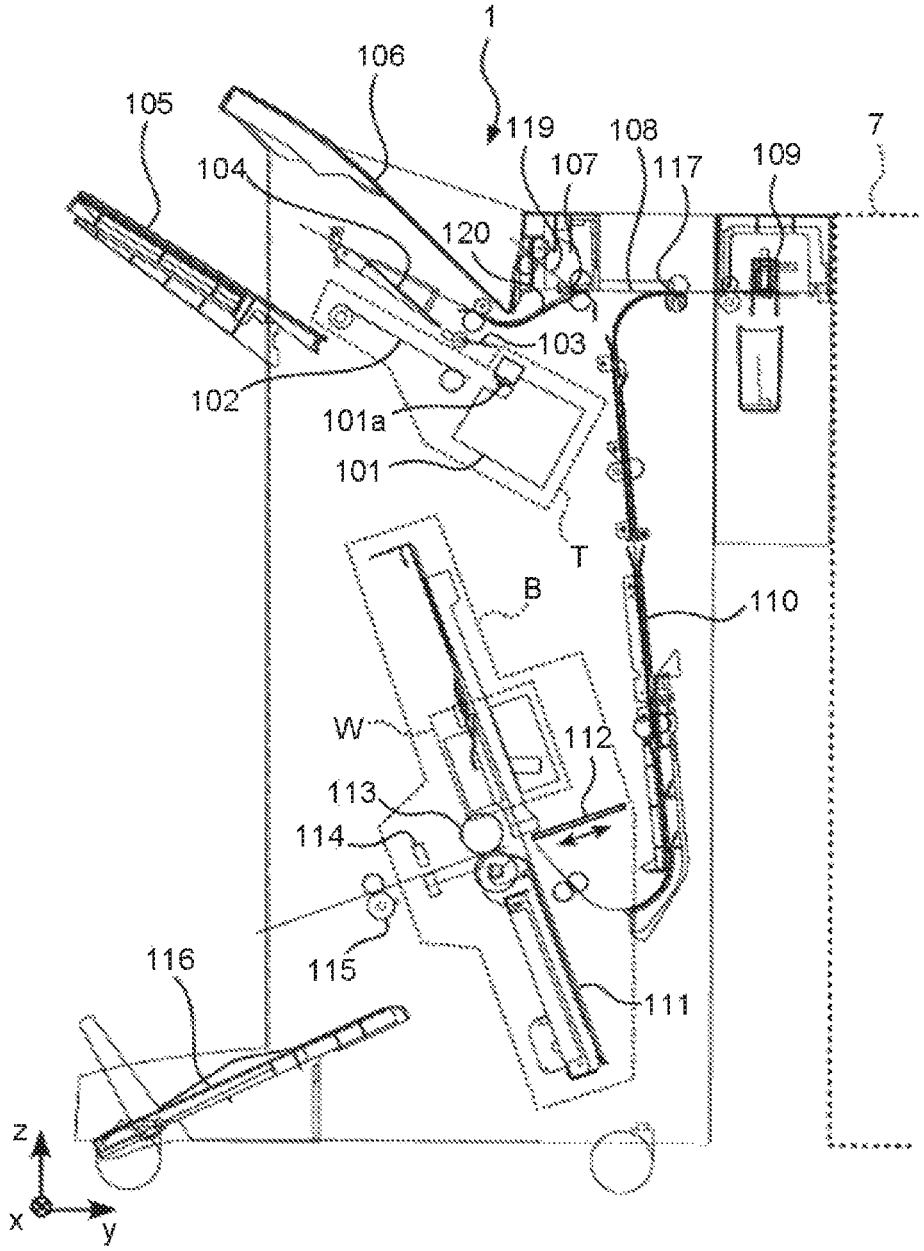
FIG. 1 is a schematic longitudinal section view of a post-processing apparatus 1 according to one embodiment.

FIG. 1 is a schematic longitudinal section view of a post-processing apparatus 1 according to the embodiment.

The post-processing apparatus 1 according to the present embodiment receives, for example, sheets output from an image forming apparatus 7 which is communicably connected with the post-processing apparatus 1 and carries out various processing such as binding processing, folding processing, hole-drilling processing and the like on the sheets.

The post-processing apparatus 1 mainly comprises, for example, a binding processing section T, a folding processing section B, a stapler W, a hole drilling section 109 as processing functions.

The sheet on which an image is formed by the image forming apparatus 7 first passes through the hole drilling section 109. In a case of carrying out hole-drilling processing on the sheet, the hole drilling section 109 drills holes in the sheet at this time.

The sheet passing through the hole drilling section 109 is distributed to either of a conveyance path 110 and a conveyance path 108 by a flapper 117.

In a case where a user desires to merely carry out hole-drilling processing on the sheet, or in a case where a user desires to discharge the sheet passing through the hole drilling section 109 to the outside of the apparatus, the sheet is guided to the conveyance path 108 by the flapper 117, and further guided to a conveyance path 119 by a flapper 107 and then discharged on a first discharge tray 106.

Figure 2:
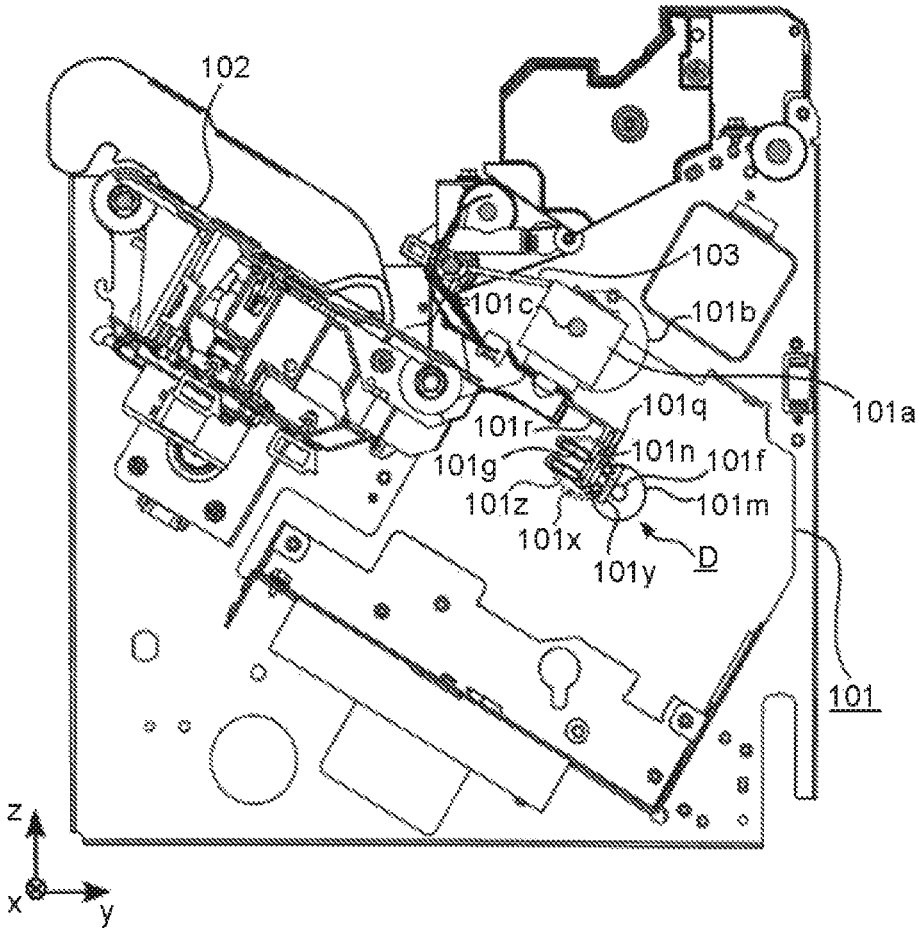
FIG. 2 is a longitudinal section view illustrating the schematic constitution around a binding processing section T.

On the other hand, in a case of desiring to carry out binding processing through the binding processing section T on the sheet, the sheet guided to the conveyance path 108 is further guided to a conveyance path 120 by the flapper 107 and then discharged to a buffer tray 104. FIG. 2 is a longitudinal section view illustrating the schematic constitution around the binding processing section T.

The sheet discharged on the buffer tray 104 is hit by a paddle 103 (shown in FIG. 1) which rotates anticlockwise on the surface of a sheet, and is then loaded on a processing tray 102.

Figure 3:
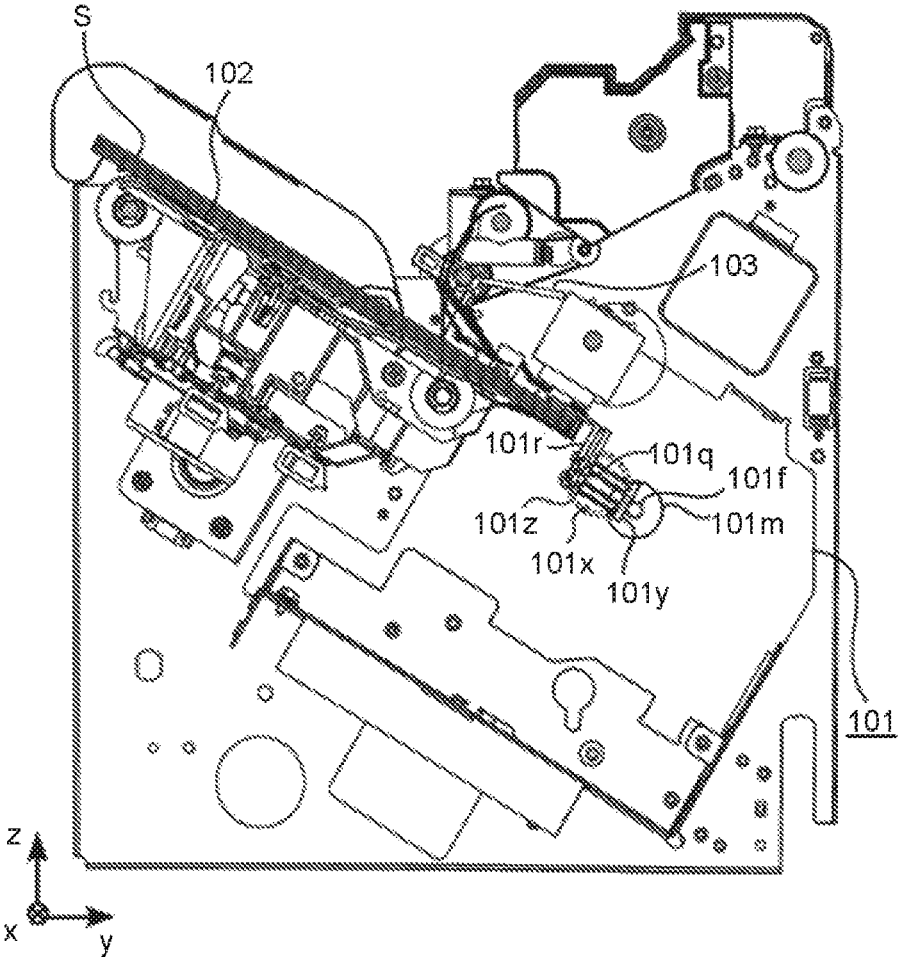
FIG. 3 is a diagram illustrating a state in which a pasted sheet bundle is loaded on a processing tray 102.

The binding processing section T is provided with a pasting section 101 for carrying out pasting processing on the upper surface of the sheet loaded on the processing tray 102. Every time a sheet is loaded onto the processing tray 102, the binding processing section T carries out pasting processing on the upper surface of the sheet through the pasting section 101. However, for example, in a case of binding a sheet bundle including ten sheets, the pasting processing is not carried out on the upper surface of the tenth sheet. FIG. 3 is a diagram illustrating a state in which the pasted sheet bundle is loaded on the processing tray 102.

Figure 4:
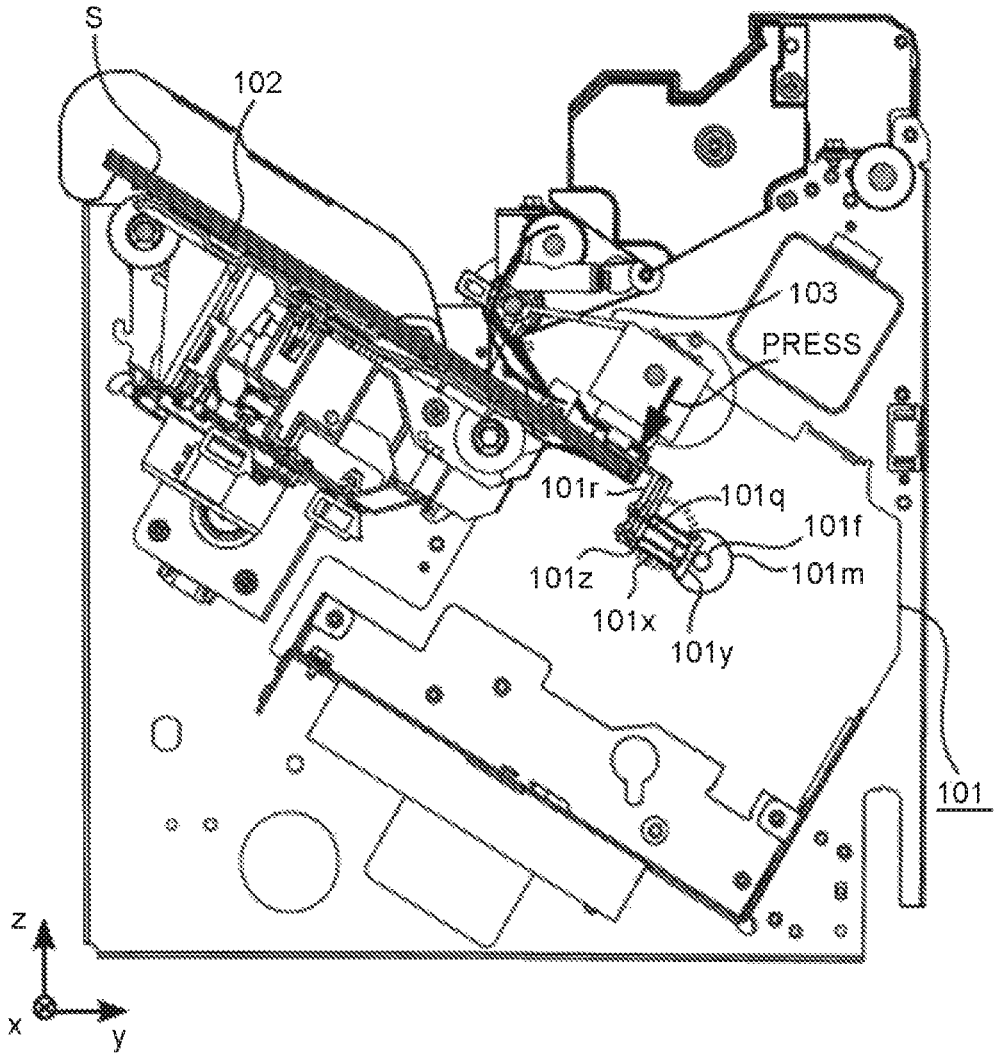
FIG. 4 is a diagram illustrating a state in which the pasted sheet bundle is pressed on the processing tray 102.

After the pasting processing carried out on all of the plurality of sheets to be subjected to the binding processing is completed on the processing tray 102, the plurality of sheets, of which the upper surfaces are pasted respectively, are pressed towards the processing tray 102 by a pressing mechanism D in an overlapped state. Herein, the pasting section 101 jets liquid glue to the sheet, and the plurality of sheets pressed by the pressing mechanism D are firmly bonded with each other by the glue, in this way, the sheet binding processing is completed (refer to FIG. 4).

On the other hand, in a case of desiring to carry out folding processing and stapling processing on the sheet passing through the hole drilling section 109, the sheet is guided to the conveyance path 110 by the flapper 117 and then discharged onto a stacker 111 to be subjected to the stapling processing by the stapler W and the folding processing by the folding processing section B. Specifically, the folding processing section B folds, for example, the sheet bundle subjected to the stapling processing by the stapler W with a folding blade 112 and a folding roller 113, clamps the fold with a fold reinforcing roller 114, and then discharges the folded sheet bundle on a third discharge tray 116 by a discharge roller 115.

Figure 5:
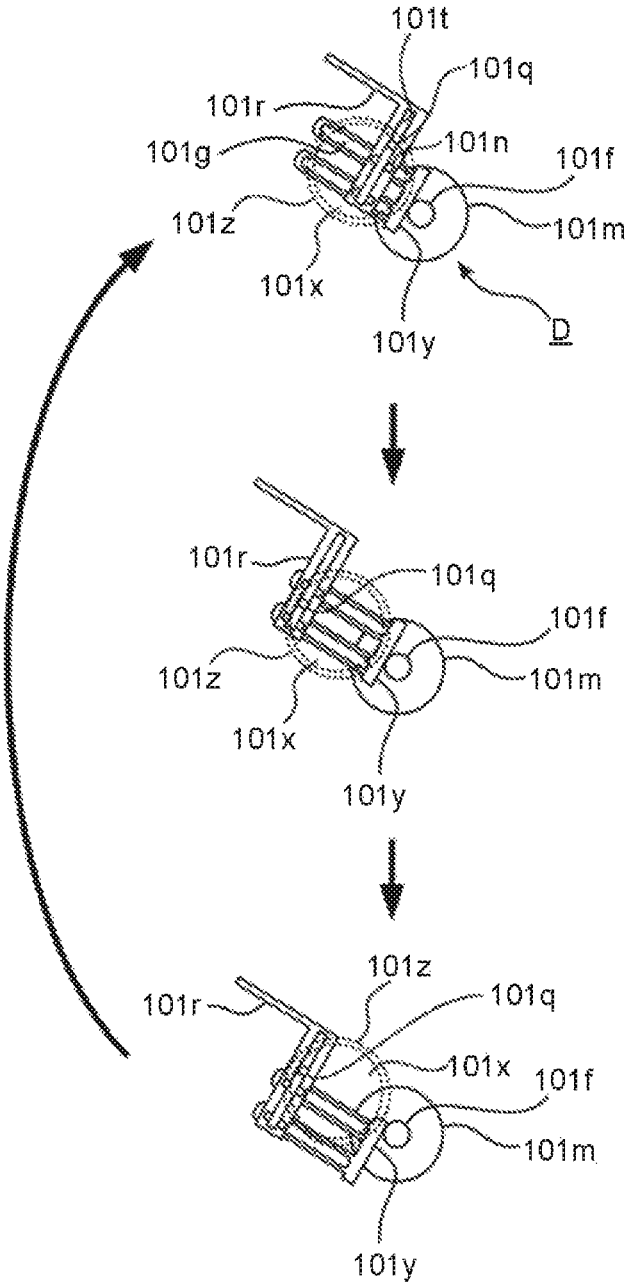
FIG. 5 is a transition diagram illustrating a series of pressing operations carried out by a pressing mechanism D.

FIG. 5 is a transition diagram illustrating a series of pressing operations carried out by the pressing mechanism D. As shown in FIG. 5, the pressing mechanism D includes, for example, a pressing member 101*r*, a guide member 101*g*, a motor 101*z*, a cam 101*x*, a rack gear 101*y*, a motor 101*m*, a pinion gear 101*f*, a guided member 101*n*, a pin 101*q* and the like.

The operations of the pressing mechanism D are described below.

The cam 101*x* is installed on an output shaft of the motor 101*z*, and the cam 101*x* rotates if the motor 101*z* is driven to rotate. The pin 101*q* which is arranged in the cam 101*x* slides in a guide groove 101*t* formed in the pressing member 101*r*.

Further, the guided member 101*n* which is arranged in the pressing member 101*r* is guided to reciprocate by a guide groove of the guide member 101*g*.

Thus, if the motor 101*z* is driven to rotate, the pin 101*q* of the cam 101*x* rotates, and the driving force is transferred to the pressing member 101*r* through the guide groove 101*t* by the moving pin 101*q*, thereby, the pressing member 101*r* reciprocates along the guide groove of the guide member 101*g*.

Further, the rack gear 101*y* is formed at the end part of the pressing member 101*r* to extend in a direction (pressing direction) orthogonal to the extending direction of the guide groove of the guide member 101*g*. The pinion gear 101*f* installed on an output shaft of the motor 101*m* meshes with the rack gear 101*y*, and if the motor 101*m* is driven to rotate, the pressing member 101*r* together with the guide member 101*g* is made to reciprocate in the extending direction of the rack gear 101*y*.

Figure 6:
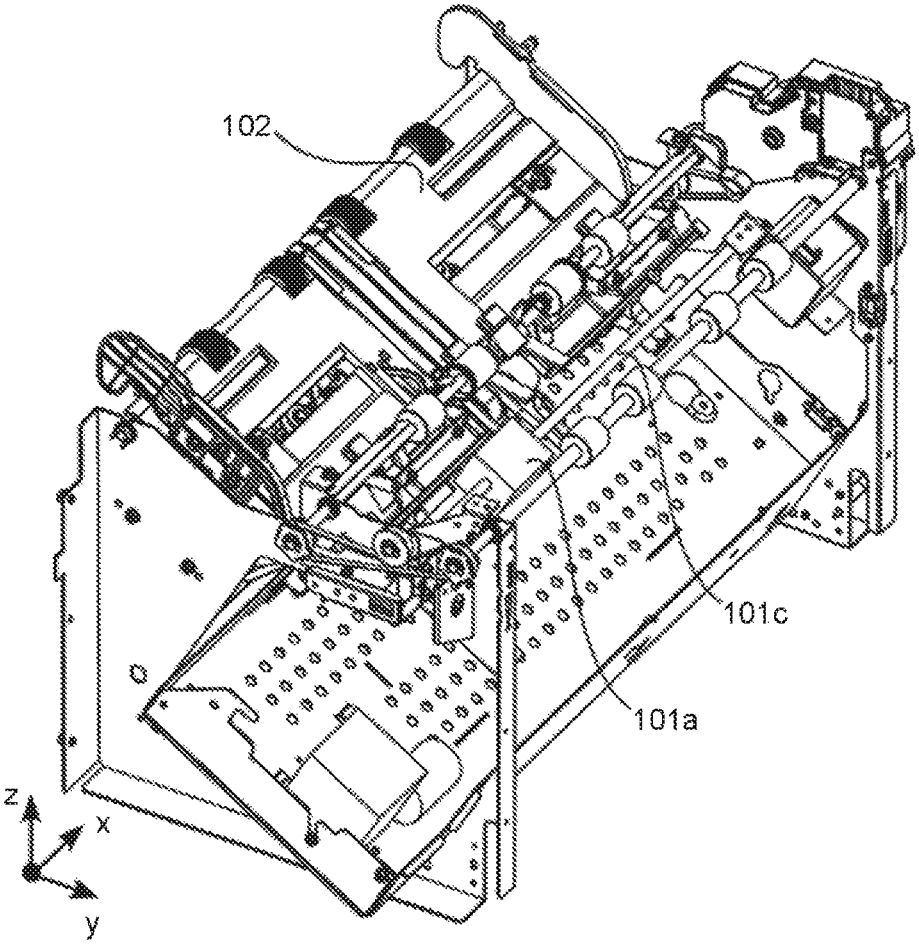
FIG. 6 is an exploded perspective view illustrating the schematic constitution around the binding processing section T viewed from the side of the processing tray 102.

Then, the sheet bundle including a plurality of sheets bound in the binding processing is discharged to, for example, a second discharge tray 105 by a discharge member (not shown) arranged in the processing tray 102. FIG. 6 is an exploded perspective view illustrating the schematic constitution around the binding processing section T viewed from the side of the processing tray 102.

Figure 7:
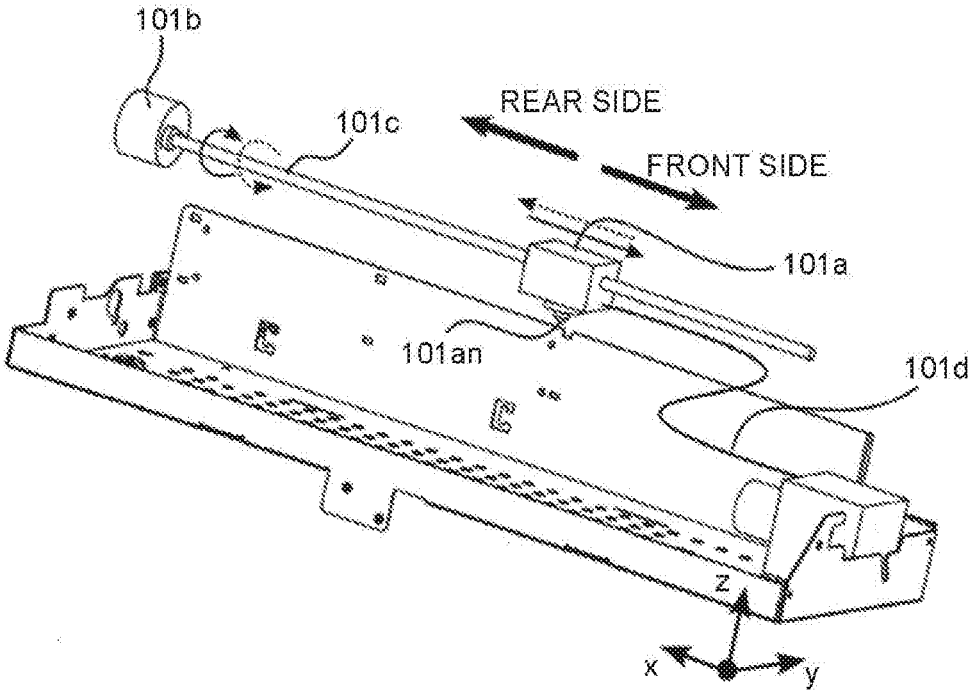
FIG. 7 is a partially exploded perspective view illustrating the constitution of a pasting section 101 in the binding processing section T.

FIG. 7 is a partially exploded perspective view illustrating the constitution of the pasting section 101 in the binding processing section T. As shown in FIG. 7, the pasting section 101 includes a pasting head 101*a* (pasting unit), a supply tube 101*d*, a shaft 101*c*, a motor 101*b* and the like. The pasting head 101*a* is supported to reciprocate in a direction indicated by an arrow shown in FIG. 7 by the shaft 101*c* on the outer peripheral surface of which a worm gear is formed. The shaft 101*c* which is connected with the output shaft of the motor 101*b* is rotated if the motor 101*b* is driven to rotate. In this way, if the motor 101*b* is rotated forward, the pasting head 101*a* moves towards one end due to the action of the worm gear of the shaft 101*c*, and if the motor 101*b* is rotated reversely, the pasting head 101*a* moves towards the other end due to the action of the worm gear of the shaft 101*c*.

The liquid glue is supplied to the pasting head 101*a* which is supported to reciprocate as stated above via the supply tube 101*d* by a pump (not shown). The liquid glue supplied to the pasting head 101*a* is jetted to a desired area of the upper surface of the sheet loaded on the processing tray 102 from a nozzle 101 an arranged on the pasting head 101*a*. Herein, for example, the motor 101*b*, the shaft 101*c* and the like function as a "moving mechanism".

As stated above, in the binding processing section T (pasting section), pasting processing can be selectively carried out on at least one of a plurality of different "given pasting target areas" on the sheets to be pasted. The plurality of "given pasting target areas", the positions of which relative to the sheet are set in advance, are areas such as G11-G15 shown in later-described FIG. 10.

Herein, an example is described in which the binding processing section T is arranged at the position shown in FIG. 1 in the post-processing apparatus 1, however, the present invention is not limited to this. For example, the binding processing section T may be arranged at other position in the apparatus such as the hole drilling section 109 or the folding processing section B.

Figure 8:
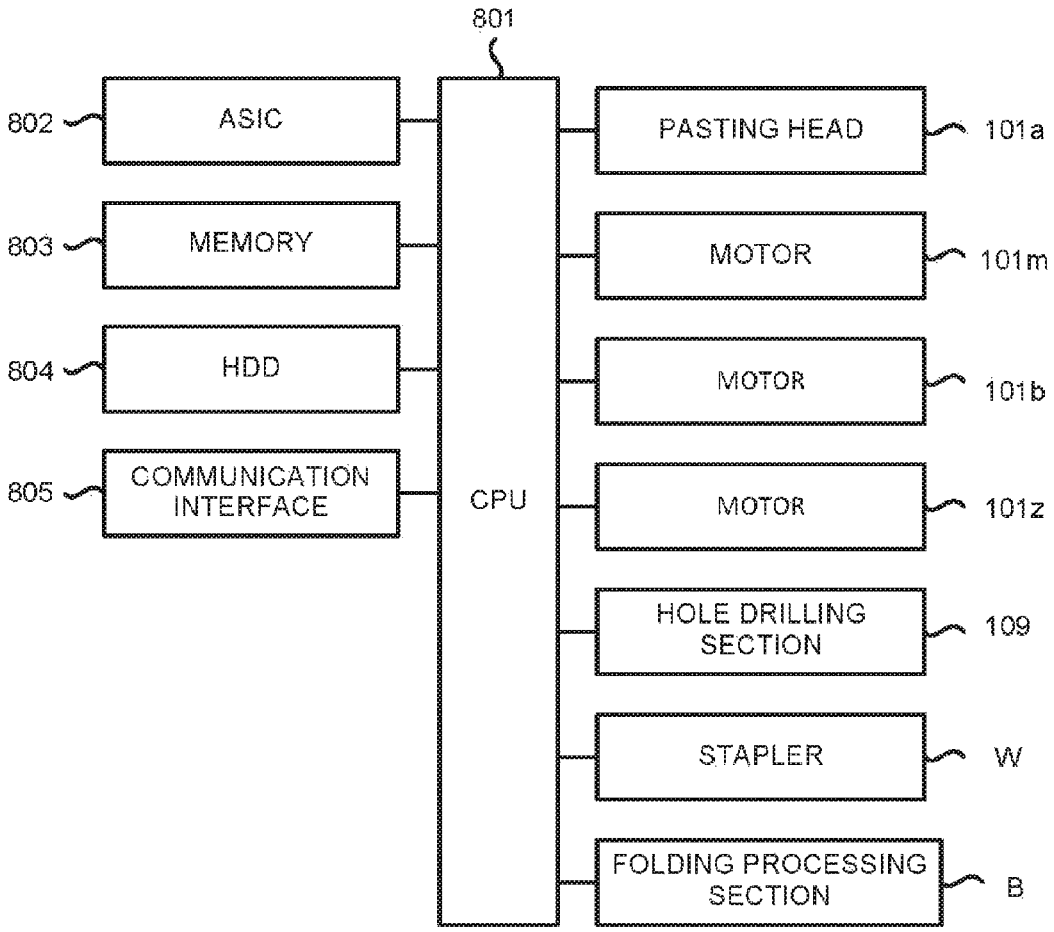
FIG. 8 is a diagram illustrating one example of a control block of the post-processing apparatus 1 provided with the sheet binding apparatus according to the embodiment.

FIG. 8 is a diagram illustrating one example of a control block of the post-processing apparatus 1 provided with the sheet binding apparatus according to the embodiment.

As shown in FIG. 8, the post-processing apparatus 1 to be partially described comprises, for example, a CPU 801, an ASIC (Application Specific Integrated Circuit) 802, a memory 803, a HDD (Hard Disk Drive) 804, the pasting head 101*a*, the motor 101*m*, the motor 101*z*, the motor 101*b*, a communication interface 805 and the like.

The various actuators and sensors of the post-processing apparatus 1 such as the ASIC 802, the memory 803, the HDD 804, the motor 101*m*, the motor 101*b* and the communication interface 805 are communicably connected with the CPU 801 through a communication line such as a parallel bus and serial bus.

The CPU 801 loads and executes, for example, the program downloaded from the HDD 804 or an external device in the memory 803 to control, for example, the pasting head 101*a*, the motor 101*m*, the motor 101*z*, the motor 101*b*, the communication interface 805 and the like.

In the sheet binding apparatus and the post-processing apparatus 1 provided with the sheet binding apparatus according to the present embodiment, the CPU 801 carries out various processing in the sheet binding apparatus and the post-processing apparatus 1 provided with the sheet binding apparatus, and realizes various functions by executing the programs stored in the memory 803, the HDD 804 and the like. In addition, it goes without saying that the CPU 801 can be replaced with a MPU (Micro Processing Unit) capable of executing the same arithmetic processing. Similarly, the HDD 804 may also be replaced with a storage device such as a flash memory and the like.

The memory 803, which may consist of, for example, a RAM (Random Access Memory), a ROM (Read Only Memory), a DRAM (Dynamic Random Access Memory), a SRAM (Static Random Access Memory), a VRAM (Video RAM), a flash memory and the like, stores various kinds of information or programs used in the sheet binding apparatus and the post-processing apparatus 1 provided with the sheet binding apparatus.

<Detailed Description of Sheet Binding Apparatus>

Next, the sheet binding apparatus according to the embodiment is described in detail.

Figure 9:
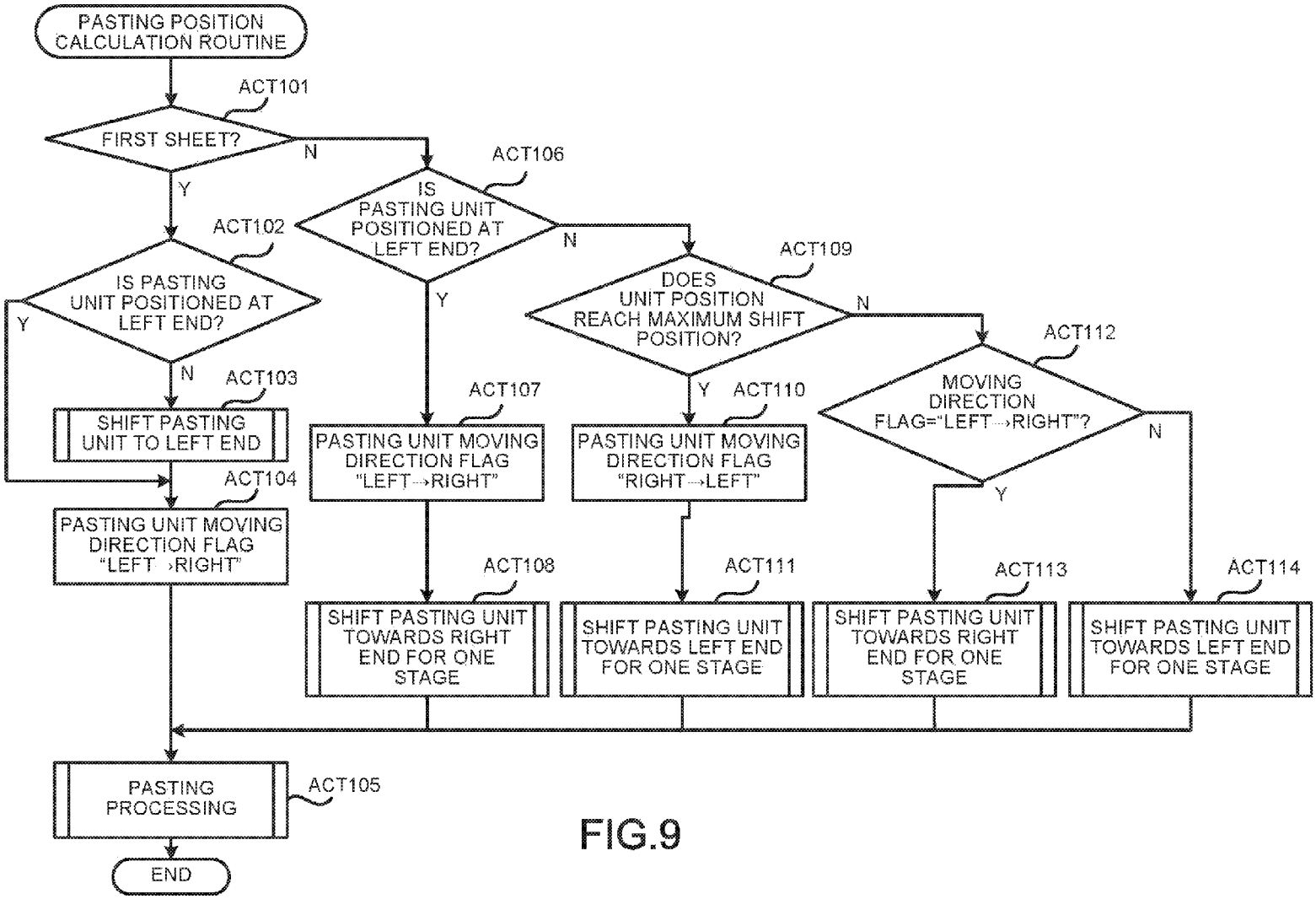
FIG. 9 is a flowchart illustrating a procedure of the processing carried out in the sheet binding apparatus according to the embodiment.

FIG. 9 is a flowchart illustrating a procedure of the processing carried out in the sheet binding apparatus according to the embodiment.

The CPU 801 (sheet number information acquisition section) acquires information (information for identifying each sheet) indicating whether or not the sheet to be subjected to the binding processing is the first sheet from the image forming apparatus 7 and the like, and if the sheet is the first sheet in the sheet bundle (YES in ACT 101), it is determined whether or not the pasting head 101*a* is positioned at the left end (the back side of the apparatus, the inner side of the sheet surface in FIG. 1) (ACT 102). The determination on the position of the pasting head 101*a* may be carried out by the CPU 801 based on the control history of past; alternatively, the current position of the pasting head 101*a* is recorded in the HDD 804 and the like as necessary, and the determination may be carried out by reading the record. Further, the position of the pasting head 101*a* may be detected by a sensor and the like.

In a case where the pasting head 101*a* is not positioned at the left end (the back side of the apparatus) (NO in ACT 102), the pasting head 101*a* is shifted to the left end (the back side of the apparatus) and returned to an initial position nearby the corner of the sheet (ACT 103). Then the CPU 801 sets a moving direction flag of the pasting head 101*a* stored in the HDD 804 to "from left end to right end" (ACT 104), and then carries out pasting processing on the upper surface of the sheet through the pasting head 101*a* (ACT 105).

On the other hand, in a case where the sheet to be subjected to binding processing is not the first sheet (NO in ACT 101), the CPU 801 (sheet number information acquisition section) determines whether or not the pasting head 101*a* is positioned at the left end (the back side of the apparatus) (ACT 106).

In a case where the pasting head 101*a* is positioned at the left end (the back side of the apparatus) (YES in ACT 106), the CPU 801 sets the moving direction flag of the pasting head 101*a* stored in the HDD 804 to "from left end to right end" (ACT 107), and shifts the pasting head 101*a* towards the right end (the front side of the apparatus) for one stage (ACT 108), and then carries out pasting processing on the upper surface of the sheet through the pasting head 101*a* (ACT 105).

In a case where the pasting head 101*a* is not positioned at the left end (the back side of the apparatus) (NO in ACT 106), the CPU 801 determines whether or not the pasting head 101*a* reaches a "maximum shift position" (limit shift position of the front side of the apparatus) (ACT 109).

In a case where the pasting head 101*a* reaches the "maximum shift position" (YES in ACT 109), the CPU 801 sets the moving direction flag of the pasting head 101*a* stored in the HDD 804 to "from right end to left end" (ACT 110), and shifts the pasting head 101*a* towards the left end (the back side of the apparatus) for one stage (ACT 111), and then carries out pasting processing on the upper surface of the sheet through the pasting head 101*a* (ACT 105).

In a case where the pasting head 101*a* does not reach the "maximum shift position" (NO in ACT 109), and the moving direction flag of the pasting head 101*a* is "from left end to right end" (YES in ACT 112), the CPU 801 shifts the pasting head 101*a* towards the right end (the front side of the apparatus) for one stage (ACT 113), and then carries out pasting processing on the upper surface of the sheet through the pasting head 101*a* (ACT 105).

On the other hand, in a case where the moving direction flag of the pasting head 101*a* is not "from left end to right end" (NO in ACT 112), the CPU 801 shifts the pasting head 101*a* towards the left end (the back side of the apparatus) for one stage (ACT 114), and then carries out pasting processing on the upper surface of the sheet through the pasting head 101*a* (ACT 105).

In this way, the CPU 801 (control section) in the sheet binding apparatus according to the present embodiment moves the pasting head 101*a* to differentiate (shift) the pasting target areas of the "first sheet (for example, the sheet of the first page)" and the "second sheet (for example, the sheets of the second page and the page other than the first page)" other than the first sheet in the sheet bundle including a plurality of sheets to be subjected to binding processing, and then carries out pasting processing through the pasting head 101*a*.

Herein, the CPU 801 drives and controls the pasting head 101*a* so that the pasting target positions of the adjacent sheets (the first sheet and the second sheet) are different from one another. In this way, the pasting target positions of the adjacent sheets are made different, thus, the positions where the thickness is increased due to the pasting can be dispersed, which prevents the thickness increase caused by the continuous pasting processing at the same position of adjacent overlapped sheets.

Figure 10:
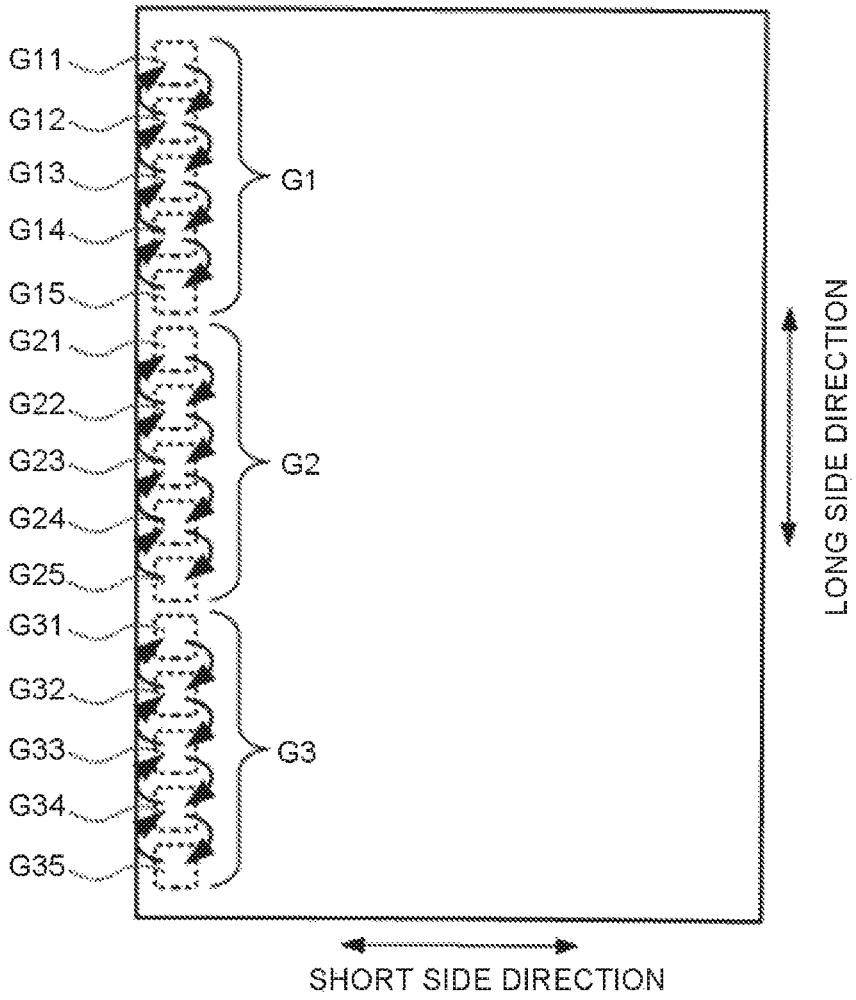
FIG. 10 is a diagram illustrating one example of a plurality of given pasting target areas defined on the sheet when the pasting processing is carried out in the binding processing section T.

FIG. 10 is a diagram illustrating one example of a plurality of given pasting target areas defined on the sheet when the pasting processing is carried out in the binding processing section T.

As shown in FIG. 10, the plurality of given pasting target areas are divided into three groups, that is, groups G1-G3. The group G1 includes a plurality of pasting target areas G11-G15, the group G2 includes a plurality of pasting target areas G21-G25, and the group G3 includes a plurality of pasting target areas G31-G35.

Figure 11:
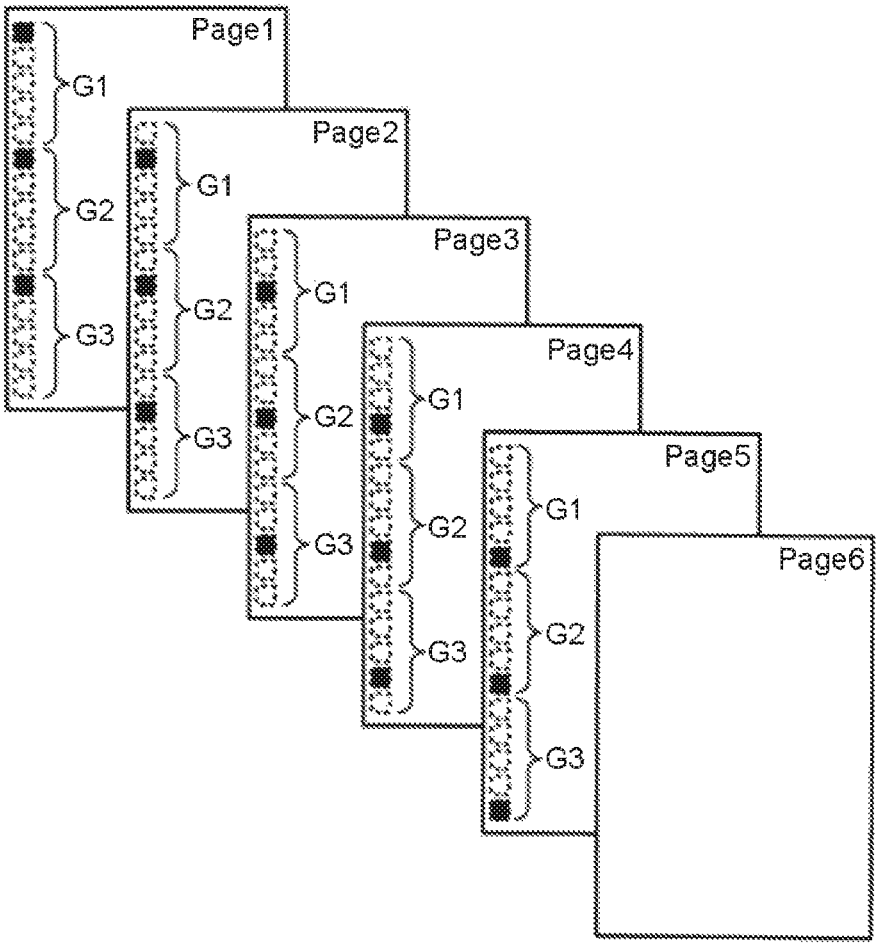
FIG. 11 is a diagram illustrating pasting target positions in a case where the pasting processing is carried out in a pattern shown in FIG. 10.

As shown in FIG. 11, in a case of binding, for example, six sheets, the CPU 801 drives and controls the motor 101*b* to carry out pasting processing on the areas G11, G21 and G31 in the group G1-group G3 for the first sheet; carry out pasting processing on the areas G12, G22 and G32 in the group G1-group G3 for the second sheet; carry out pasting processing on the areas G13, G23 and G33 in the group G1-group G3 for the third sheet; carry out pasting processing on the areas G14, G24 and G34 in the group G1-group G3 for the fourth sheet; and carry out pasting processing on the areas G15, G25 and G35 in the group G1-group G3 for the fifth sheet. Then the CPU 801 discharges the sixth sheet (the last sheet) on the pasted fifth sheet without carrying out pasting processing on the sixth sheet, and then presses the pasted parts of the six sheets through the pressing mechanism D.

Figure 12:
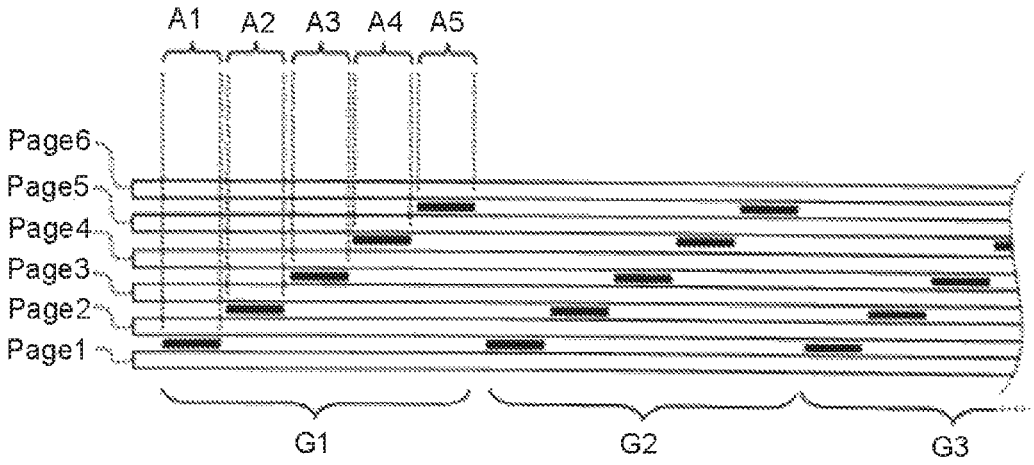
FIG. 12 is a diagram illustrating the cross-section of the bound sheet bundle in a case where pasting processing is carried out on the six sheets in the procedure described above.

FIG. 12 is a diagram illustrating the cross-section of the bound sheet bundle in a case where pasting processing is carried out on the six sheets in the procedure described above. As shown in FIG. 12, in the surface direction of the sheets, the pasted areas positioned at the both sides of any sheet are at different positions without overlap.

Herein, the CPU 801 selects, in a given order, an area from the plurality of given pasting target areas every time the page to be pasted is changed. In this way, there is a periodicity (regularity) in the pasting target positions in the binding positions, which can improve the aesthetics of the binding positions and the stabilization of the binding strength.

As stated above, the pasting target position of one sheet is made different from that of other sheets in the sheet bundle to be subjected to binding processing, thus, compared with a case where pasting processing is carried out on the same position of all the sheets constituting the sheet bundle, the thickness increase nearby the pasted positions due to the thickness of the paste caused by the overlapping of the pasted positions can be prevented.

Figure 13:
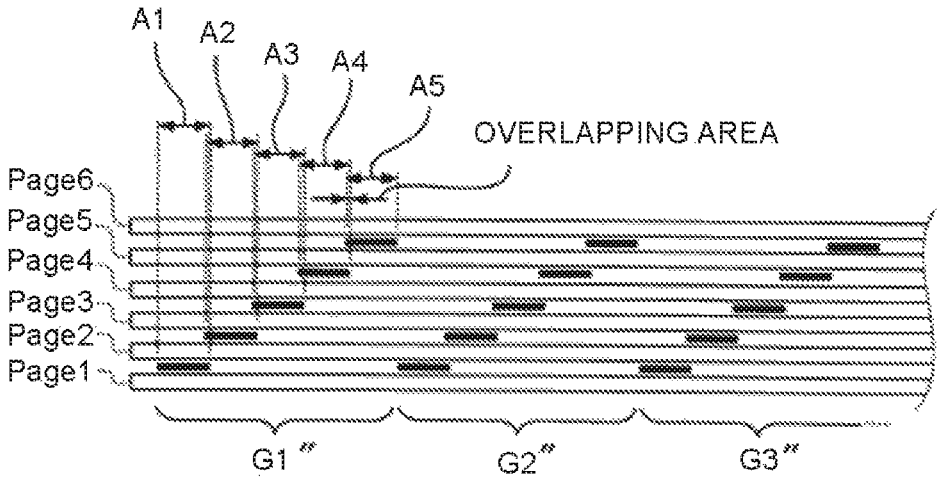
FIG. 13 is a diagram illustrating the cross-section of the sheet bundle pasted in a state in which the pasted parts slightly overlap with each other.

In addition, "shift the pasting target areas" described herein means that the pasting target position on the first sheet is not "exactly the same" as that on the second sheet. For example, "shift the pasting target areas" further includes a case (as shown in FIG. 13) where part of the pasted area on the first sheet overlaps with the pasted area on the second sheet. That is, it is fine that the pasted positions overlap with one another at a certain degree, as long as the thickness of the whole bound sheet bundle can be reduced compared with the thickness in a case where the pasted parts overlap at the same position.

Figure 14:
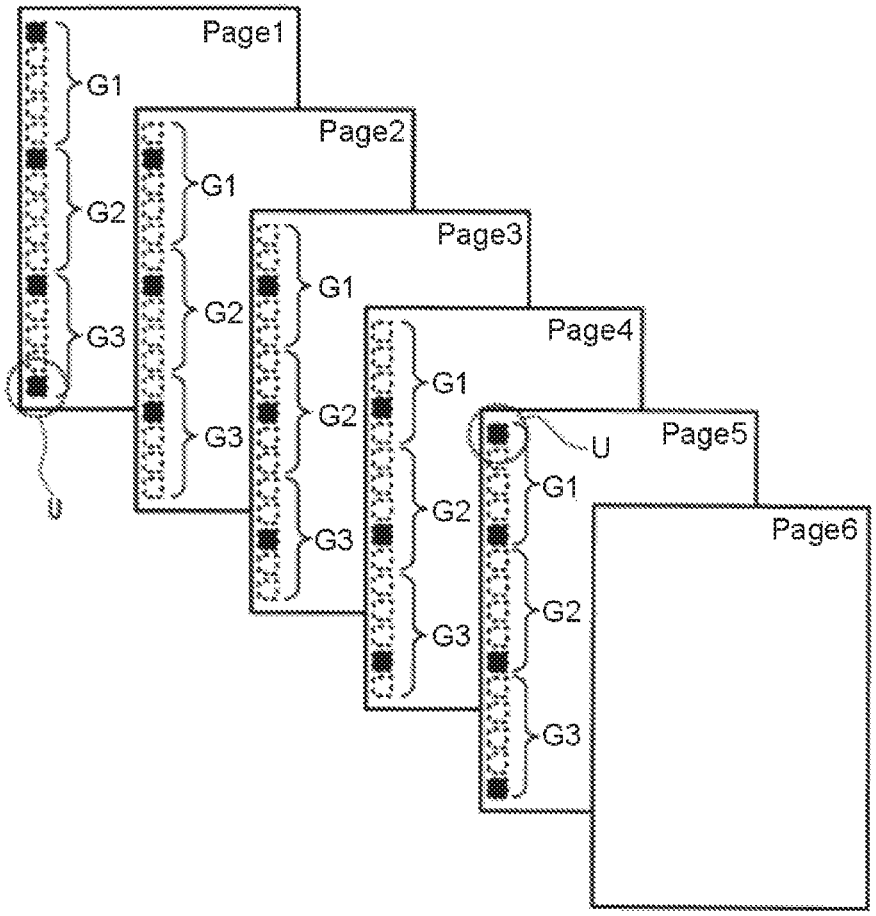
FIG. 14 is a diagram illustrating another pasting method according to a first embodiment.

FIG. 14 is a diagram illustrating another pasting method according to the first embodiment.

In the example shown in FIG. 14, for a "first given sheet (Page1 shown in FIG. 14) serving as an initial first cover page" and a "second given sheet (Page5 shown in FIG. 14) serving as the page before the last second cover page" in the plurality of sheets to be subjected to binding processing, the CPU 801 always carries out pasting processing on the pasting target areas (herein refer to the pasting target areas G11 and G35 surrounded by a dashed circle U) which are the nearest to the corners of the sheet in the plurality of given pasting target areas.

Generally, the front cover sheet and the back cover sheet are easy to peel off from the corner part where stress is applied easily. Thus, for the front cover sheet and the back cover sheet, pasting processing is always carried out on the corner part of the sheet, which can prevent the front cover sheet and the back cover sheet from being peeled off from the corner part.

Figure 15:
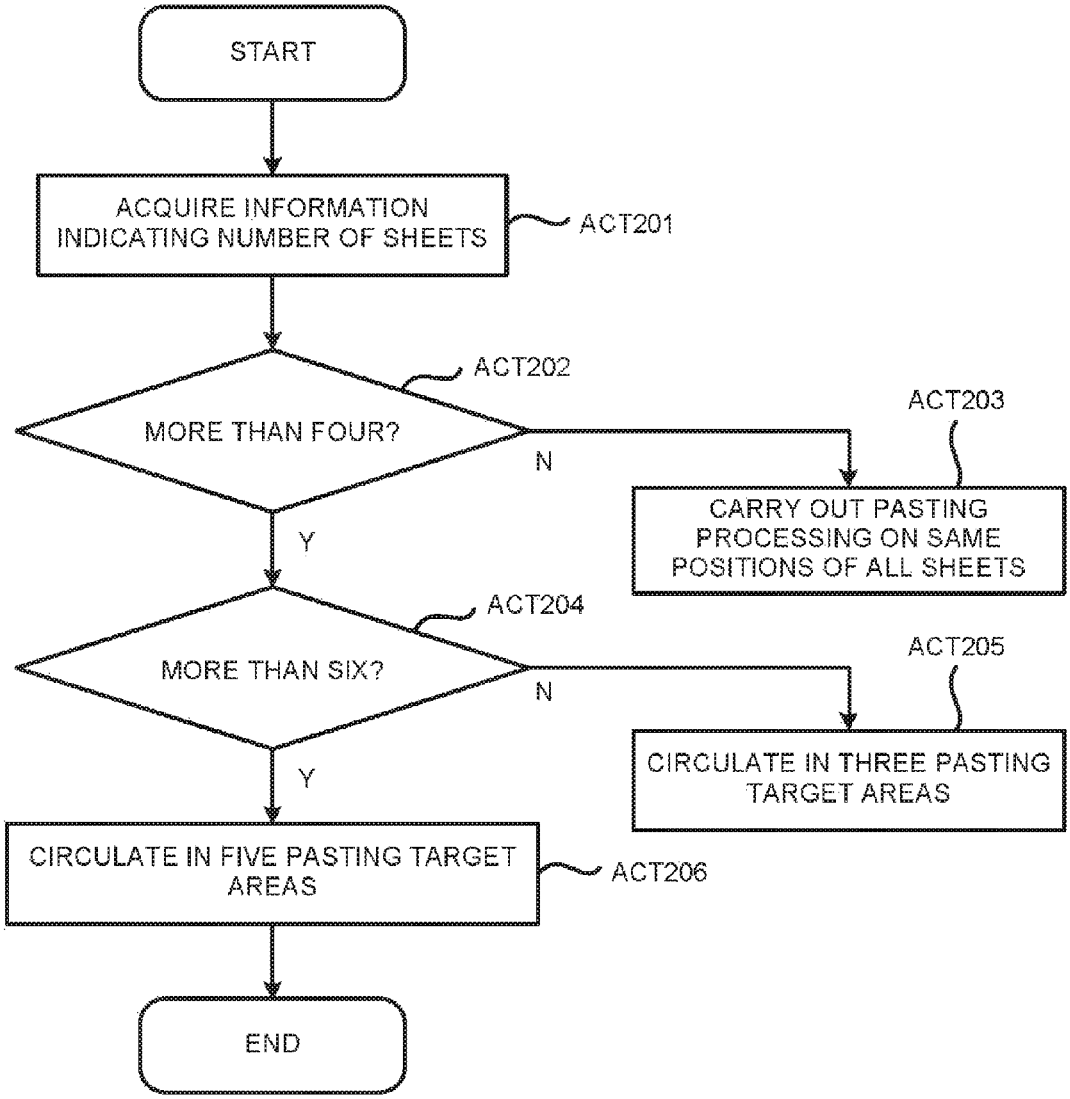
FIG. 15 is a flowchart illustrating a control carried out to change the pasting target position based on the number of sheets of the sheet bundle to be subjected to binding processing.

FIG. 15 is a flowchart illustrating a control carried out to change the pasting target position based on the number of sheets of the sheet bundle to be subjected to binding processing.

As shown in FIG. 15, the CPU 801 (sheet number information acquisition section) acquires information indicating the number of sheets constituting the sheet bundle to be bound by pasting from the image forming apparatus 7 and the like (ACT 201).

In a case where the number of sheets indicated by the acquired sheet number information is less than a given sheet number (herein, four) (NO in ACT 202), the CPU 801 sets the pasting target areas of the first sheet (for example, the sheet of the first page) and the pasting target areas of the second sheet (for example, the sheets of the second page and the page other than the first page) to be at the same position of the sheets (ACT 203).

In this way, in a case of binding a document including a small number of sheets, the influence caused by the thickness increase due to the pasting can be ignored, thus, for the sake of a stable binding processing and the improvement of aesthetics, the pasting processing may be carried out on the same position of the sheets.

Figure 16:
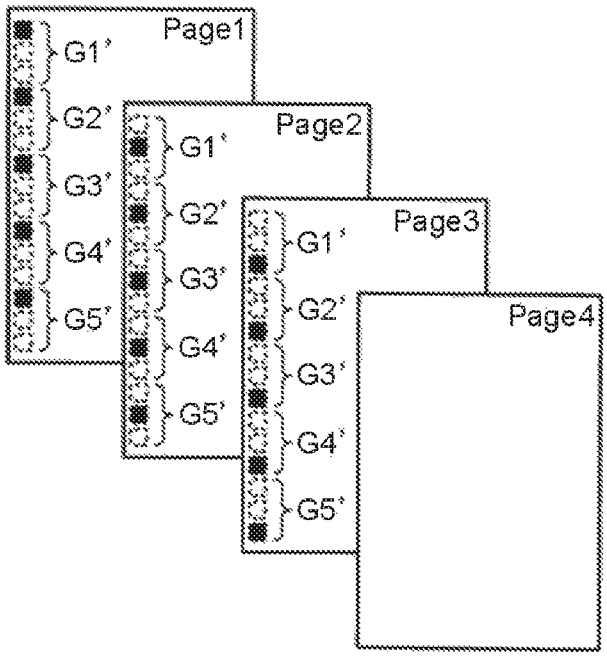
FIG. 16 is a diagram illustrating one example of the pasting processing based on the procedure shown in FIG. 15.

Further, the CPU 801 increases the number of the plurality of given pasting target areas if the number of sheets indicated by the acquired sheet number information is large. Specifically, for example, in a case where the number of sheets constituting the sheet bundle to be subjected to binding processing is four or five (NO in ACT 204), as shown in FIG. 16, pasting processing is carried out by circulating in three kinds of pasting target areas in each of groups G1'-G5' in a given order (ACT 205).

Further, for example, in a case where the number of sheets constituting the sheet bundle to be subjected to binding processing is more than six (YES in ACT 204), as shown in FIG. 11, the CPU 801 carries out pasting processing by circulating in five kinds of pasting target areas in each of the groups G1-G3 in a given order (ACT 206).

The more the number of sheets to be bound is, the stronger the influence to the thickness increase caused by pasting at the same position is.

Thus, in a case where the number of sheets to be bound is large, the number of pasting target positions is increased to avoid the overlap between the pasting target positions as much as possible; in a case where the number of sheets to be bound is small, it is allowed to reduce the number of pasting target positions.

Figure 17:
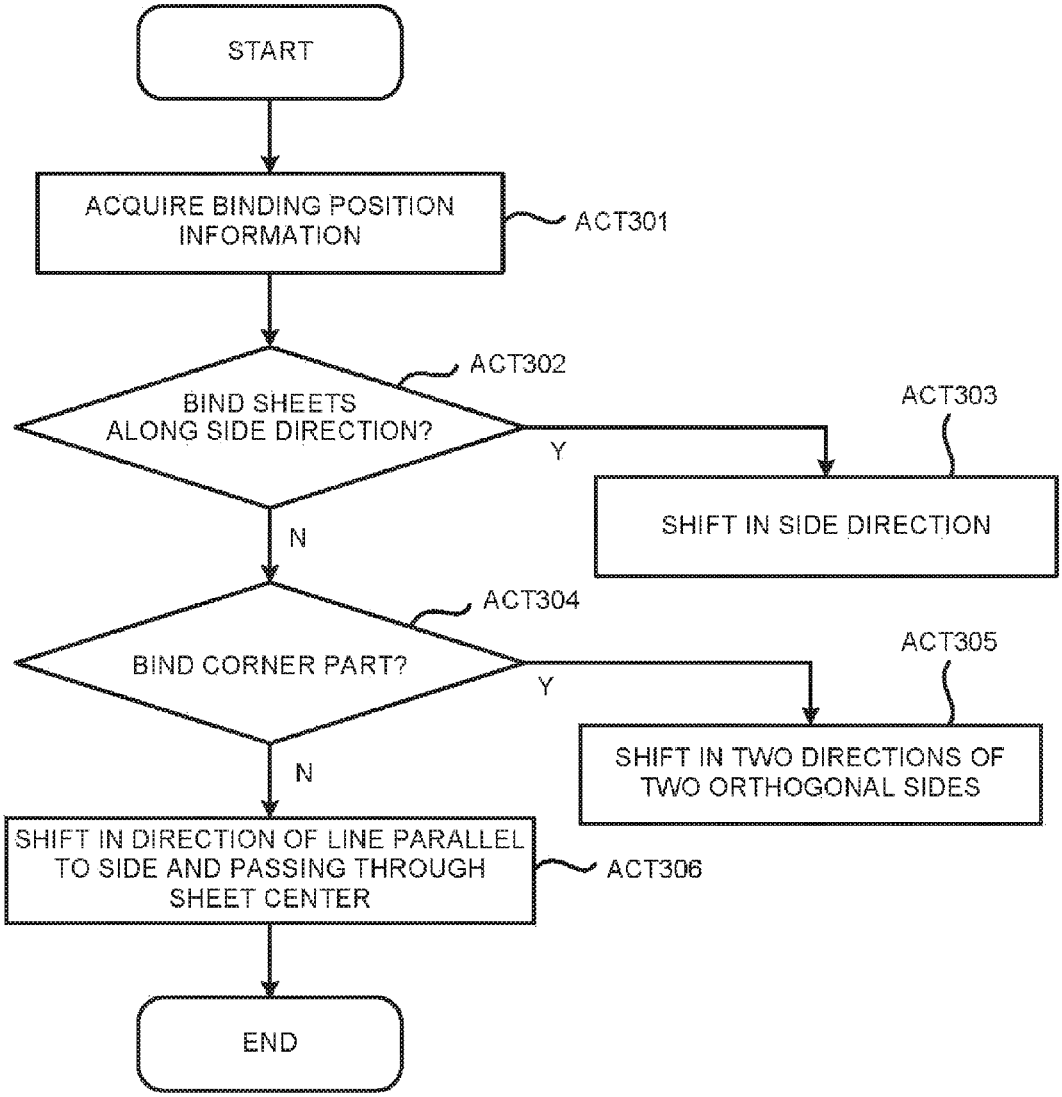
FIG. 17 is a flowchart illustrating a control carried out to change the pasting target position based on the position where the binding processing is carried out on the sheet bundle.

FIG. 17 is a flowchart illustrating a control carried out to change the pasting target position based on the position where the binding processing is carried out on the sheet bundle.

As shown in FIG. 17, the CPU 801 (binding position information acquisition section) acquires "binding position information indicating which position on the sheet is set as the binding position" acquired from the image forming apparatus 7 (ACT 301). The information is set by a user through, for example, a printer driver of an external machine such as a PC for sending printing instruction to the image forming apparatus 7, or a control panel of the image forming apparatus 7.

As to the category of the binding positions, for example, the following may be listed:

(1) binding at a plurality of positions along the long side or the short side, (2) binding the corner part of the sheet, and (3) binding along a line which is parallel to any side of the sheet and passes through the center of the sheet.

In a case of binding at a plurality of positions along any side (for example, long side) of the sheet based on the acquired binding position information (YES in ACT 302), the CPU 801 differentiates the pasting target areas of the first sheet (for example, the sheet of the first page) from the pasting target areas of the second sheet (for example, the sheets of the second page and the page other than the first page) in the direction of the side (for example, the long side), and then carries out pasting processing (ACT 303).

In a case of binding at a plurality of positions along any side of the sheet bundle, there is a case where the blank part arranged nearby the side to be subjected to binding processing is small according to different categories of documents to be subjected to binding processing. In this case, if the pasting target positions of the first sheet and the pasting target positions of the second sheet are shifted in a direction orthogonal to the side direction, the glue may be pasted beyond the blank part onto the content part of the document.

Therefore, in a case of binding the sheet bundle at a plurality of positions along any side, the pasting target areas are shifted in the direction of the side, which can prevent that the pasting processing is carried out beyond the blank part of the document.

Further, the CPU 801 changes the direction for differentiating the pasting target areas of the first sheet (for example, the sheet of the first page) from the pasting target areas of the second sheet (for example, the sheets of the second page and the page other than the first page) in response to the information indicating which position on the sheet is set as the binding position based on the acquired binding position information.

Figure 18:
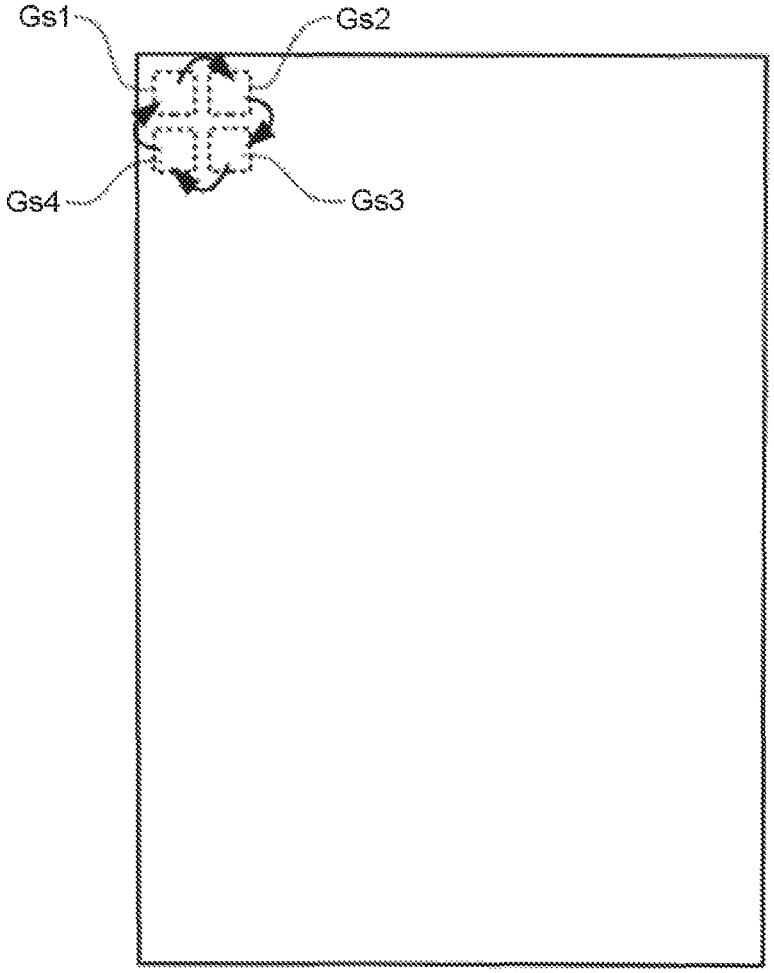
FIG. 18 is a diagram illustrating a pasting pattern in a case of binding a corner part of the sheet.
Figure 19:
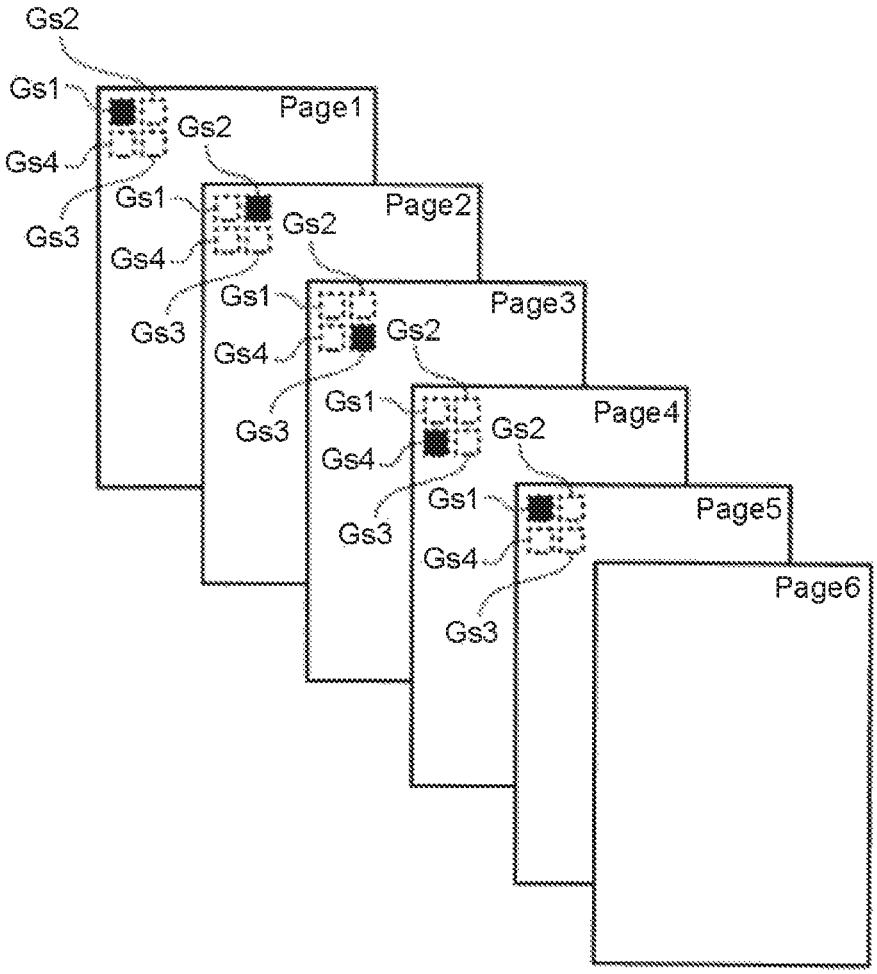
FIG. 19 is a diagram illustrating a pasting example in a case of carrying out binding processing on six sheets while shifting the pasting target positions in a rule shown in FIG. 18.

Specifically, if it is determined to bind the corner part of the sheet according to the acquired binding position information (YES in ACT 304), the CPU 801 shifts the pasting target positions in the direction of each of the two orthogonal sides (short side and long side) (ACT 305). Specifically, as shown in FIG. 18, the CPU 801 shifts the pasting target positions for each page by sequentially circulating in pasting target areas Gs1-Gs4 which are at different positions in the two orthogonal shaft directions. FIG. 19 is a diagram illustrating a pasting example in a case of carrying out binding processing on six sheets while shifting the pasting target positions in a rule shown in FIG. 18.

As stated above, the method of shifting the pasting target areas of the first sheet with respect to the pasting target areas of the second sheet in a case of binding a plurality of pasting target areas arranged along the side of the sheet is different from that in a case of binding an area nearby the corner part of the sheet, thus, a proper pasting processing can be realized in response to the binding method.

That is, for example, in a case where the user designates to bind an area nearby the corner part of the sheet, it is considered that the user generally turns the page diagonally to read the sheet bound in that way. In this case, if the pasting target areas of the first sheet are shifted with respect to the pasting target areas of the second sheet in the side direction, the part pasted in a long area in the side direction may hinder the user to turn the page diagonally. Thus, for example, in a case of binding an area nearby the corner part of the sheet, the direction of shifting the pasting target areas are not biased to a specific side direction; while in a case of binding at a plurality of binding positions arranged along a specific side direction, the pasting target areas are shifted in the specific side direction; thus, no trouble is caused when the user views the bound sheet bundle.

In addition, if it is neither the binding method of binding at a plurality of positions along the side direction of the sheet nor the binding method of binding at the corner part according to the acquired binding position information (NO in ACT 304), for example, the CPU 801 determines that it is the binding method described in (3) mentioned above, therefore, the CPU 801 carries out pasting processing while shifting the pasting target positions in a direction of a line which is parallel to any side of the sheet and passes through the center of the sheet.

Figure 20:
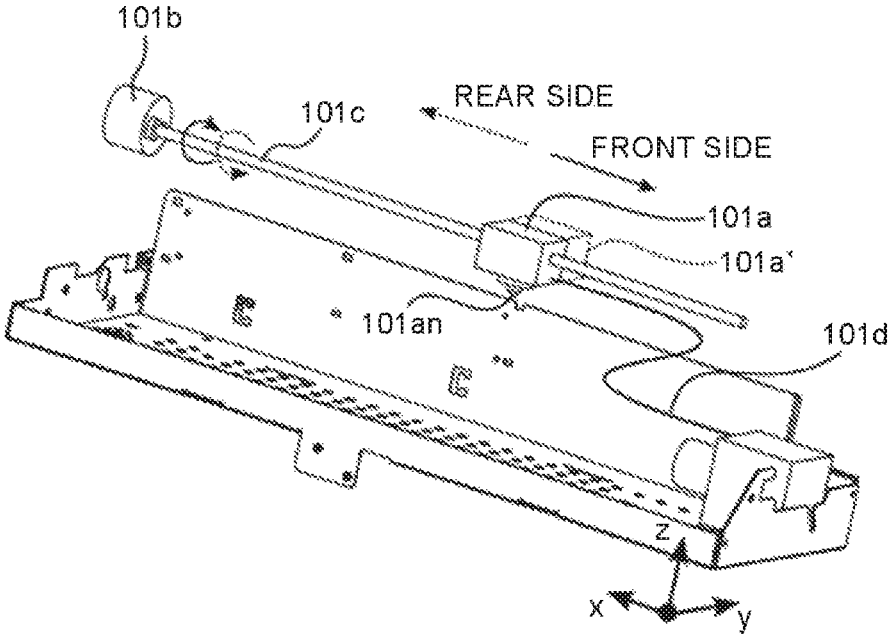
FIG. 20 is a diagram illustrating one example of a mechanism capable of moving a pasting head 101*a* in a y-axis direction.

In addition, as a mechanism for carrying out pasting processing in a pattern shown in FIG. 18 and FIG. 19, for example, a device is considered which is further provided with a pasting head 101*a*' (shown in FIG. 20) moving integrally with the pasting head 101*a*. In this way, the pasting target positions can be shifted for each sheet not only in the sliding direction (the extending direction of the shaft 101*c*) but also in a direction (direction y in FIG. 20) orthogonal to the shaft 101*c* as needed.

Of course, the present invention is not limited to this. For example, a constitution (shown in later-described FIG. 25) capable of moving the pasting section 101 in a y-axis direction through a rack and pinion mechanism may also be applied to realize the shift of the pasting target positions in the y-axis direction.

Figure 21:
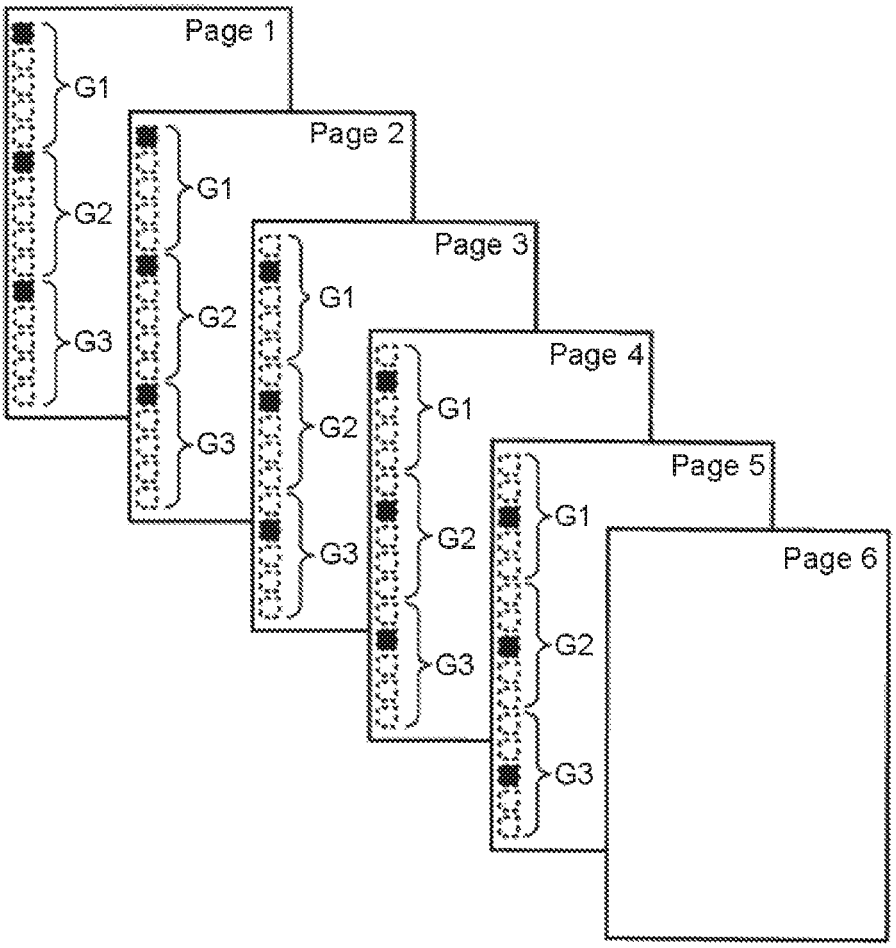
FIG. 21 is a diagram illustrating one example of pasting target positions in a case where the pasting target positions are changed every a plurality of pages.
Figure 22:
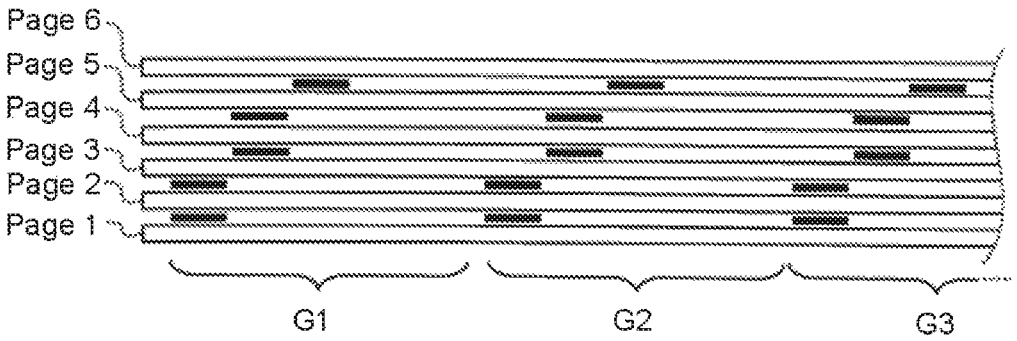
FIG. 22 is a diagram illustrating the cross-section of the sheet bundle in a case where binding processing is carried out while shifting the pasting target positions in a rule shown in FIG. 21.

Further, in the example described above, the pasting target positions connected with the both sides of any sheet are set to be at different positions in the surface direction of the sheet; however, the present invention is not limited to this. For example, as shown in FIG. 21, the pasting target positions may be changed every a plurality of pages, in this way, the pasting target positions are allowed to overlap with one another at a certain degree and the dispersion of the pasting target positions can be carried out as a whole. The pasting target positions are dispersed as a whole sheet bundle even in a case of changing the pasting target positions in such a rule, thus, the adverse effect of the thickness of the pasted part can be reduced. FIG. 22 is a diagram illustrating the cross-section of the sheet bundle in a case where binding processing is carried out while shifting the pasting target positions in the rule shown in FIG. 21.

Each operation in the processing carried out in the sheet binding apparatus described above is realized by executing a sheet binding program stored in the memory 803 through the CPU 801.

A Second Embodiment

Next, the second embodiment is described.

The second embodiment is a modification of the first embodiment described above. A plurality of pasting heads is arranged in the second embodiment, which is different from the first embodiment. Hereinafter, the components in the present embodiment having the same functions as those in the first embodiment are applied with the same reference numerals, and therefore, the detailed descriptions thereof are not repeated.

Figure 23:
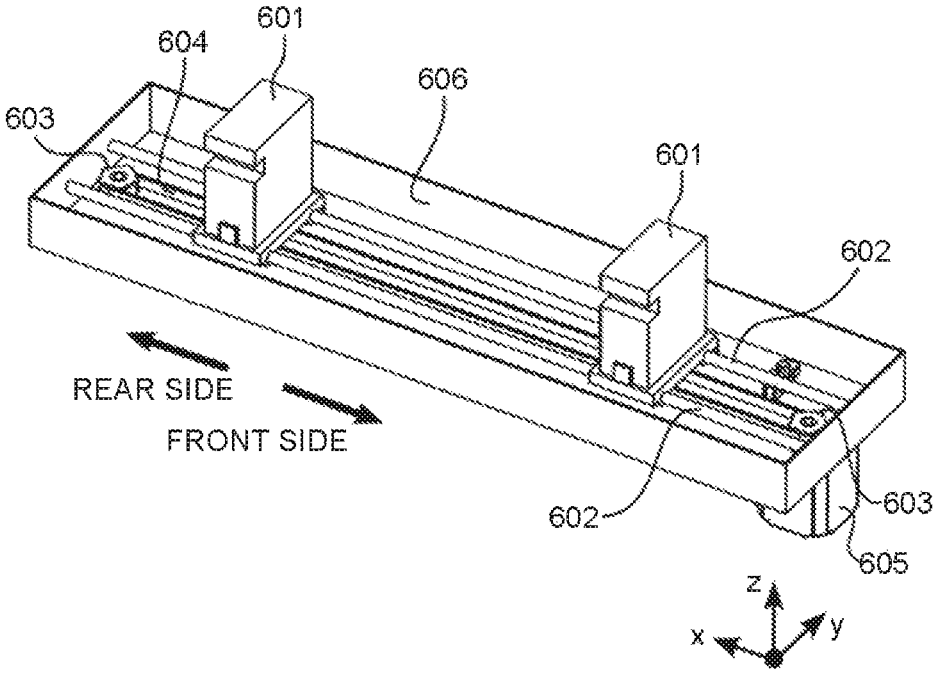
FIG. 23 is a partially exploded perspective view illustrating other constitutions of the pasting section in the binding processing section.

FIG. 23 is a partially exploded perspective view illustrating other constitutions of the pasting section in the binding processing section.

In the sheet binding apparatus according to the present embodiment, a plurality of pasting units 601 is arranged in response to each of a plurality of given pasting target areas. In this way, a plurality of pasting units is arranged from the beginning, which can improve the efficiency when carrying out pasting processing on a plurality of positions on the sheet.

Figure 24:
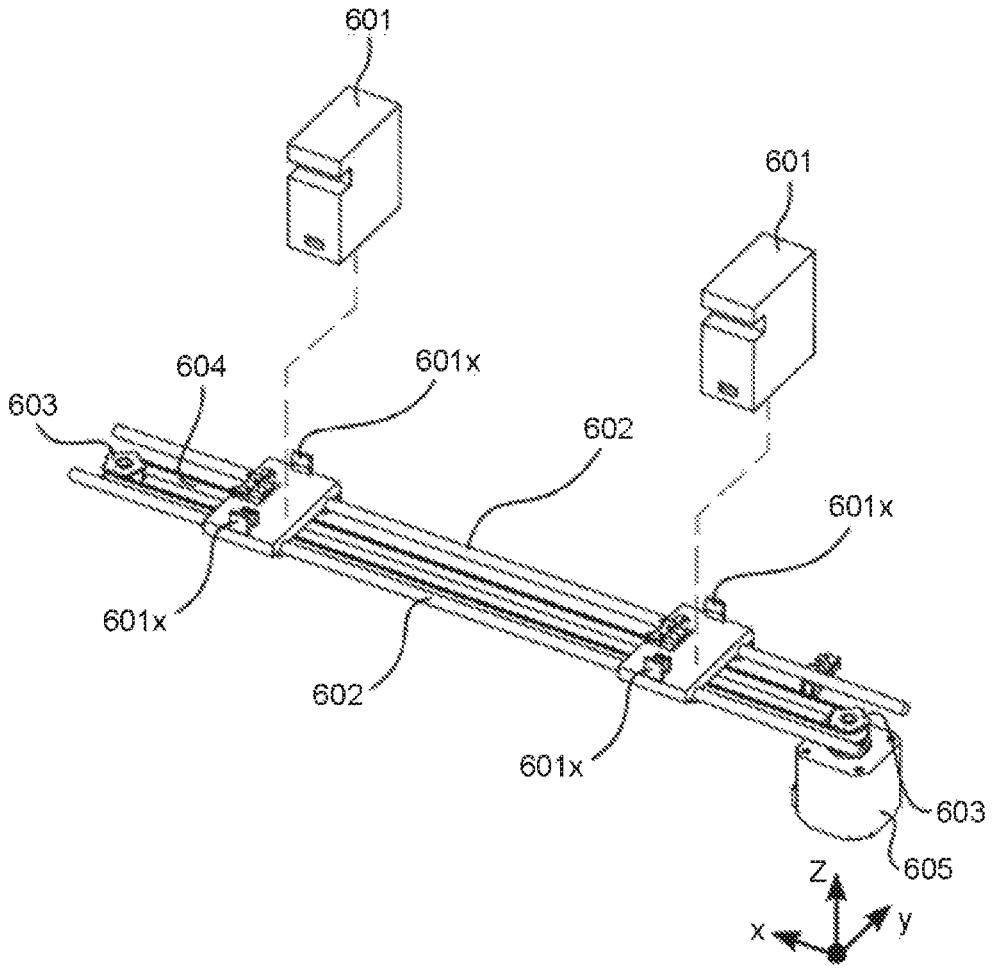
FIG. 24 is a diagram illustrating an attachment/detachment mechanism of a pasting unit 601.

Further, as shown in FIG. 24, the pasting unit 601 according to the present embodiment can be freely attached to and detached from a pedestal provided with an engaging section 601*x*, which makes the exchange job in maintenance much easier.

Moreover, the pedestal provided with the engaging section 601*x* can slide in the arrangement direction of the plurality of given pasting target areas through a shaft 602 fixed on a casing 606. The pasting unit 601 slidably supported in such a manner can reciprocate in the extending direction of the shaft 602 through a belt 604 stretched by two pulleys 603 installed on a driving shaft of a motor 605.

It goes without saying that the sheet binding apparatus with such a constitution described in the present embodiment is also capable of carrying out the binding position control based on the CPU 801 in the first embodiment described above.

Figure 25:
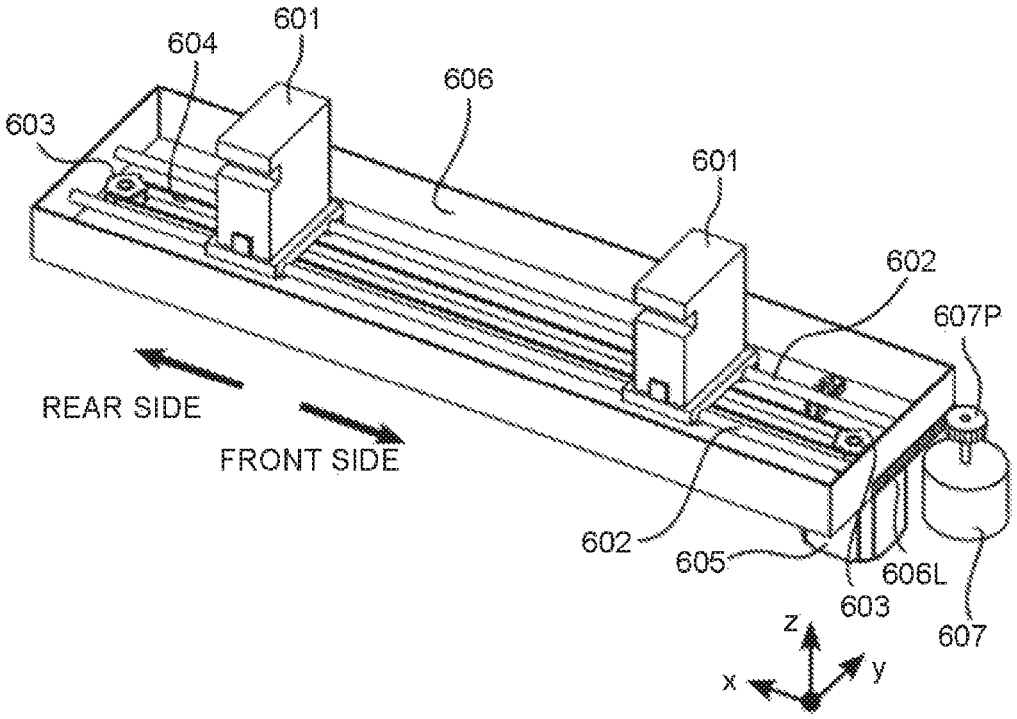
FIG. 25 is a diagram illustrating one example of a mechanism capable of moving the pasting unit 601 in a y-axis direction.

As a mechanism in a case of carrying out pasting processing in the pattern shown in FIG. 18 and FIG. 19, for example, the example shown in FIG. 25 can be listed. In FIG. 25, such a constitution is shown as an example, that is, a rack gear is formed on the side (the side parallel to the y-axis) of the casing 606, and the casing 606 can be shifted in the y-axis direction through a pinion gear 607P installed on the output shaft of a motor 607. The motor 607 can be driven and controlled by, for example, the CPU 801.

In this way, the pasting target positions can be shifted for each sheet not only in the extending direction of the shaft 602, but also in a direction (y direction in FIG. 25) orthogonal to the shaft 602 as needed.

In addition, in each embodiment described above, the pasting unit for carrying out pasting processing on the sheet is not limited to a unit which jets liquid glue. For example, other forms are listed as follows:

(1) pasting of double-sided tape with both sides coated with glue (2) coating of pasty glue (3) coating of liquid glue (4) coating of glue stick Further, such a constitution is exemplified in each embodiment described above that the pasting target positions are changed based on the number of sheets of the sheet bundle to be subjected to binding processing and the binding position on the sheet when carrying out the binding processing. However, the present invention is not limited to this. It goes without saying that the shifting method of the pasting target areas can also be changed based on, for example, the content (setting information of blank part) of the image formed on the sheet by the image forming apparatus 7.

A Third Embodiment

Next, the third embodiment is described.

Herein, for the sake of convenience of description, there is a case in which the components having the same functions as those in each embodiment described above are applied with reference numerals or names different from those in each embodiment described above. However, the components practically having the same functions from the description of the embodiments, though applied with different reference numerals or names, are the same with the corresponding parts in each embodiment described above. Thus, for example, a paper discharge tray 6 in the present embodiment is the same as the second discharge tray 105 described in the first and the second embodiments.

Generally, a paper post-processing apparatus for binding a plurality of paper discharged from an image forming apparatus into a bundle and then discharging the paper bundle has been proposed. Such a post-processing apparatus, which is also called as, for example, finisher, carries out needle binding at given positions with metal staple needles.

However, if stapling processing is carried out with staple needles, needle holes are generated in the paper after the staple needles are removed, which may adversely affect the reuse of the paper. Further, the pulled out metal staple needles may slip into somewhere.

Thus, a bookbinding apparatus is proposed in which either a stapling processing section using staple needles or a glue binding section for carrying out glue binding using glue is arranged in a replaceable manner.

However, the conventional bookbinding apparatus mentioned above does not take the glue adhesive force into consideration. Particularly, from a view point of reusing the so-called copy paper, if the glue adhesive force is strong, the paper can hardly be peeled off one by one, which may damage the paper. On the other hand, if the glue adhesive force is weak, the paper can be peeled off easily, which cannot realize the function of binding paper.

Further, it is necessary to exchange unit when the conventional bookbinding apparatus mentioned above changes from a binding method based on staple needles to a binding method based on glue, which is inconvenient.

In the present embodiment, a paper post-processing apparatus is provided which is capable of carrying out glue binding of paper bundle easily and carrying out gluing processing using glue having proper adhesive force in response to the thickness of the paper and the like Further, a paper post-processing apparatus is provided which is capable of selectively executing either of the binding method based on staple needles and the binding method based on glue.

The paper post-processing apparatus according to the present embodiment is described below with reference to the accompanying drawings.

Figure 26:
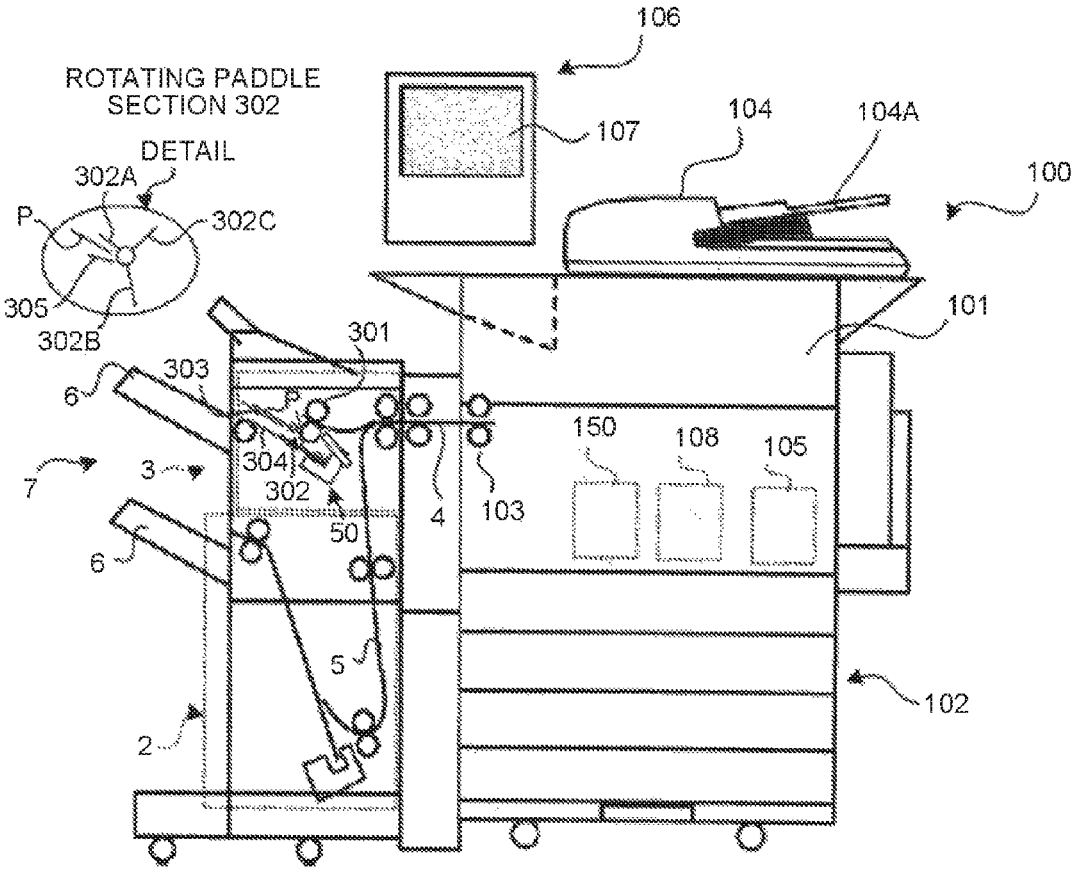
FIG. 26 is a schematic view illustrating a state in which a post-processing apparatus is connected with an image forming apparatus according to a third embodiment.
Figure 27:
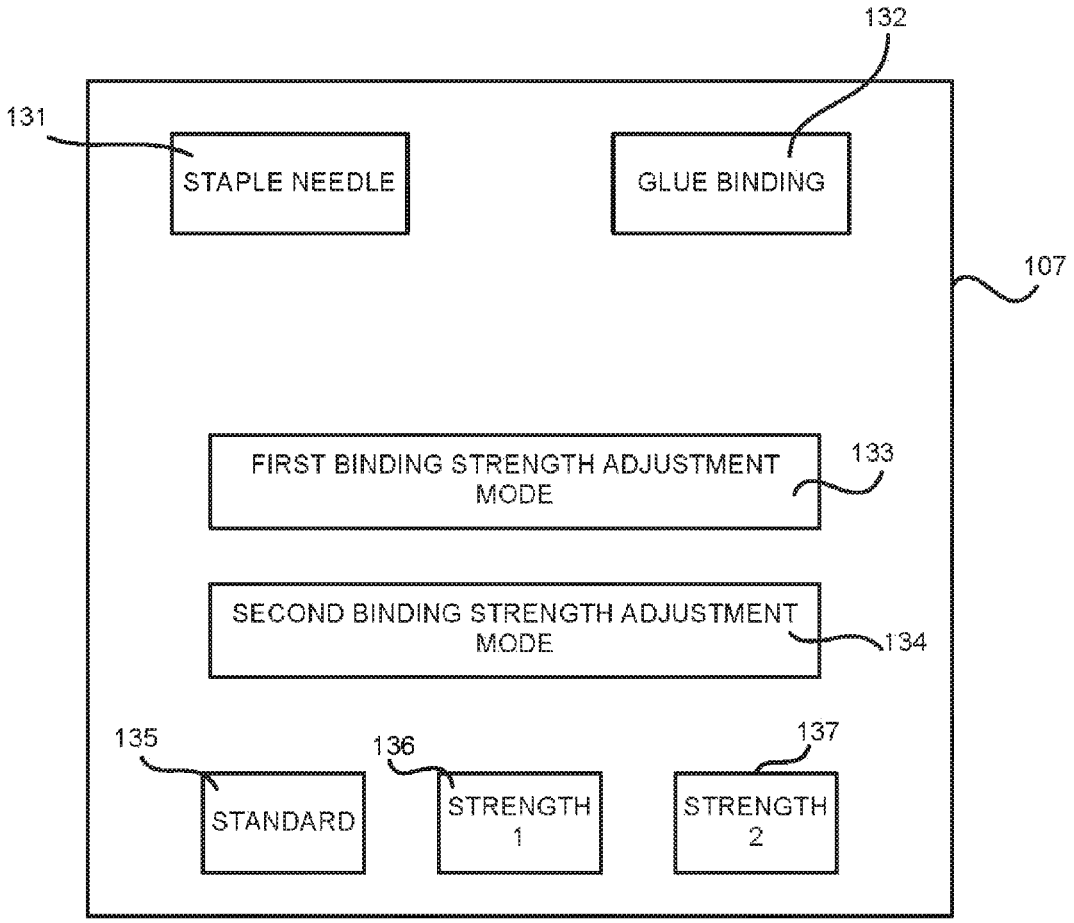
FIG. 27 is a diagram illustrating a finisher selection screen displayed on a display section of FIG. 26.

FIG. 26 is a front view illustrating a state in which the paper post-processing apparatus (finisher) is attached to the image forming apparatus, and FIG. 27 is an enlarged view of the finisher shown in FIG. 26.

In FIG. 26, a finisher 1 comprises a staple needle binding section 2 for binding a plurality of paper P with staple needles; a glue binding section 3 for carrying out binding processing with glue instead of staple needles; a first conveyance section 4 for conveying the paper P discharged from an image forming apparatus 100 to the glue binding section 3; a second conveyance section 5, which branches off from the first conveyance section 4, for conveying the paper P to the staple needle binding section 2; and a paper discharge tray section 7 provided with a plurality of paper discharge trays 6 which can be moved vertically. Further, the paper bundles subjected to binding processing by the staple needle binding section 2 and the glue binding section 3 are discharged to the paper discharge trays 6 of the paper discharge tray section 7.

The MFP 100 includes a paper feed cassette section 102, an image forming process section (not shown), a fixing section (not shown) and a discharge roller section 103 in an apparatus main body 101. For example, a toner image formed by the image forming process section is transferred to the paper P fed from the paper feed cassette section 102. Then, the unfixed toner image transferred to the paper P is fixed by the fixing section, and then the paper P on which the toner image is fixed is discharged to the outside of the apparatus through the discharge roller section 103. The paper P discharged from the discharge roller section 103 is fed to the finisher 1.

The MFP 100 includes an automatic document feeder (ADF) 104. A sheet-like document set on a document feeding table 104A is fed to a scanner section (not shown) one by one, and the read document information is temporarily stored in a memory section 105. For example, the document information sent from a personal computer (not shown) and the like, the document information read by the scanner section through the ADF 104, the paper information such as the number of printings of the printing paper P and the thickness of the printing paper P, and the like are stored in the memory section 105.

An operation section 106 of the image forming apparatus 100 can carry out various operations by viewing a display screen displayed on a display section 107. A control section 108 controls the whole MFP, and sends the paper information such as the number of printings and the thickness of the printing paper stored in the memory section 105 to a finisher control section 150. Though the finisher control section 150 is arranged in the image forming apparatus 100 in the present embodiment, it may also be arranged in the finisher 1.

The operation section 106 selects a binding method of paper P based on the staple needle binding section 2 or the glue binding section 3 in the finisher 1. Further, in a case where the glue binding is selected, a first binding strength adjustment mode and a second binding strength adjustment mode can be selected. The first binding strength adjustment mode and the second binding strength adjustment mode includes a standard strength, a first binding strength stronger than the standard strength and a second binding strength stronger than the first binding strength, which can be selected by the user. As shown in FIG. 27, the modes and the selection of the strength are displayed on, for example, a touch panel type display section 107 of the operation section 106 and selected by an operator by pressing the display area.

FIG. 27 shows a finisher selection screen of the display section 107. A staple needle display section 131 for selecting the binding method based on the staple needle binding section 2, a glue binding display section 132 for selecting the glue binding method, a first binding strength adjustment mode display section 133, a second binding strength adjustment mode display section 134, a standard strength display section 135, a first binding strength display section (strength 1 display) 136 and a second binding strength display section (strength 2 display) 137 are displayed on the finisher selection screen.

Herein, the first binding strength adjustment mode adjusts the binding strength by changing the pasting times (coating times) of glue. The second binding strength adjustment mode adjusts the binding strength by changing the pasting width (coating width) of the glue. In addition, the binding strength adjustment in each mode is described later.

In the finisher 1, the glue binding section 3 includes, nearby a paper discharge side of a paper discharge roller 301 arranged at the conveyance end part of the first conveyance section 4, a rotating paddle section 302 and a lever-like grip section 305 which reciprocates in a given range, and grips the conveyance rear end of the discharged paper P between a first paddle 302A of the rotating paddle section 302 and the grip section 305 from both surfaces of the paper. Further, the discharged paper P stands by on a standby tray 303. Herein, the conveyance direction of the paper P is referred to as a longitudinal alignment direction and the paper surface direction orthogonal to the longitudinal alignment direction is referred to as a lateral alignment direction.

The standby tray 303 is arranged towards the front side of the longitudinal alignment direction in an upward-inclined manner, and if one sheet of paper P is fed, the standby tray 303 is horizontally opened towards the outer side of the lateral alignment direction to drop the loaded paper P down to a processing tray 304 below. At this time, the griping operation of the grip section is released, and the rotating paddle section 302 starts to rotate almost at the same time; during the first rotation, a plurality of other paddles 302B and 302C hit the rear end part of the paper P downwards in sequence to forcibly drop the paper P down to the processing tray 304. At this time, the paddle with long leg contacts with the surface of the paper P and meanwhile presses the paper P towards the rear side of the longitudinal alignment direction. A positioning section 306 is arranged at the rear side of the longitudinal alignment direction of the processing tray 304, and when the rear ends of the paper P abuts against the positioning section 306, the positioning of the paper P in the longitudinal alignment direction is carried out, in this way, the rear ends of paper P are aligned.

In the glue binding section 3, though a double-sided adhesive tape with strong adhesive force is pasted (in a way described later) on the surface of the rear end part of the longitudinal alignment direction of the paper P, when a next binding paper contacts with and moves on the paper P pasted with adhesive tape, the rear end of the next paper can reach the positioning section 306 smoothly without sticking to the double-sided adhesive tape directly. The double-sided adhesive tape is adhered to the paper by applying pressure force.

In addition, the staple needle binding section 2 has a same constitution as the conveyance system of paper P of the glue binding section 3, and therefore the description thereof is omitted.

The glue binding section 3 is provided with a tape stamping device 50 which carries out glue binding on the paper of which the rear ends are aligned by the positioning section 306 one by one using adhesive tape with strong adhesive force to bind a plurality of paper into one bundle.

Figure 28:
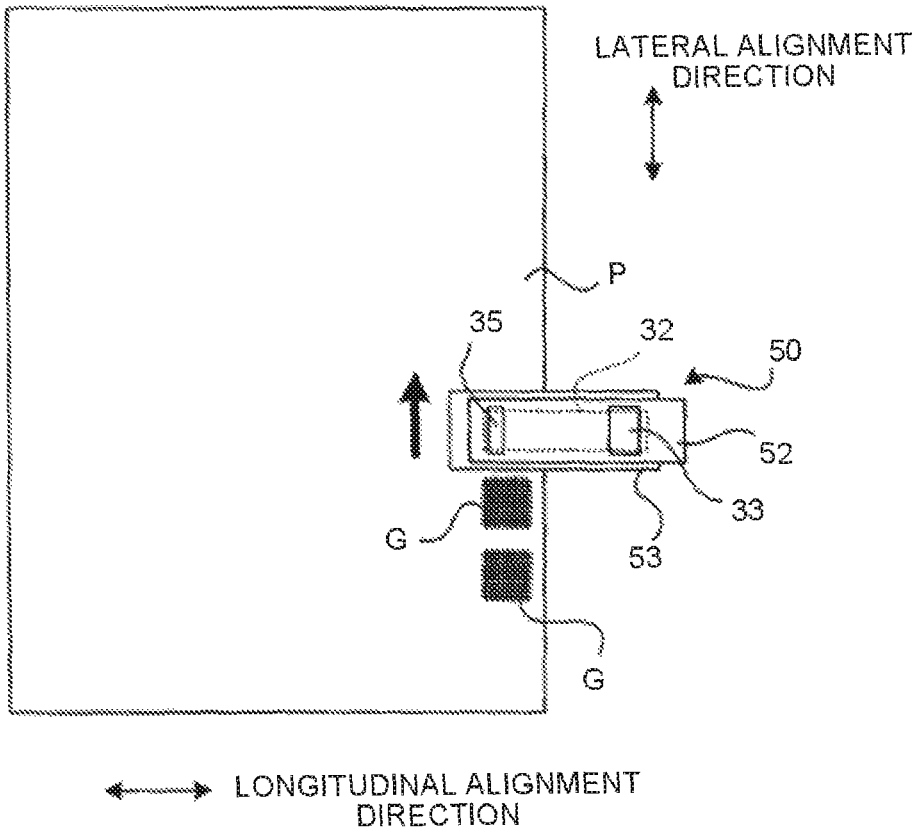
FIG. 28 is a diagram illustrating the tape pasting operation carried out by a glue binding section according to the third embodiment.

In the present embodiment, as shown in FIG. 28, the tape stamping device 50 capable of moving in the lateral alignment direction moves in the lateral alignment direction intermittently to paste the double-sided adhesive sheet at a given width (the width direction is the longitudinal alignment direction). The pasted double-sided adhesive sheet is referred to as a cut adhesive sheet part G.

Figure 29:
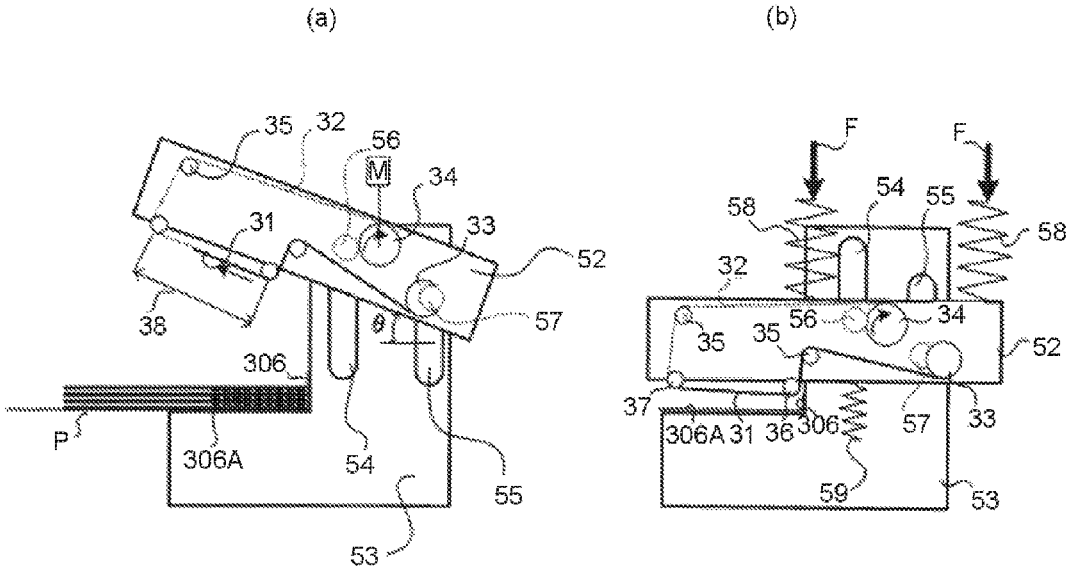
FIG. 29 is a diagram illustrating a tape stamping device according to the third embodiment, wherein (a) shows a standby position and (b) shows a stamping state.

FIG. 29 shows the tape stamping device 50.

The tape stamping device 50 is arranged nearby the positioning section 306 which abuts against the rear ends of the longitudinal alignment direction of the paper P to align the ends of the paper P.

The tape stamping device 50 includes a tape head 52 and a stamping stand 53 which holds the tape head 52 in a tiltable manner. The tape head 52 can be tilted between a standby position (shown in FIG. 29(*a*)) where the tape head 52 is inclined upwards at an angle $\theta$(0 degree$<\theta<$90 degrees) with respect to a paper placing surface 306A of the positioning section 306 and a press position (shown in FIG. 29(*b*)) where tape head 52 is parallel to the paper placing surface 306A. At the standby position, the tape head 52 rises and inclines upwards to a position higher than a maximum height of the paper P placed on the paper placing surface 306A so that the paper P dropped down to the processing tray 304 can reach the positioning section 306 easily. Of course, it is also applicable that the tape head 52 is not inclined at the standby position.

The tape head 52 is tilted from the standby position to the press position to apply a pressing force F to contact the paper P with the cut adhesive sheet part G, and then returned to the standby position again; and such a series of operations are referred to as tape head stamping operation.

The mechanism for carrying out the tape head stamping operation includes a first long hole 54 formed on the stamping stand 53 to be long in the vertical direction, a second long hole 55 of which the upper end is lower than that of the first long hole 54, a first engaging pin 56 engaged with the first long hole 54, and a second engaging pin 57 engaged with the second long hole 55, and the first engaging pin 56 and the second engaging pin 57 are installed at the side of the tape head 52. The first engaging pin 56 is engaged with an auxiliary long hole (not shown) which is long in the longitudinal direction against the side of the tape head 52. The auxiliary long hole is arranged so that after the second engaging pin 57 reaches the upper end of the second long hole 55, the first engaging pin 56 can further move upwards until it reaches the upper end of the first long hole 54. The first engaging pin 56 moves in the auxiliary long hole, in this way, the tape head 52 starts to tilt by taking the second engaging pin 57 as a fulcrum.

Further, the pressing force F generated by a pressing force applying section (not shown) is applied downwards to the tape head 52 through a first elastic body 58 such as a spring and the like. If the pressing force F is applied to the tape head 52, the tape head 52 moves downwards against the elastic force of a second elastic body 59 such as a spring and the like. When the first engaging pin 56 reaches the upper end position of the second long hole 55, the tape head 52 is at a horizontal position shown in FIG. 30, and then the tape head 52 further moves downwards in a state of maintaining the horizontal position, as a result, a later-described transfer contact surface of tape is contacted with the surface of the paper P. In this state, even if the pressing force F is applied to the first elastic body 58, the tape head 52 will not move downwards any more, and the first elastic body 58 is shorted, in this way, the double-sided adhesive sheet is pasted on the paper P.

Then, if the pressing force F is removed, the elastic force accumulated in the second elastic body 59 is released, and therefore the tape head 52 returns to the standby position. At this time, the pasting part of the double-sided adhesive sheet pasted on the paper P is remained as the cut adhesive sheet part G.

A roll tape 33, which is obtained by pasting a tape-like double-sided adhesive sheet 31 on the single side of a belt-like mount tape 32 indicated by dashed lines in a peelable manner and then winding the mount tape 32 pasted with double-sided adhesive sheet 31 on a given winding shaft (first reel) in a roll shape, is arranged in the tape head 52, and the starting end side of the roll tape 33 is wound on a winding shaft 34. Further, the roll tape 33 is wound, in a way shown in FIG. 30, by two folding back rollers 35 and two transfer contact surface forming rollers 36 and 37 facing each other at a distance along the longitudinal alignment direction. Further, the winding shaft 34 (second reel) is driven by a tape winding mechanism consisting of a motor M and the like to wind the roll tape. The first transfer contact surface forming roller 36 and the second transfer contact surface forming roller 37 protrude downwards from the lower surface of the tape head 52, and the space between the rollers in the longitudinal alignment direction is referred to as a transfer contact surface 38. Moreover, the part on the lower surface 52A of the tape head 52 corresponding to the transfer contact surface 38 is formed as a wall to contact with the mount tape 32.

In a direction (hereinafter referred to as width direction) along the space between the first transfer contact surface forming roller 36 and the second transfer contact surface forming roller 37, the feeding amount of the roll tape 33 and the width of the double-sided adhesive sheet 31 fed from the first transfer contact surface forming roller 36 in the width direction can be adjusted by controlling the rotation of the motor M. If the width of the double-sided adhesive sheet 31 is short, the adhesive force between the paper P is weak. For example, in a case where the paper P is thick, the stiffness of the paper is high, thus, a strong peel force is applied easily in the direction of peeling off the adhesion when a user turning the page of the paper bundle. At this time, if the width of the double-sided adhesive sheet 31 is wide, the adhesive force is increased correspondingly. On the other hand, in a case where the paper P is thin, the peel force applied to the adhering part is weak.

Thus, the adhesive strength can be adjusted by adjusting the width of the double-sided adhesive sheet 31 fed to the transfer contact surface 38.

For example, if the length between the first transfer contact surface forming roller 36 and the second transfer contact surface forming roller 37 is divided into three equal parts, a state in which the double-sided adhesive sheet 31 is fed for an amount equal to one third of the length from the first transfer contact surface forming roller 36 is set as the standard binding strength, a state in which the double-sided adhesive sheet 31 is fed for an amount equal to two third of the length is set as the first binding strength, and a state in which the double-sided adhesive sheet 31 is fed for an amount equal to the whole length from the first transfer contact surface forming roller 36 to the second transfer contact surface forming roller 37 is set as the second binding strength. The feeding amount can be manually set by the user or automatically set based on the paper information such as the thickness of the paper and the like to obtain a paper bundle the paper of which will not be peeled off easily.

This case corresponds to a case in which the second binding strength adjustment mode shown in FIG. 27 is selected. If the display of the standard display section 135 is selected, the double-sided adhesive sheet 31 is fed for an amount equal to one third of the length from the first transfer contact surface forming roller 36, if the display of the strength 1 display section 136 is selected, the double-sided adhesive sheet 31 is fed for an amount equal to two third of the length, and if the display of the strength 2 display section 137 is selected, the double-sided adhesive sheet 31 is fed for an amount equal to the whole length from the first transfer contact surface forming roller 36 to the second transfer contact surface forming roller 37.

Dot parts obtained by, for example, making the side of the mount tape 32 as a concave portion and the side of non-pasting surface as a convex portion are formed in a matrix state on the double-sided adhesive sheet 31, and the double-sided adhesive sheet 31 can be split at the boundary between the pasting part and the non-pasting part. Thus, after the double-sided adhesive sheet 31 is pressed against and pasted on the pasting surface of the binding part of the paper P, if the double-sided adhesive sheet 31 is returned in a direction opposite to the pressing direction, the double-sided adhesive sheet 31 is split between the dot parts at the boundary between pasting area and the non-pasting area, in this way, the double-sided adhesive sheet 31 can be pasted on the binding area of the paper P for a desired pasting length.

Further, the binding strength can be increased by pasting a plurality of layers of cut adhesive sheet part G instead of one layer. This corresponds to the first binding strength adjustment mode shown in FIG. 27. In this case, it can be set that one layer of cut adhesive sheet part G corresponds to the standard binding strength, two layers correspond to the first binding strength, and three layers correspond to the second binding strength.

In addition, the mechanism carrying out tape head stamping operation and the constitution of the roll tape described above are just exemplified as one example, and the present invention is not limited to this.

Figure 30:
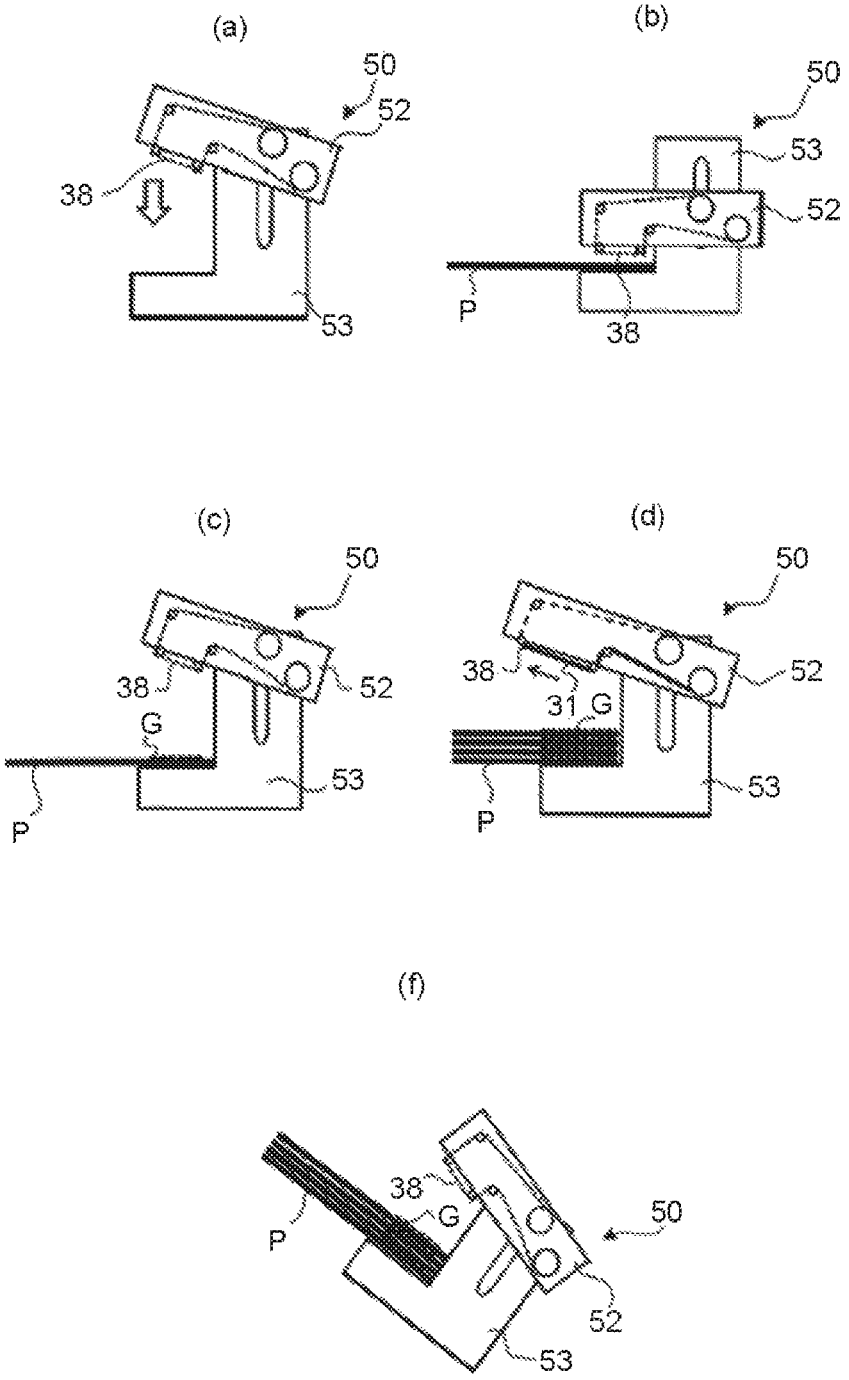
FIG. 30 is a diagram illustrating the stamping operations carried out by the tape stamping device shown in FIG. 29, wherein (a) shows a standby position of a tape head, (b) shows a pressing state in which the stamping operation of the tape head is started, the tape head moves towards the paper for stamping to coat a given width of double-sided adhesive sheet on the paper, (c) shows a state in which the tape head returns to the original standby position after the double-sided adhesive sheet is coated, (d) shows a state of the tape head in which the double-sided adhesive sheet is fed to a transfer contact surface, and (f) shows a inclined position of the tape stamping device arranged in a glue binding section.

FIG. 30 is a diagram illustrating the tape stamping operations carried out in a case where, for example, the second binding strength adjustment mode and the second binding strength are selected.

In FIG. 30(*a*), the tape head 52 rises to the standby position to wait for the paper P to be supplied to the processing tray 304. In FIG. 30 (*b*), the paper is supplied to the processing tray 304 and the tape stamping operation of the tape head 52 is started in a state in which the rear end of the paper contacts with the positioning section 306; after one layer of cut adhesive sheet part G is pasted, as shown in FIG. 30 (*c*), the tape head 52 returns to the original standby position, and the tape stamping operation carried out for one sheet of paper P is completed. Then, as shown in FIG. 30 (*d*), the feeding of the roll tape 33 is started, and after the double-sided adhesive sheet 31 is fed for a length from the first transfer contact surface forming roller 36 to the second transfer contact surface forming roller 37, the feeding of the roll tape 33 is ended. Though FIG. 30(*a*)-(*d*) described above show a state in which the tape stamping device 50 is arranged at a horizontal position, actually, the tape stamping device 50 is arranged in an inclined manner as shown in FIG. 30 (*f*).

Figure 31:
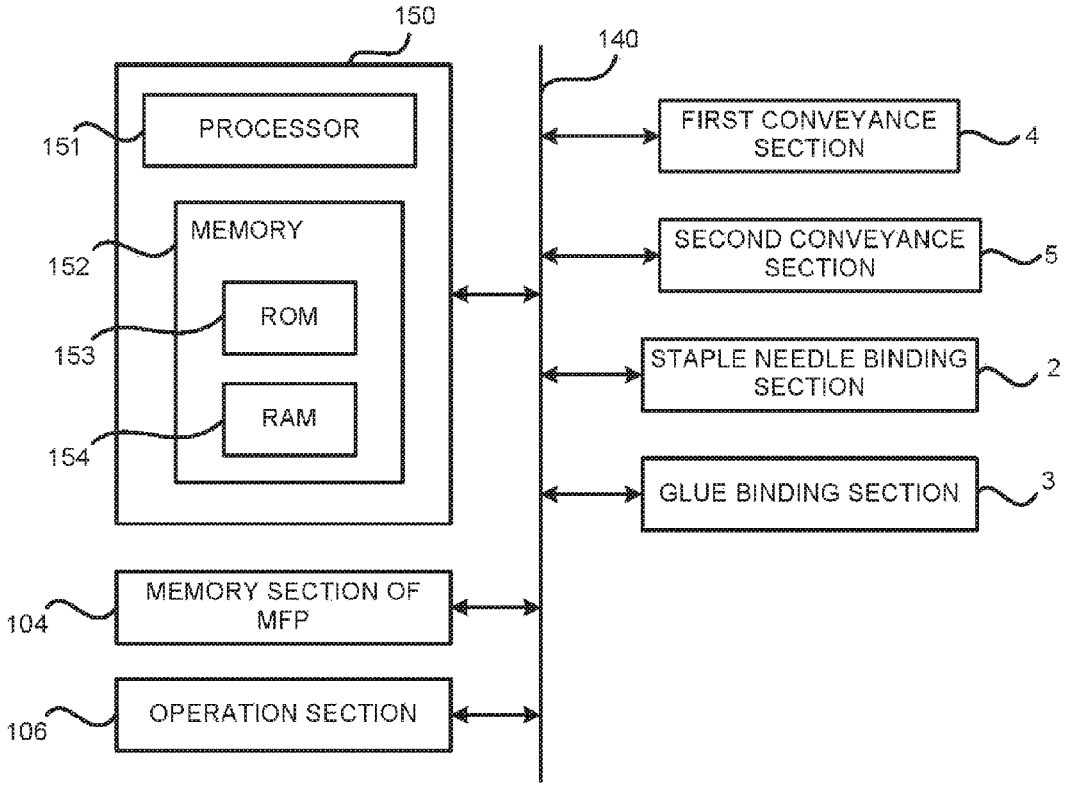
FIG. 31 is a control block diagram illustrating the finisher control carrying out the post-processing operations shown in FIG. 26.

FIG. 31 is a control block diagram illustrating the finisher control carrying out the post-processing operations shown in FIG. 26. The control block of the finisher control consists of the finisher control section 150, the memory section 105 of the MFP 100, the operation section 106, the first conveyance section 4, the second conveyance section 5, the staple needle binding section 2, the glue binding section 3 and the like, each of which is connected with each other through a bus line 140.

The finisher control section 150 comprises a processor 151 including a CPU (Central Processing Unit) or a MPU (Micro Processing Unit), and a memory 152. The finisher control section 150 controls the whole finisher 1 to convey the paper to the glue binding section 3 through the first conveyance section 4 to carry out post-processing based on glue binding, or convey the paper to the staple needle binding section 2 through the second conveyance section 5 to carry out post-processing based on staple needles based on the operation information of the operation section 106 and the paper information from the memory section 105.

The memory 152, which is, for example, a semiconductor memory, includes a ROM (Read Only Memory) 153 for storing various control programs, and a RAM (Random Access Memory) 154 for providing a temporary work area for the processor 151. For example, the ROM 153 stores the number of paper of one paper bundle and the like.

If the glue binding display section 132 is selected through the operation section 106, the first conveyance section 4 and the glue binding section 3 are driven. Generally, for example, the standard binding strength is set in the second binding strength adjustment mode. Then after the paper thickness information is acquired from the memory section 105, the first binding strength or the second binding strength is set according to the thickness information. It goes without saying that the operation of turning on the first binding strength adjustment mode display section 133 or the second binding strength adjustment mode display section 134 and the selection, if necessary, on the standard binding strength, the first binding strength and the second binding strength can be carried out through manual operation on the operation section 106.

Figure 32:
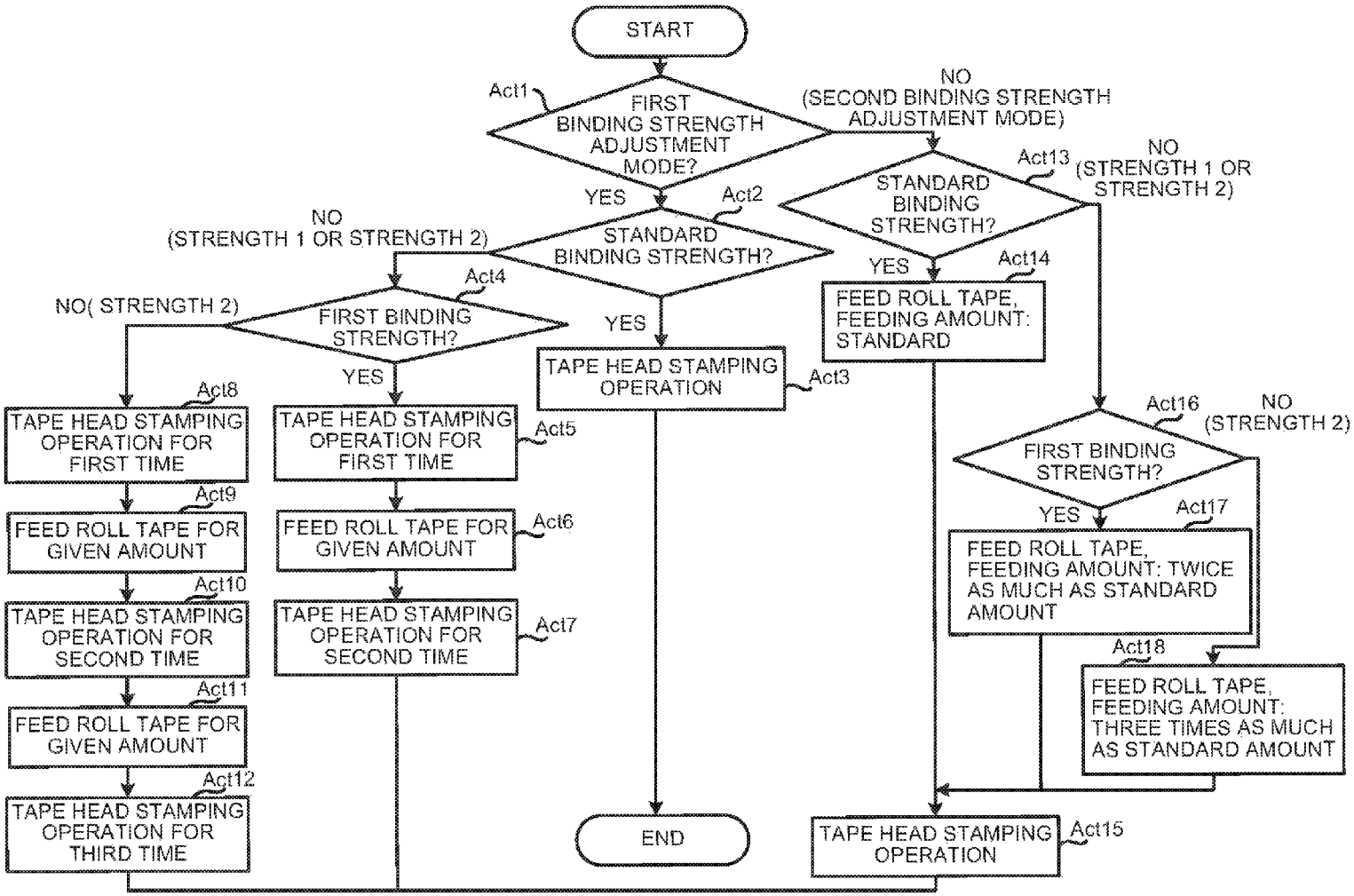
FIG. 32 is a flowchart illustrating a procedure of paste binding operations carried out by the finisher control section shown in FIG. 31.

The operation of pasting the cut adhesive sheet part G on one sheet of paper P in a case where the glue binding is selected is described based on the flowchart shown in FIG. 32. In addition, in a case of pasting the cut adhesive sheet part G on a plurality of positions in the lateral alignment direction as shown in FIG. 28, the tape stamping device 50 is intermittently driven in the lateral alignment direction.

In ACT 1, it is determined whether or not the first binding strength adjustment mode is selected, and if the first binding strength adjustment mode is selected, ACT 2 is taken; on the other hand, if the second binding strength adjustment mode is selected, ACT 13 is taken.

In ACT 2, it is determined whether or not the standard binding strength is selected, and if the standard binding strength is selected, ACT 3 is taken, otherwise (the first binding strength or the second binding strength is selected), ACT 4 is taken.

In ACT 3, the tape stamping operation based on the tape head 52 is carried out once, and then the processing is ended.

In ACT 4, it is determined whether or not the first binding strength is selected, and if the first binding strength is selected, ACT 5 is taken; on the other hand, if the second binding strength is selected, ACT 8 is taken.

In ACT 5, the tape stamping operation based on the tape head 52 is carried out for the first time to paste the cut adhesive sheet part G on a given position on the paper P, and then ACT 6 is taken.

In ACT 6, the double-sided adhesive sheet 31 of the roll tape 33 is fed for a given amount corresponding to the width of the cut adhesive sheet part G, and then ACT 7 is taken.

In ACT 7, the tape stamping operation based on the tape head 52 is carried out for the second time to paste a second layer of cut adhesive sheet part G on the cut adhesive sheet part G pasted on the paper P previously, and then the processing is ended.

In ACT 4, if it is determined that the second binding strength is selected, it needs to overlap three layers of cut adhesive sheet part G, thus, the operations same as those from ACT 5 to ACT 7 are carried out from ACT 8 to ACT 10, and then in order to overlap the third layer of cut adhesive sheet part G, the double-sided adhesive sheet 31 of the roll tape 33 is fed for a given amount corresponding to the width of the cut adhesive sheet part G in ACT 11, and then ACT 12 is taken.

In ACT 12, the tape stamping operation based on the tape head 52 is carried out for the third time to paste the third layer of cut adhesive sheet part G on the second layer of cut adhesive sheet part G pasted on the paper P previously, and then the processing is ended.

On the other hand, if it is determined that the second binding strength adjustment mode is selected in ACT 1, similar to ACT 2, it is determined whether or not the standard binding strength is selected in ACT 13, and if the standard binding strength is selected, ACT 14 is taken, otherwise (the first binding strength or the second binding strength is selected), ACT 16 is taken.

In ACT 14, the roll tape 33 is fed for a standard amount, and then ACT 15 is taken.

In ACT 15, the tape stamping operation based on the tape head 52 is carried out to paste a standard width of cut adhesive sheet part G on the given position on the paper P, and then the processing is ended.

In ACT 16, similar to ACT 4, it is determined whether or not the first binding strength is selected, and if the first binding strength is selected, ACT 17 is taken; on the other hand, if the second binding strength is selected, ACT 18 is taken.

In ACT 17, the roll tape is fed for an amount twice as much as the standard amount, and then ACT 15 is taken to carry out the tape stamping operation based on the tape head to paste the cut adhesive sheet part G on the given position on the paper P for a width twice as wide as the standard width, and then the processing is ended.

In ACT 18, the roll tape is fed for an amount three times as much as the standard amount, and then ACT 15 is taken to carry out the tape stamping operation based on the tape head to paste the cut adhesive sheet part G on the given position on the paper P for a width three times as wide as the standard width, and then the processing is ended.

In this way, if the first binding strength adjustment mode is selected, and in a case where the glue margin is narrow, the glue coating density can be increased to increase the glue adhesive force, which is advantageous. If the second binding strength adjustment mode is selected, the thickness of the binding part of the paper bundle can be reduced.

In FIG. 29, the feeding direction of the roll tape 33 is a direction from the first transfer contact surface forming roller 36 towards the second transfer contact surface forming roller 37, however, it is not limited to this. The feeding direction may be a direction opposite to the direction described above.

A Fourth Embodiment

Next, the fourth embodiment is described.

The fourth embodiment is a modification of the third embodiment described above. Hereinafter, the components in the present embodiment having the same functions as those in the third embodiment are applied with the same reference numerals, and therefore, the detailed descriptions thereof are not repeated.

Figure 33:
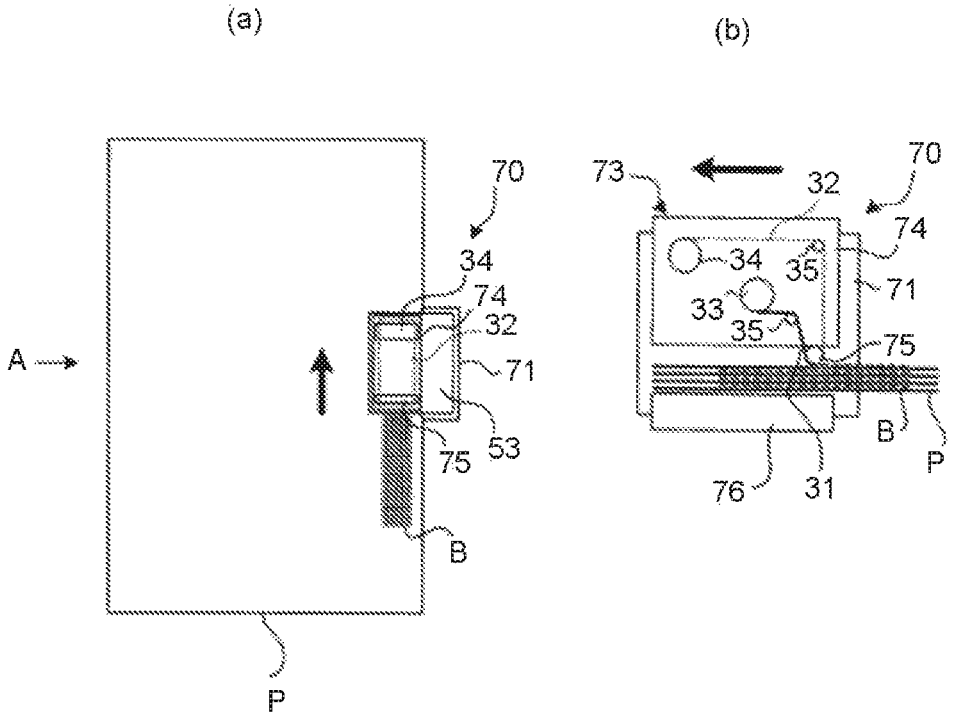
FIG. 33 is a diagram illustrating a tape stamping device according to a fourth embodiment, wherein (a) is a top view and (b) is a diagram viewing from a direction indicated by an arrow A in (a)

FIG. 33 is a diagram illustrating a tape stamping device according to the fourth embodiment, FIG. 33(*a*) is a top view and FIG. 33(*b*) is a diagram viewing from a direction indicated by an arrow A in FIG. 33(*a*).

In a tape stamping device 70 according to the present embodiment, the conveyance direction of the roll tape 33 is set as the lateral alignment direction, a stamping support base 72 is arranged on a moving body 71 which can move in the lateral alignment direction, and a tape head 73 is arranged on the stamping stand 53 arranged on the stamping support base 72 in the same way as shown in FIG. 29.

The tape head 73 is provided with the same roll tape 33 as that described in the third embodiment shown in FIG. 29 in a case 74, and the starting end side of the roll tape 33 is wound on the winding shaft 34. Further, the roll tape 33 is wound, in a way shown in FIG. 33(*b*), by two folding back rollers 35 and a transfer roller 75 having a rotation shaft in the longitudinal alignment direction. The transfer roller 75 protrudes downwards from the lower surface of the case 74 to press the double-sided adhesive tape 31 towards the binding margin part of the paper P.

Further, in the moving body 71, a base member 76 for supporting the rear end part of the paper P is arranged at a position opposite to the transfer roller 75 along the lateral alignment direction to support the paper P during the stamping processing.

The moving body 71 is moved in the lateral alignment direction by a driving mechanism (not shown). At this time, such a state is maintained in which the tape head 73 applies a pressing force to press and paste the double-sided adhesive tape 31 on the paper P through the transfer roller 75.

As stated above, if the tape head 73 is moved through the moving of the moving body 71, as to the roll tape 33, the double-sided adhesive tape 31 is peeled off from the mount tape 32 and pasted on the paper P under the pressing force of the transfer roller 75, and the mount tape 32 is moved and fed as the double-sided adhesive tape 31 is pulled, in this way, a belt-like adhesive sheet part B is pasted on the paper P. At this time, the winding shaft 34 may be rotated under the driving of a motor to wind the mount tape; alternatively, the winding shaft 34 is rotated in synchronization under the moving force of the tape head 73 towards the lateral alignment direction to wind the mount tape.

In the present embodiment, the binding strength can be adjusted by adjusting the moving distance towards the lateral alignment direction.

In accordance with each embodiment described above, the pasting area of the double-sided adhesive tape is adjusted, or the double-sided adhesive tape is overlapped with the thickness and the like of the paper taken into consideration, in this way, the paper can be peeled off easily without any damage and the copy paper and the like can be, reused.

In accordance with the third and the fourth embodiments, for example, there is provided a sheet post-processing apparatus the constitutions of which are as follows.

(1) A sheet post-processing apparatus comprising:

a processing tray configured to load sheets which are formed with images and are fed in sequence, carry out post-processing on the sheets, and convey a sheet bundle bound into a bundle to a paper discharge section;

a positioning section configured to abut against the conveyance direction rear end of the sheet loaded on the processing tray and carry out positioning processing; and a glue binding section configured to carry out glue binding on the rear end parts of the sheets contacted with the positioning section; wherein the glue binding section includes a glue pasting section for carrying out glue pasting, of which the glue binding strength can be adjusted, on each of the sheets fed to the processing tray.

(2) The sheet post-processing apparatus according to (1), wherein the glue pasting section includes:

a roll tape obtained by pasting adhesive on a mount tape;

a tape head for holding the roll tape in a windable manner;

a tape head holding section for holding the tape head in such a manner that the tape head can be moved vertically;

a tape head actuation mechanism for pressing the tape head against the paper on the processing tray to paste the adhesive fed for a given length on the paper; and a feeding amount adjustment section for adjusting the feeding amount of the adhesive.

(3) The sheet post-processing apparatus according to (2), wherein the glue pasting section regards the feeding direction of the roll tape as the conveyance direction of the sheet.

(4) The sheet post-processing apparatus according to (2), wherein the glue pasting section regards the feeding direction of the roll tape as a direction orthogonal to the conveyance direction of the sheet.

(5) The sheet post-processing apparatus according to (1), further comprising:

a staple needle binding section configured to carry out binding processing using staple needles; wherein a sheet post-processing based on the glue binding section and a sheet post-processing based on the staple needle binding section can be selected.

(6) A paper post-processing apparatus comprising:

a processing tray configured to load paper which is formed with images and is fed in sequence, carry out post-processing on the paper, and convey a paper bundle bound into a bundle to a paper discharge section;

a positioning section configured to abut against the conveyance direction rear end of the paper loaded on the processing tray and carry out positioning processing;

a glue binding section configured to carry out glue binding on the rear end parts of the paper contacted with the positioning section;

a moving body configured to move the glue binding section along a paper width direction orthogonal to the paper conveyance direction; and a glue pasting section configured to carry out glue pasting, of which the glue binding strength can be adjusted, on each of the paper fed to the processing tray through the moving of the moving body in the paper width direction.

A Fifth Embodiment

The fifth embodiment is described below.

Herein, for the sake of convenience of description, there is a case in which the components having the same functions as those in each embodiment described above are applied with reference numerals or names different from those in each embodiment described above. However, the components practically having the same functions from the description of the embodiments, though applied with different reference numerals or names, are the same with the corresponding parts in each embodiment described above. Thus, for example, a discharge tray 213 in the present embodiment is the same as the second discharge tray 105 described in the first and the second embodiments and the paper discharge tray 6 described in the third embodiment.

Conventionally, as a method of binding a plurality of sheets discharged from an image forming apparatus, there is known a method which threads a wire through a sheet bundle and then bends the front ends of the wire to bind the sheet bundle.

However, in the conventional method using the wire, in a case of removing the wire from the sheet bundle to reuse the sheet, holes or damage are generated in the sheet when the wire is removed from the sheet bundle, which may adversely affect the conveyance of sheet in the image forming apparatus.

In the present embodiment, there is provided a technology for binding sheets in a special way so that the sheets can be reused easily.

Figure 34:
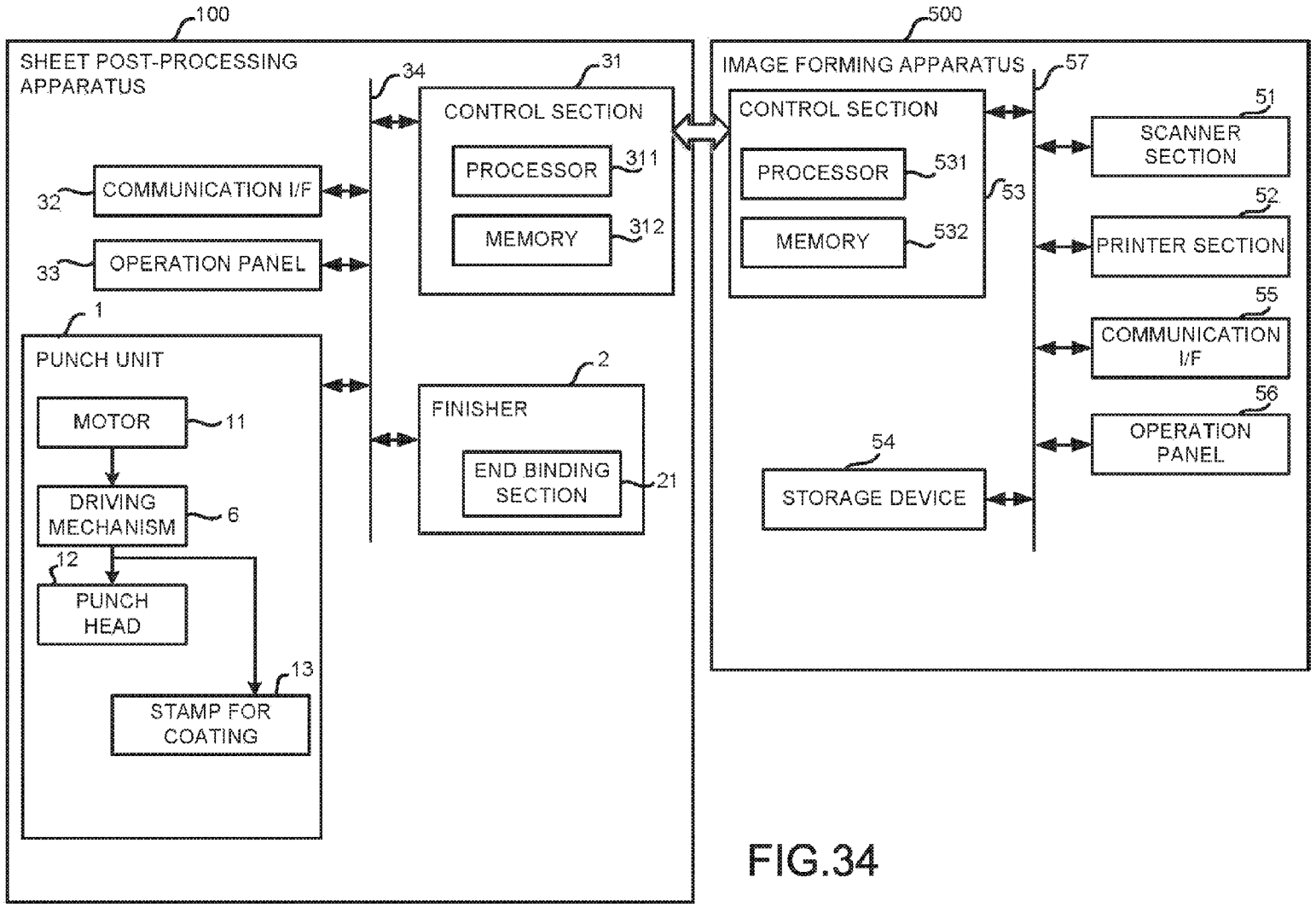
FIG. 34 is a block diagram illustrating the hardware constitution of a sheet post-processing apparatus and an image forming apparatus according to a fifth embodiment.

FIG. 34 is a block diagram illustrating the hardware constitution of a sheet post-processing apparatus 100 and an image forming apparatus 500.

The sheet post-processing apparatus 100 (so-called finisher) carries out post-processing such as bookbinding processing of binding the end of a sheet bundle discharged by the image forming apparatus 500 such as a MFP (Multi Function Peripheral) and the like with pressure sensitive adhesive, and hole-drilling processing of drilling holes in the sheet. The pressure sensitive adhesive is an adhesive which generates adhesive force by receiving pressure stronger than a given pressure.

The sheet post-processing apparatus 100 comprises a punch unit 1, a sheet binding section 21, a control section 31, a communication I/F 32 and an operation panel 33 which are connected with each other through a bus line 34.

The punch unit 1 carries out hole-drilling processing and a processing of coating the pressure sensitive adhesive.

The sheet binding section 21 carries out binding processing through sheet end binding.

The control section 31 controls the whole sheet post-processing apparatus 100. The control section 31 includes a processor 311 for carrying out various arithmetic operations and a memory 312 for storing a program read by the processor 311. The communication I/F 32 is an interface connected with an external machine. The communication I/F 32 transmits data to and receives data from the image forming apparatus 500 in a wired or wireless manner. The operation panel 33 is a touch panel for receiving an input operation of a user. The operation panel 33 displays a notification to a user, log information, operation status and setting information of the sheet post-processing apparatus 100.

The image forming apparatus 500 includes a scanner section 51, a printer section 52, a control section 53, a storage device 54, a communication I/F 55 and an operation panel 56 which are connected with each other through a bus line 57. The scanner section 51 reads an image of a sheet loaded on a document table and the like. The printer section 52 forms an image on the sheet based on the image data read by the scanner section 51 and the like.

The control section 53 controls the whole image forming apparatus 500. The control section 53 includes a processor 531 for carrying out various arithmetic operations and a memory 532 for storing a program read by the processor 531. The storage device 54 stores various programs, jobs and the like. The communication I/F 55 is an interface connected with an external machine. The communication I/F 55 transmits data to and receives data from the sheet post-processing apparatus 100, the external machine and the like in a wired or wireless manner. The operation panel 56 is a touch panel for receiving an input operation of the user. The operation panel 56 displays a notification to the user, log information, operation status and setting information of the image forming apparatus 500.

Figure 35:
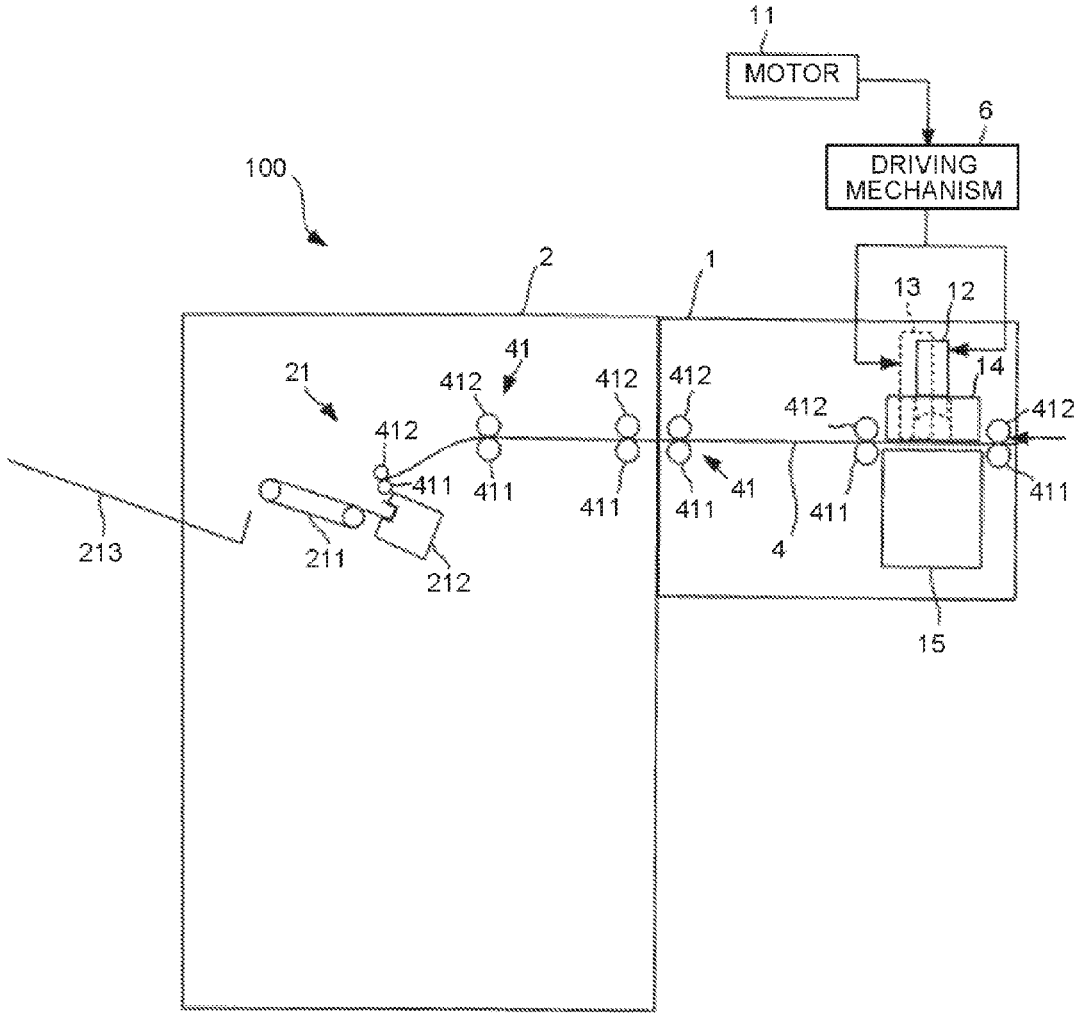
FIG. 35 is a schematic constitution diagram of the sheet post-processing apparatus.

FIG. 35 is a schematic constitution diagram of the sheet post-processing apparatus 100.

The sheet post-processing apparatus 100 comprises the punch unit 1 and the sheet binding section 21.

A conveyance path 4 is formed from the punch unit 1 to the sheet binding section 21 to convey the sheet discharged by the image forming apparatus 500 to the punch unit 1 and the sheet binding section 21. The conveyance path 4 includes a conveyance roller 41.

The conveyance roller 41 includes a driving roller 411 and a driven roller 412 which is arranged opposite to the driving roller 411 across the sheet. The driving roller 411 is set to have high rigidity and a sufficient friction coefficient to be capable of conveying the sheet. The driven roller 412 made of resin has an elastic layer such as a rubber layer and the like around the outer surface thereof and is driven by the driving roller 411. The driven roller 412 is arranged at the side of the sheet where the pressure sensitive adhesive is coated by a stamp for coating 13, that is, the back side of the sheet where an image is formed during the simplex printing carried out by the image forming apparatus 500. The driven roller 412 on the surface of which is laminated fluororesin (for example, Polyfluoroethylene resin and the like) is set to have a friction coefficient lower than that of the driving roller 411.

The punch unit 1 is arranged between the image forming apparatus 500 and the sheet binding section 21.

The punch unit 1 includes a motor 11, a driving mechanism 6, a punch head 12, the stamp for coating 13 (coating section), a guide frame 14 and a dust box 15. In FIG. 35, for the sake of clarity, the punch head 12 and the stamp for coating 13 are drawn to be at different positions in the sheet conveyance direction; however, the punch head 12 and the stamp for coating 13 are arranged at the same position in the sheet conveyance direction. That is, the punch head 12 and the stamp for coating 13 are arranged in parallel in a direction perpendicular to the paper surface of FIG. 35.

The punch head 12 punches a hole in the sheet. The stamp for coating 13, when being pressed against the sheet, coats a given amount of pressure sensitive adhesive on the sheet. When the punch head 12 and the stamp for coating 13 carry out punching processing and adhesive coating processing on the sheet, the sheet is in such a state where the sheet is conveyed and stopped at a position just under the punch head 12 and the stamp for coating 13 and clamped by the conveyance roller 41.

The stamp for coating 13 includes, for example, a seal which is wound for a given amount if being pressed. The pressure sensitive adhesive is laminated on the seal. If the stamp for coating 13 is pressed against the sheet, the pressure sensitive adhesive on the seal is peeled off from the seal and transferred to the sheet. In this case, for example, a paste coating unit having a constitution shown in the third and the fourth embodiments can be adopted.

The driving mechanism 6 drives, based on the rotation of the motor 11, the punch head 12 to reciprocate vertically between a position (middle lower position in FIG. 35) for punching holes in the sheet and a retracting position (middle upper position in FIG. 35) where the punch head 12 is retracted from the sheet; and drives, based on the rotation of the motor 11, the stamp for coating 13 to reciprocate vertically between a position (middle lower position in FIG. 35) where adhesive is coated on the sheet and a retracting position (middle upper position in FIG. 35) where the stamp for coating 13 is retracted from the sheet in a phase different from that of the punch head 12. That is, the stamp for coating 13 is retracted upwards during the punching processing carried out by the punch head 12, and the punch head 12 is retracted upwards during the adhesive coating processing carried out by the stamp for coating 13.

Figure 36:
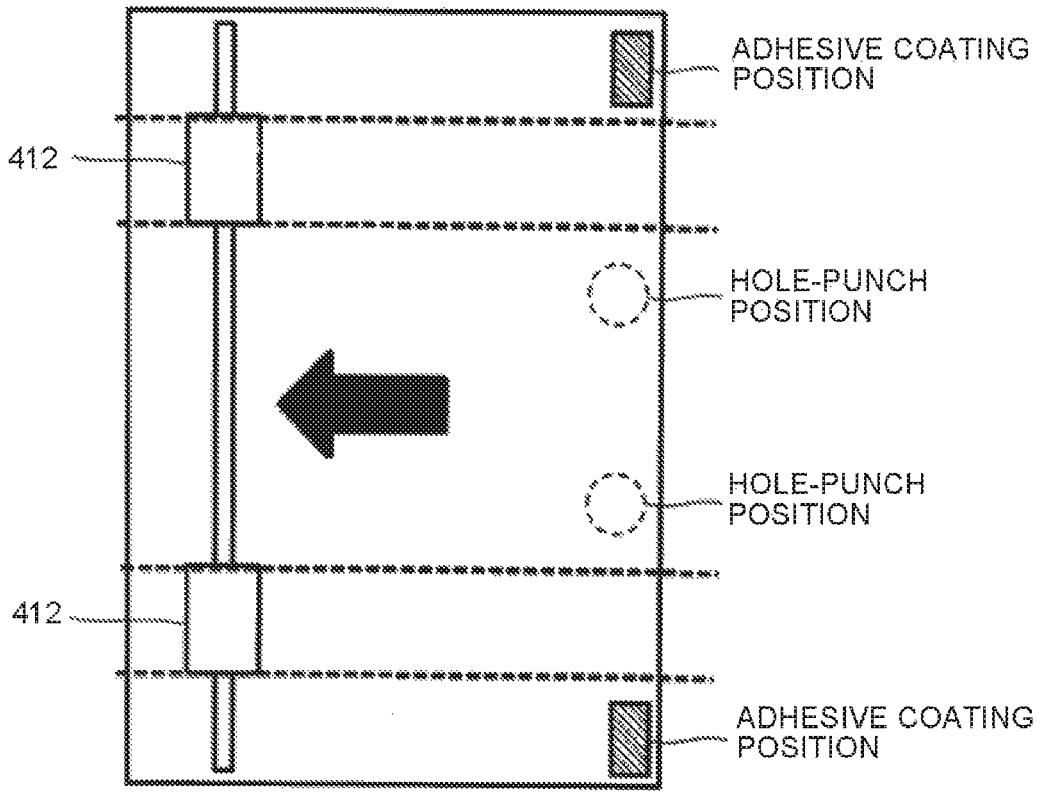
FIG. 36 is a diagram illustrating a position relation between the adhesive coating position and the position of each driven roller at the downstream side of the stamp for coating in the conveyance direction.

FIG. 36 is a diagram illustrating a position relation between the adhesive coating position and the position of each driven roller 412 at the downstream side of the stamp for coating 13 in the conveyance direction.

The stamp for coating 13 coats adhesive on the area excluding the area which will be contacted with the driven roller 412 at the parts of the sheet along a direction orthogonal to the sheet conveyance direction. In this way, in the present embodiment, the pressure sensitive adhesive can be prevented from adhering to the driven roller 412.

Further, the stamp for coating 13 is used for end binding in the present embodiment. In a case where a job of end binding processing is input in the sheet post-processing apparatus 100, the sheet is positioned at a position where the conveyance direction downstream end part of the sheet is positioned just under the stamp for coating 13. The stamp for coating 13 presses the conveyance direction downstream end part of the sheet stopped at the position and coats the pressure sensitive adhesive at this position. The sheet on which the pressure sensitive adhesive is coated is conveyed to the sheet binding section 21 (refer to FIG. 35).

The sheet end binding section 21 includes a conveyance belt 211, a pressing section 212 and the discharge tray 213. The sheet discharged from the conveyance path 4 and loaded on a standby tray (not shown) is dropped down to the conveyance belt 211. The pressing section 212 presses the conveyance direction downstream end part of the sheet bundle placed and aligned on the conveyance belt 211. In this way, the adhesive force is generated in the pressure sensitive adhesive of the rear end parts of the sheets, and therefore the rear end parts of the sheets are bound. The sheets subjected to the binding processing are discharged to the discharge tray 213 by the conveyance belt 211.

Figure 37:
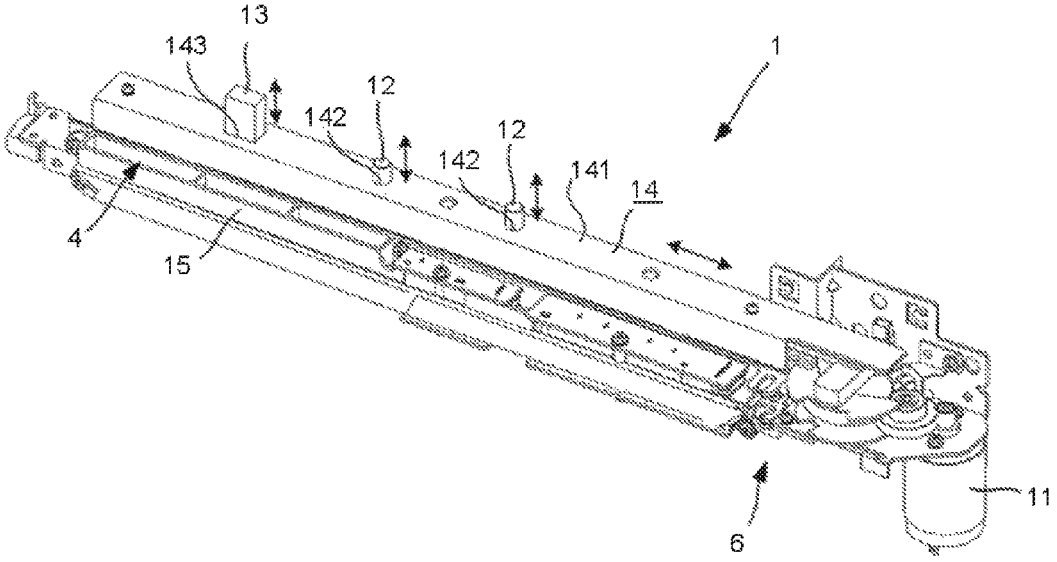
FIG. 37 is a perspective view illustrating a punch unit.

FIG. 37 is a perspective view illustrating the punch unit 1. In addition, another stamp for coating 13 (not shown) is also arranged at the right side of the punch head 12 on the right side in FIG. 37.

As stated above, the punch unit 1 comprises the motor 11, the driving mechanism 6, the punch head 12, the stamp for coating 13, the guide frame 14 and the dust box 15. The sheet passes through the conveyance path 4 between the dust box 15 and the guide frame 14, and is subjected to the punching processing and the adhesive coating processing by the punch head 12 and the stamp for coating 13. The motor 11 can be controlled to rotate in a forward direction or a backward direction.

The guide frame 14, which is formed in an elongated inverted U-shape, holds a later-described driving frame 64 (FIG. 38) inside. Guide holes 142 and 143 through which the punch head 12 and the stamp for coating 13 are inserted are formed on the top surface 141 of the guide frame 14. The guide frame 14 regulates the moving of the punch head 12 and the stamp for coating 13 in the vertical direction through the guide holes 142 and 143.

The constitutions and the actions of the driving mechanism 6 are described below.

Figure 38:
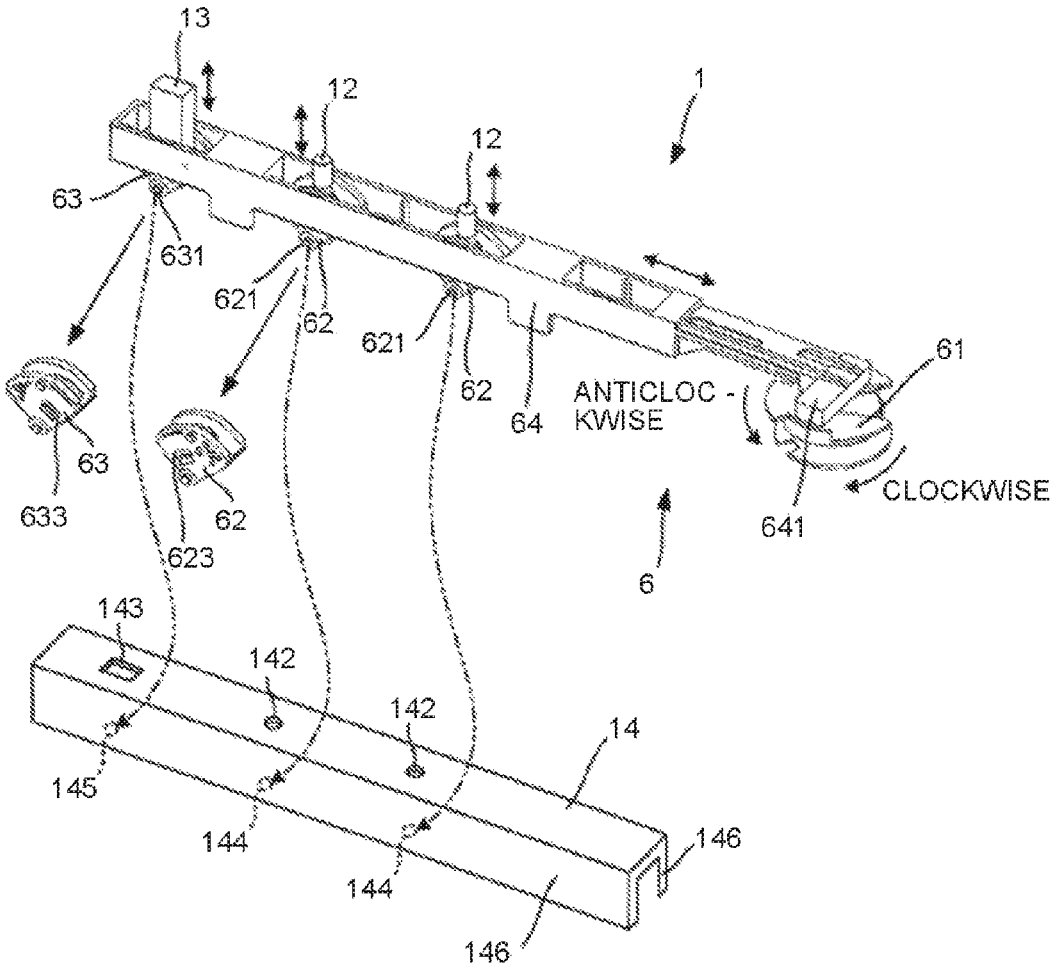
FIG. 38 is a perspective view illustrating the driving constitution of a driving mechanism.

FIG. 38 is a perspective view illustrating the driving constitution of the driving mechanism 6. In FIG. 38, in order to show the sides (the rear sides of the second and the third cams 62 and 63 in the driving frame 64 in FIG. 38) which are not engaged with the punch head 12 and the stamp for coating 13 within the two sides of each of the second and the third cams 62 and 63, the second and the third cams 62 and 63 are drawn at the outside of the driving frame 64 with the sides directed to the front side of FIG. 38.

The driving mechanism 6 consisting of first-third driving cams 61-63, an angle sensor (not shown) and the driving frame converts the rotation of the motor 11 into the sliding motion of the driving frame 64 in the horizontal direction, and converts the sliding motion of the driving frame 64 into the vertical motion of the punch head 12 and the stamp for coating 13 through the second and the third cams 62 and 63.

The rotation of the motor 11 is transferred to the first cam 61. An action shaft 611 (FIG. 39) is vertically arranged on the first cam 61. The action shaft 611 is housed in a housing section 641 arranged at the end part of the driving frame 64. The driving frame 64, the moving direction of which is regulated, can only move in the width direction (horizontal direction in FIG. 38) orthogonal to the conveyance direction of the sheet. When the first cam 61 is rotated, the action shaft 611 acts in the housing section 641 to make the driving frame 64 reciprocate in the width direction of the sheet. The first cam 61 is rotated in a forward direction or backward direction according to the rotation direction of the motor 11. That is, if the rotation direction of the motor 11 changes, the rotation direction of the first cam 61 changes as well, as a result, the phase of the reciprocating of the driving frame 64, and the phase of the vertical motion of the punch head 12 and the stamp for coating 13 change.

Cut-out portions are formed around the outer periphery of the first cam 61 at given intervals. The angle sensor (not shown) detects the pass of the cut-out portions of the first cam 61. The control section 31 can detect the rotation state of the first cam 61 according to an output signal of the angle sensor (not shown), thereby detecting the states (state of protruding to the sheet and state of retracting from the sheet) of the punch head 12 and the stamp for coating 13.

The driving frame 64 is formed in a longitudinal frame shape in which the second and the third cams 62 and 63 are arranged. The housing section 641 is formed at the front end of the driving frame 64.

The second and the third cams 62 and 63 include rotation shafts 621 and 631 extending in the horizontal direction. The rotation shafts 621 and 631 are supported by being inserted into holes 144 and 145 formed on two sides 146 of the guide frame 14 (only the holes 144 and 145 on one side are shown in FIG. 38). The second and the third cams 62 and 63 are arranged to be capable of rotating in the slide direction of the driving frame 64. For example, protrusion parts (not shown) protruding from the inner surface of the driving frame 64 are arranged in groove portions 623 and 633 formed on one side (the rear side of each of the second and the third cams 62 and 63 in the driving frame 64 in FIG. 38) of each of the second and the third cams 62 and 63, in this way, the second and the third cams 62 and 63 are rotated according to the slide direction of the driving frame 64. It is also applicable to arrange the protrusion parts on the second and the third cams 62 and 63 and arrange the groove portions on the driving frame 64.

Figure 39:
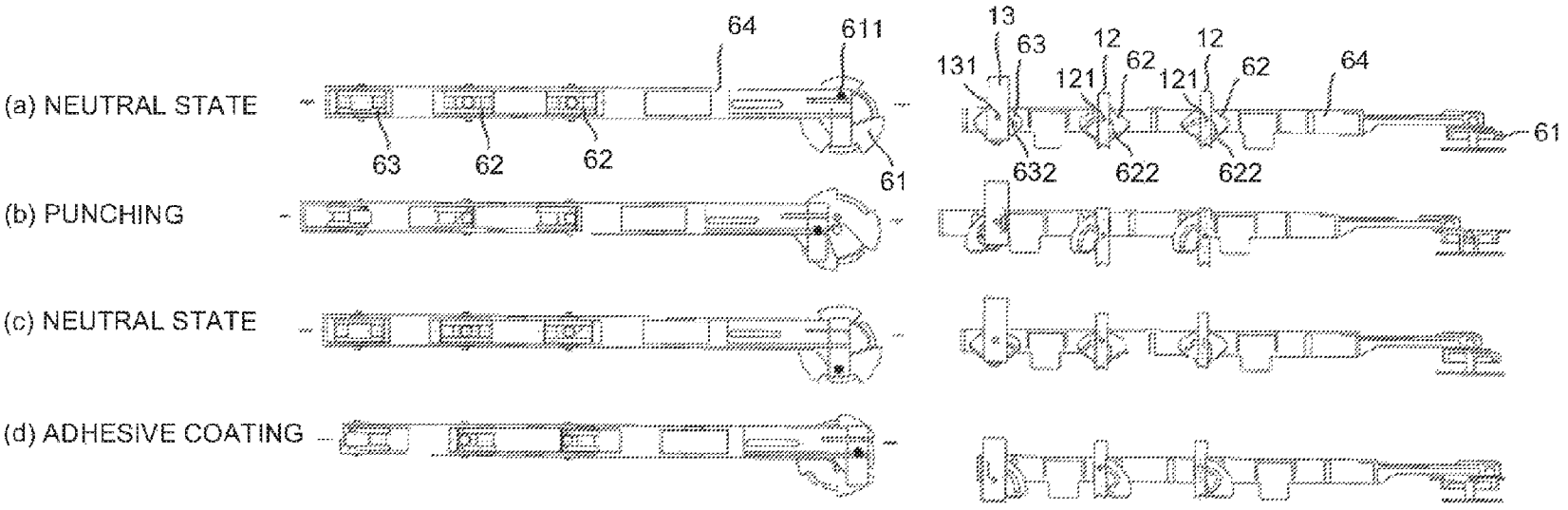
FIG. 39 is a diagram illustrating the relation between the rotation angle of a first cam and the states of the punch head and the stamp for coating.

FIG. 39 is a diagram illustrating the relation between the rotation angle of the first cam 61 and the states of the punch head 12 and the stamp for coating 13.

Though one side (the rear side of each of the second and the third cams 62 and 63 in the driving frame 64 in FIG. 38) of each of the second and the third cams 62 and 63 is engaged with the driving frame 64, the other side (the front side of the second cam 62 in the driving frame 64 in FIG. 38) of the second cam 62 is engaged with the punch head 12 and the other side (the front side of the third cam 63 in the driving frame 64 in FIG. 38) of the third cam 63 is engaged with the stamp for coating 13. Specifically, groove portions 622 and 632 (refer to FIG. 39) curved towards the outer peripheral side respectively are formed on the other sides of the second and the third cams 62 and 63, and protrusion parts 121 and 131 of the punch head 12 and the stamp for coating 13 are arranged in the groove portions 622 and 632.

In this way, if the driving frame 64 reciprocates in the horizontal direction, the punch head 12 and the stamp for coating 13 move in the vertical direction merely under the regulation of the guide frame 14, thus, the punch head 12 and the stamp for coating 13 move vertically in response to the distance of the groove portions 622 and 632 from the rotation shafts 621 and 631 at the position of the punch head 12 and the stamp for coating 13. The shapes of the groove portions 622 and 632 are formed in such a manner that the phases of vertical movement of the punch head 12 and the stamp for coating 13 are shifted for 180 degrees.

Hereinafter, the relation between the position of the action shaft 611 of the first cam 61 and the positions of the punch head 12 and the stamp for coating 13 is described with reference to FIG. 39 and FIG. 40.

In a case where the action shaft 611 of the first cam 61 is at a position shown in FIG. 39(*a*), the punch unit 1 is at a neutral state in which both the punch head 12 and the stamp for coating 13 are separated from the sheet.

In a case where the action shaft 611 of the first cam 61 is rotated for 90 degrees in an anticlockwise direction in FIG. 39 from the neutral state (rotated clockwise for 270 degrees), as shown in FIG. 39(*b*), the punch head 12 is positioned at the punching position and the stamp for coating 13 is positioned at the retracting position.

Thus, in a case where a punching job is received, the sheet post-processing apparatus 100 controls the motor 11 to rotate the action shaft 611 of the first cam 61 anticlockwise for 90 degrees from the neutral state.

In a case where the action shaft 611 of the first cam 61 is rotated anticlockwise for 180 degrees from the neutral state (rotated clockwise for 180 degrees), as shown in FIG. 39(*c*), the punch head 12 rises from the punching position to the retracting position and the punch unit 1 returns to the neutral state again.

In a case where the action shaft 611 of the first cam 61 is rotated clockwise for 90 degrees from the neutral state (rotated anticlockwise for 270 degrees), as shown in FIG. 39(*d*), the punch head 12 is positioned at the retracting position and the stamp for coating 13 protrudes to the sheet and is positioned at the adhesive coating position.

Thus, in a case where an adhesive coating job is received, the sheet post-processing apparatus 100 controls the motor 11 to rotate the action shaft 611 of the first cam 61 clockwise for 90 degrees from the neutral state, that is, drives the motor 11 in a direction opposite to the driving direction in a case where the punching job is received.

In a case where a job of carrying out both the punching processing and the adhesive coating processing on one sheet is received, the sheet post-processing apparatus 100 controls the motor 11 to rotate the action shaft 611 of the first cam clockwise or anticlockwise for 360 degrees from the neutral state. In this way, the punch head 12 and the stamp for coating 13 protrude towards the sheet one after another and are positioned at the punching position and the coating position, respectively, thus, both the punching processing and the adhesive coating processing can be carried out.

Figure 41:
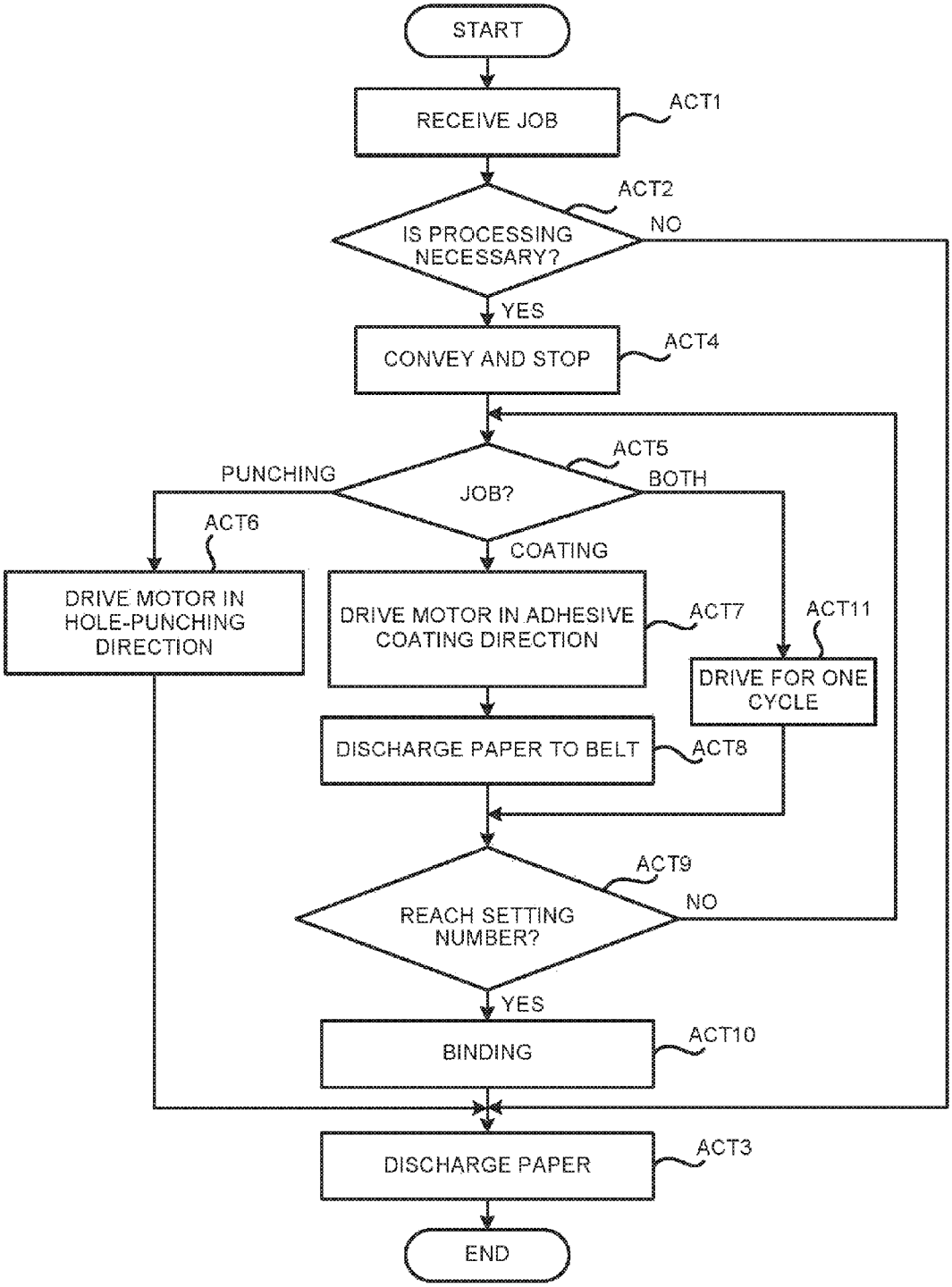
FIG. 41 is a flowchart illustrating a job processing carried out by the sheet post-processing apparatus.

Hereinafter, the job processing carried out by the sheet post-processing apparatus 100 is described with reference to the flowchart shown in FIG. 41.

The sheet post-processing apparatus 100 receives a job from the image forming apparatus 500 (ACT 1).

In a case where it is not necessary to carry out the punching processing or the adhesive coating processing (NO in ACT 2), the sheet post-processing apparatus 100 discharges the sheet to the discharge tray 213 directly (ACT 3).

In a case where it is necessary to carry out the punching processing or the adhesive coating processing (YES in ACT 2), the sheet post-processing apparatus 100 conveys the sheet fed from the image forming apparatus 500 to the position where the punch head 12 and the stamp for coating 13 are arranged and stops the sheet at the position (ACT 4).

In a case where the input job is the punching processing (punching in ACT 5), the sheet post-processing apparatus 100 drives the motor 11 in a punching direction so that the stamp for coating 13 does not pass the adhesive coating position, and drops the punch head 12 down to the punching position to punch holes in the sheet (ACT 6). In the example shown in FIG. 39, the punching direction refers to a direction to rotate the action shaft 611 of the first cam 61 anticlockwise for 90 degrees when the punch unit 1 is in the neutral state shown in FIG. 39(*a*).

The sheet post-processing apparatus 100 discharges the sheet subjected to punching processing to the discharge tray 213 (ACT 3).

In a case where the input job is the adhesive coating processing (coating in ACT 5), the sheet post-processing apparatus 100 drives the motor 11 in an adhesive coating direction so that the punch head 12 does not pass the punching position, and drops the stamp for coating 13 down to the adhesive coating position to coat the pressure sensitive adhesive on the sheet (ACT 7). The adhesive coating direction refers, to a direction to rotate the action shaft 611 of the first cam 61 clockwise for 90 degrees when the punch unit 1 is in the neutral state shown in FIG. 39(*a*). At this time, the sheet post-processing apparatus 100 coats the pressure sensitive adhesive at the conveyance direction downstream end part of the sheet along a direction orthogonal to the conveyance direction of the sheet.

The sheet post-processing apparatus 100 discharges the sheet on which the pressure sensitive adhesive is coated to the conveyance belt 211 (ACT 8).

If the number of sheets reaches the number designated in the job (YES in ACT 9), the sheet post-processing apparatus 100 presses the conveyance direction downstream end part of the sheet bundle on the conveyance belt 211 through the pressing section 212 to bind the ends of the sheets (ACT 10). Then, the sheet post-processing apparatus 100 discharges the bound sheet bundle to the discharge tray 213 (ACT 3).

In ACT 9, if the number of sheets does not reach the setting number designated in the job (NO in ACT 9), the flow returns to the processing in ACT 5 to execute the processing following ACT 5 again.

In a case where the input job instructs to carry out both of the punching processing and the adhesive coating processing (both in ACT 5), the sheet post-processing apparatus 100 drives the motor 11 so that the punch head 12 and the stamp for coating 13 are moved vertically for one cycle. In this case, if the punch unit 1 is in the neutral state shown in FIG. 39(*a*), the action shaft 611 of the first cam 61 is rotated clockwise or anticlockwise for 360 degrees. In this way, both the punching processing and the adhesive coating processing are carried out on the sheet (ACT 11).

If the number of sheets subjected to the processing reaches the number designated in the job (YES in ACT 9), the sheet post-processing apparatus 100 binds the end of the sheet bundle (ACT 10), and then discharges the sheet bundle (ACT 3).

A Sixth Embodiment

Next, the sixth embodiment is described.

The sixth embodiment is a modification of the fifth embodiment described above. Hereinafter, the components in the present embodiment having the same functions as those in the fifth embodiment are applied with the same reference numerals, and therefore, the detailed descriptions thereof are not repeated.

Figure 42:
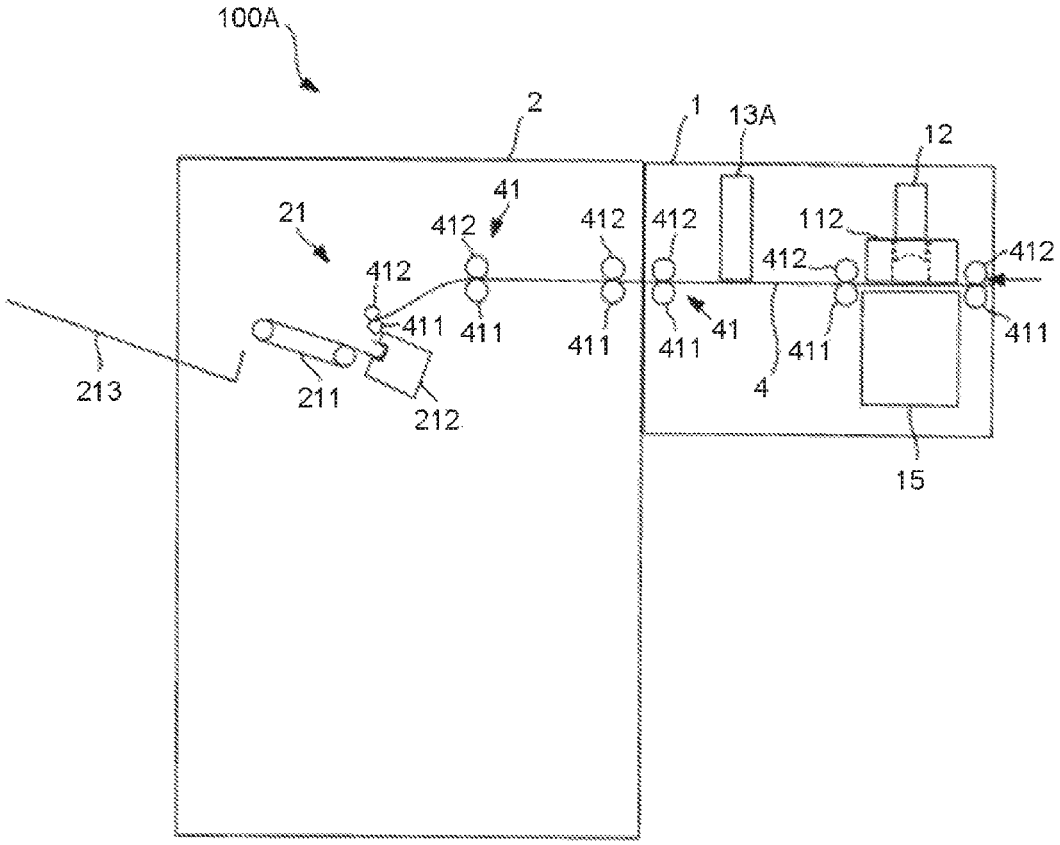
FIG. 42 is a schematic constitution diagram of a sheet post-processing apparatus according to a sixth embodiment.
Figure 43:
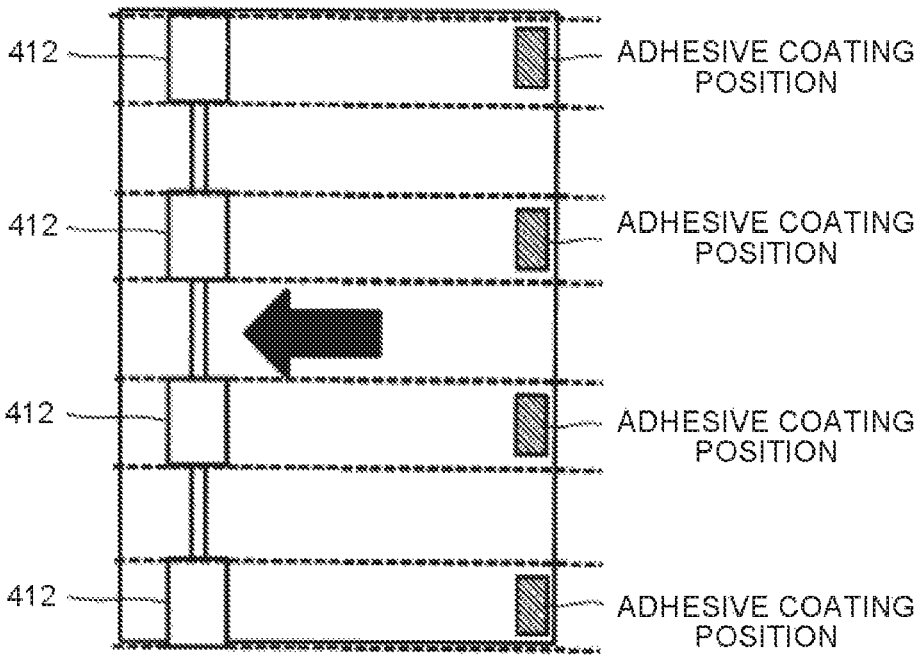
FIG. 43 is a diagram illustrating a position relation between the coating position of pressure sensitive adhesive and the position of a driven roller.

FIG. 42 is a schematic constitution diagram of a sheet post-processing apparatus 100A. FIG. 43 is a diagram illustrating a position relation between the coating position of the pressure sensitive adhesive and the position of the driven roller 412.

In the present embodiment, in the punch unit 1, a coating section 13A for coating the pressure sensitive adhesive on the sheet is arranged separately from the punch head 12. Further, as shown in FIG. 43, the coating section 13A coats pressure sensitive adhesive on the area which will be contacted with the driven roller 412 at the parts of the sheet along a direction orthogonal to the sheet conveyance direction.

In this way, in the present embodiment, the pressure sensitive adhesive can be pressed in advance at the upstream side of the pressing section 212, thus, the sheets can be bound more firmly by the pressing section 212. In addition, it may also be such a constitution that the coating section 13A includes a winding type seal on which the pressure sensitive adhesive is laminated, and if the coating section 13A is moved in a state in which the seal is contacted with the sheet, the pressure sensitive adhesive on the seal is peeled off from the seal and transferred to the sheet, and the seal part from which the pressure sensitive adhesive is peeled off is wound around a reel through the motion of the coating section 13A. That is, the coating section 13A may have a constitution similar to that of a so-called correction tape. Specifically, the constitution described in the third and the fourth embodiment may be adopted as the coating section in the present embodiment.

A Seventh Embodiment

Next, the seventh embodiment is described.

The seventh embodiment is a modification of the fifth embodiment described above. Hereinafter, the components in the present embodiment having the same functions as those in the fifth embodiment are applied with the same reference numerals, and therefore, the detailed descriptions thereof are not repeated.

Figure 44:
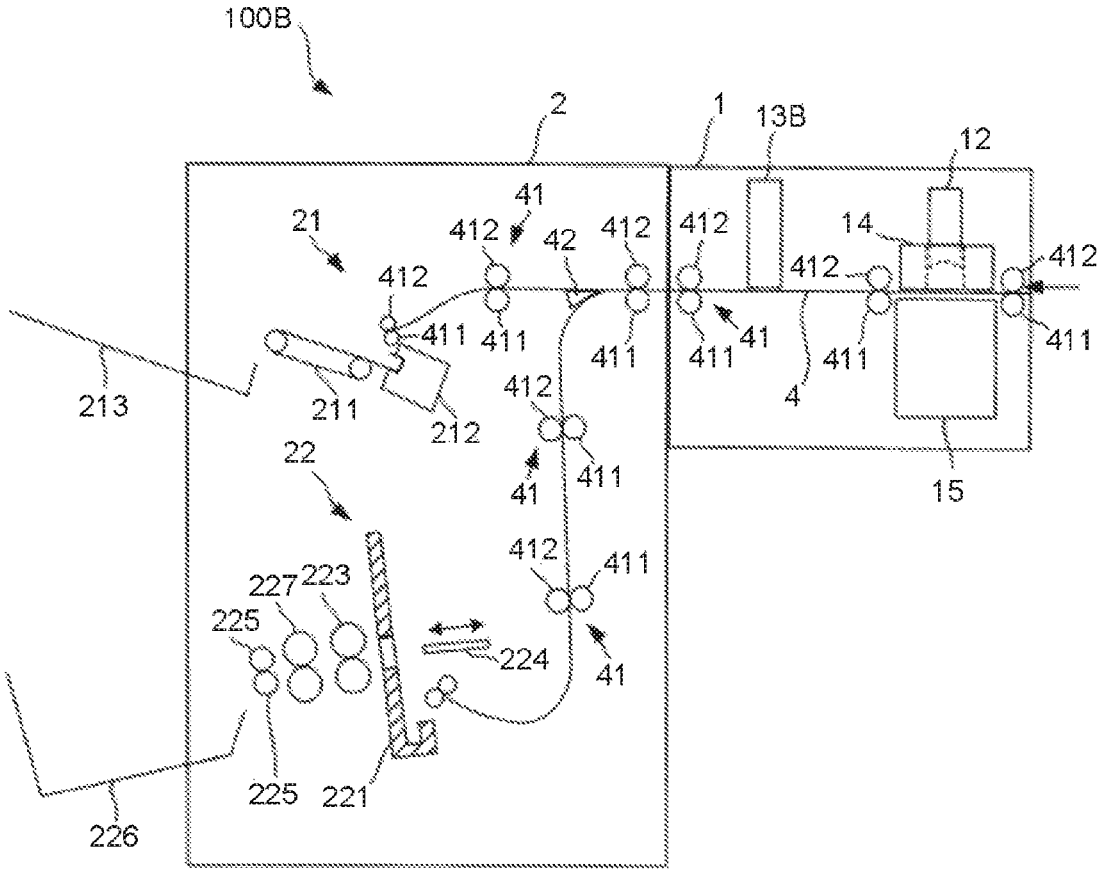
FIG. 44 is a schematic constitution diagram of a sheet post-processing apparatus according to a seventh embodiment.
Figure 45:
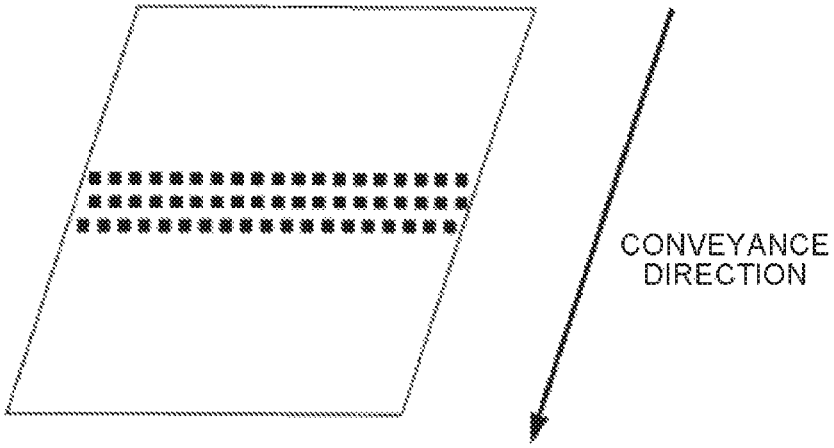
FIG. 45 is a diagram illustrating the coating position of the pressure sensitive adhesive.

FIG. 44 is a schematic constitution diagram of a sheet post-processing apparatus 100B. FIG. 45 is a diagram illustrating the coating position of the pressure sensitive adhesive.

In the present embodiment, a coating section 13B for coating the pressure sensitive adhesive on the sheet is arranged separately from the punch head 12. Further, in addition to the sheet binding section 21, a saddle stitching section 22 is arranged. The conveyance path 4 branches into two conveyance paths starting from a flapper 42. The sheet binding section 21 is arranged on one conveyance path branching off from the conveyance path 4 and the saddle stitching section 22 is arranged on the other conveyance path.

In the present embodiment, in order to carry out saddle stitching processing on the sheet, as shown in FIG. 45, the sheet post-processing apparatus 100B coats the pressure sensitive adhesive on the center part (in the conveyance direction) of the sheet along a direction orthogonal to the conveyance direction. The coating section 13B, as stated above, may have a constitution similar to that of a so-called correction tape, and if the coating section 13B is moved in a state where the seal on which the pressure sensitive adhesive is laminated is contacted with the sheet, the pressure sensitive adhesive on the seal can be coated on the sheet. Further, similar to the fifth and the sixth embodiments described above, the coating section 13B is constituted and controlled so that the pressure sensitive adhesive can be coated at the conveyance direction downstream end part of the sheet along a direction orthogonal to the conveyance direction. For example, the pasting structure having a constitution described in the third and the fourth embodiment may be adopted as the coating section 13B in the present embodiment.

The sheet on which the pressure sensitive adhesive is coated by the coating section 13B for the saddle stitching processing is conveyed to the saddle stitching section 22.

The saddle stitching section 22 includes a stacker 221, a sheet folding roller pair 223, a folding blade 224, a fold reinforcing roller pair 227, a conveyance roller 225 and a discharge tray 226.

The sheet is stacked on the stacker 221. At this time, the sheet is stacked in such manner that the coating area of the pressure sensitive adhesive faces to the folding blade 224.

Figure 46:
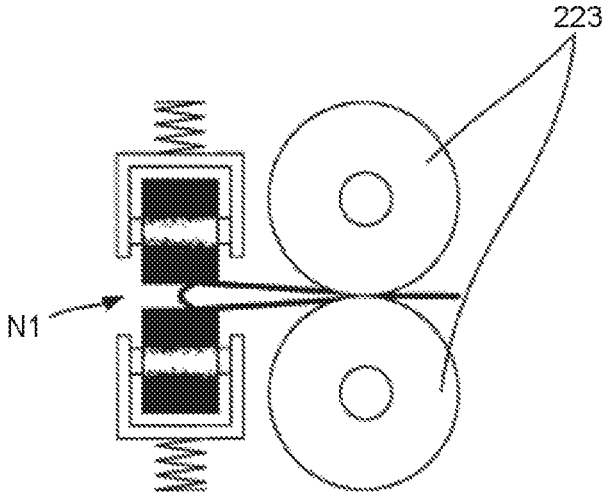
FIG. 46 is a diagram illustrating a sheet folding roller pair.
Figure 47:
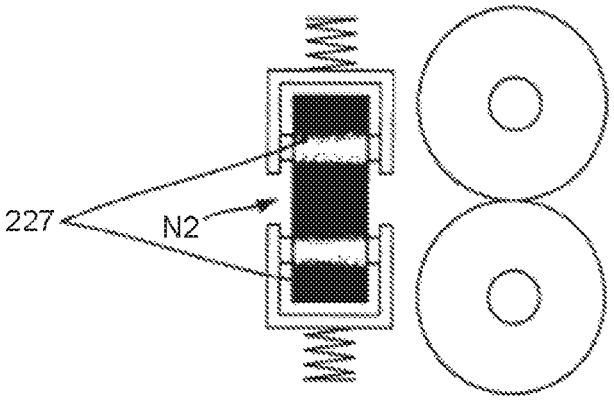
FIG. 47 is a diagram illustrating a fold reinforcing roller pair.

FIG. 46 is a diagram illustrating the sheet folding roller pair 223 and FIG. 47 is a diagram illustrating the fold reinforcing roller pair 227.

The sheet folding roller pair 223 is arranged at a position opposite to the folding blade 224 across the stacker 221 (refer to FIG. 44). A nip N1 is formed between the sheet folding roller pair 223.

The fold reinforcing roller pair 227 is at the downstream side of the sheet folding roller pair 223 in the sheet conveyance direction. A nip N2 formed between the fold reinforcing roller pair 227 is smaller than the nip N1 formed between the sheet folding roller pair 223.

The folding blade 224 contacts with the folding part of the sheet where the pressure sensitive adhesive is coated, and presses the sheet bundle on the stacker 221 into the nip N1 between the sheet folding roller pair 223 to fold the sheet bundle into two parts. At this time, the pressure sensitive adhesive cannot generate enough adhesive force under the pressure of the sheet folding roller pair 223.

The sheet bundle which passed through the sheet folding roller pair 223 and is folded into two parts is passed through the fold reinforcing roller pair 227 to be fully pressurized at the folding part. In this way, the pressure sensitive adhesive generates enough adhesive force to firmly adhere the sheets with each other at the folding part, thereby, the sheets are saddle stitched.

After the sheet bundle is folded into two parts and saddle stitched as stated above, the sheet bundle is discharged to the discharge tray 226 by the conveyance roller 225.

With such a constitution, in the present embodiment, even if the coating area of the pressure sensitive adhesive is incorrect, only the folded part can be adhered firmly.

(Modification)

In the embodiment described above, the pressure sensitive type adhesive is exemplified; however, the present invention is not limited to this. For example, the adhesive applied to the present embodiment may be an adhesive which is suitable for reuse, and of which the adhesive force reduces or almost disappears if the adhesive is heated or cooled. Further, the adhesive used by the adhering section may be an adhesive of which the adhesive force reduces or almost disappears if light is emitted to the adhesive.

In the fifth-sixth embodiments, the pressure sensitive adhesive is coated by the stamp for coating 13 and the coating sections 13A and 13B having a constitution similar to that of the correction tape. However, the present invention is not limited to this. An inkjet type printer head for jetting the pressure sensitive adhesive under the driving of a piezoelectric element or a thermal element may be used as the coating section. The specific constitution in this case may be the same as the constitution of the pasting head 101*a* described in the first embodiment.

As stated above, in accordance with the fifth-seventh embodiments, for example, there is provided a sheet post-processing apparatus the constitutions of which are as follows.

(1) A sheet post-processing apparatus comprising:

a coating section configured to coat adhesive on a sheet conveyed from an image forming apparatus; and a pressing section configured to press a sheet bundle on which the adhesive is coated by the coating section to bind the sheets.

(2) The sheet post-processing apparatus according to (1), further comprising:

a punch head configured to punch holes in the sheet;

a motor; and a driving mechanism configured to drive, based on the rotation of the motor, the punch head to reciprocate between a position for punching holes in the sheet and a retracting position where the punch head is retracted from the sheet, and drive, based on the rotation of the motor, the coating section to reciprocate between a position where adhesive is coated on the sheet and a retracting position where the coating section is retracted from the sheet in a phase different from that of the punch head.

(3) The sheet post-processing apparatus according to (1), further comprising:

a conveyance roller configured at the downstream side of the coating section in the sheet conveyance direction; wherein the coating section coats the adhesive on an area excluding the area which will be contacted with the conveyance roller at the parts of the sheet along a direction orthogonal to the sheet conveyance direction.

(4) The sheet post-processing apparatus according to (1), further comprising:

a conveyance roller configured at the downstream side of the coating section in the sheet conveyance direction; wherein the coating section coats the adhesive on an area which will be contacted with the conveyance roller at the parts of the sheet along a direction orthogonal to the sheet conveyance direction.

(5) The sheet post-processing apparatus according to (1), further comprising:

a stacker configured to stack the sheet on which the adhesive is coated;

a sheet folding roller pair configured at the downstream side of the stacker in the sheet conveyance direction;

a folding blade configured to press the sheets stacked on the stacker into a nip of the sheet folding roller pair to fold the sheets; and a fold reinforcing roller pair serving as the pressing section configured to press the sheet bundle which passed through the sheet folding roller pair and is folded to generate adhesive force in the adhesive coated on the folded part of the sheet to bind the folded parts of the sheets; wherein the adhesive is a pressure sensitive adhesive, and the coating section coats the adhesive on the center part (in the sheet conveyance direction) of the sheet along a direction orthogonal to the conveyance direction.

An Eighth Embodiment

The eighth embodiment is described below.

The eighth embodiment is a modification of the third embodiment described above. Hereinafter, the components in the present embodiment having the same functions as those in the third embodiment are applied with the same reference numerals, and therefore, the detailed descriptions thereof are not repeated. The hardware constitution of the eighth embodiment is the same as that of the third embodiment, while the control method thereof is different from that of the third embodiment.

In the adhesive coating method described in the third embodiment which presses the double-sided adhesive sheet 31 (adhesive) carried on the tape surface of the mount tape 32 (base tape) against the target sheet together with the base tape from the side of the mount tape 32 where no double-sided adhesive sheet 31 is carried, to coat the double-sided adhesive sheet 31 (adhesive) on the target sheet, the pressing mechanism for coating the double-sided adhesive sheet 31 on the sheet surface is needed.

Thus, the size of the whole apparatus can be reduced if the following two functions can be realized: (1) pressing the mount tape 32 where the double-sided adhesive sheet 31 is carried against the target sheet in a case of coating the double-sided adhesive sheet 31 on the target sheet, (2) pressing the part (the part where the double-sided adhesive sheet 31 is already peeled off) of the mount tape 32 where no double-sided adhesive sheet 31 is carried against the target sheet in a case of desiring to only press the sheet without coating the double-sided adhesive sheet 31.

Hereinafter, an example of the constitution for realizing such two functions of coating adhesive and carrying out pressing operation merely is described.

As stated in the third embodiment, the feeding amount of the roll tape 33 and the length of the double-sided adhesive sheet 31 fed in the width direction from the first transfer contact surface forming roller 36 can be adjusted by controlling the rotation of the motor M.

Figure 48:
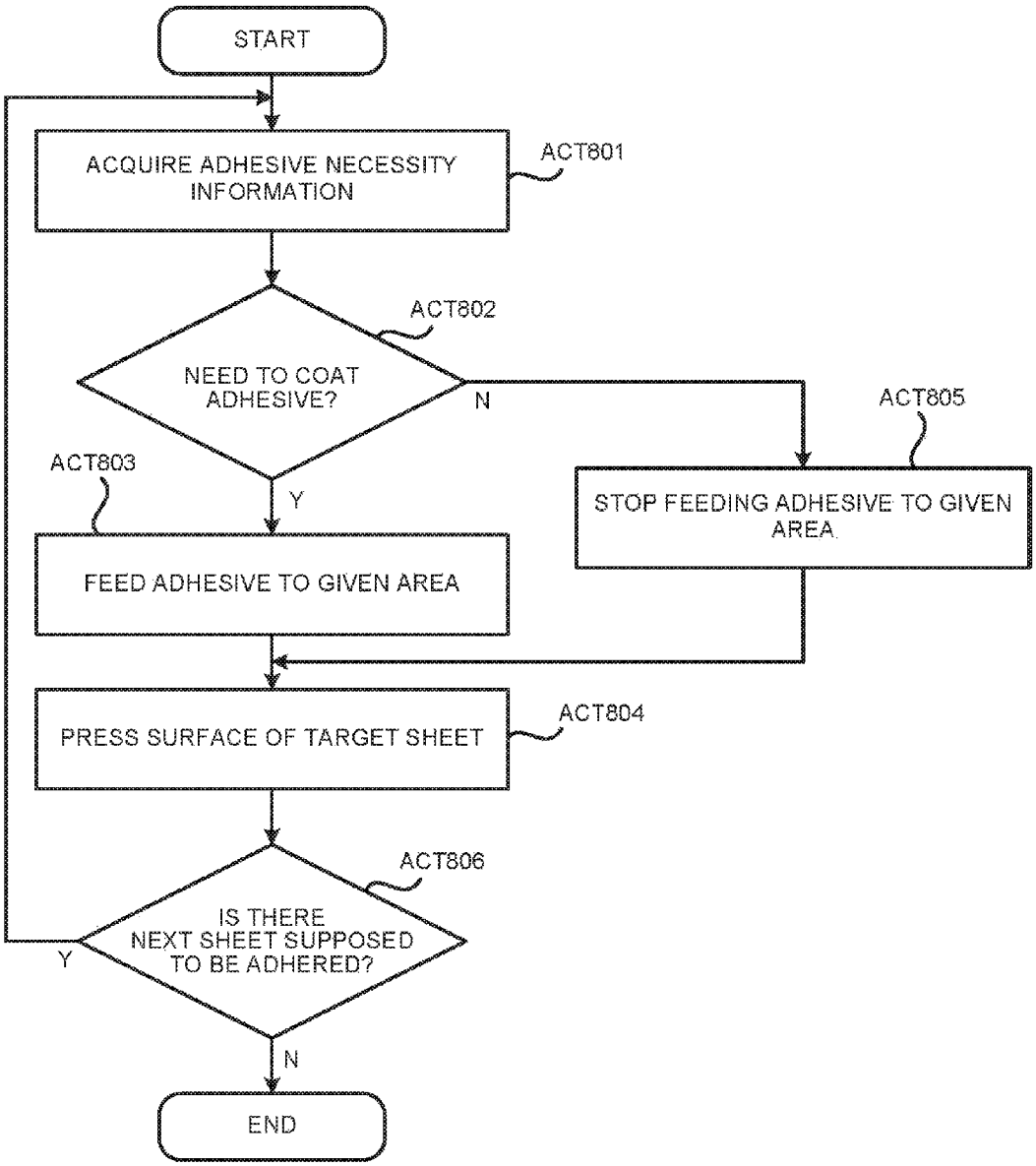
FIG. 48 is a flowchart illustrating the operations (sheet binding method) of a sheet binding apparatus according to an eighth embodiment.

FIG. 48 is a flowchart illustrating the operations (sheet binding method) of the sheet binding apparatus according to the eighth embodiment.

The processor 151 (adhesive necessity information acquisition section) (refer to FIG. 31) acquires page information of each sheet (target sheet) constituting the sheet bundle to be bound and information indicating the existence of the occurrence of a sheet jam and the like from the MFP 100 connected with the finisher 1 as the information (adhesive necessity information) for determining the necessity of coating adhesive on the sheet loaded on the processing tray 304 (ACT 801). Further, the processor 151 can also acquire information indicating whether or not the sheet supposed to be fed to the finisher 1 reaches the processing tray 304 as scheduled (for example, whether or not sheet jam and the like occur in the finisher 1) and the like as the adhesive necessity information. The occurrence of sheet jam in the finisher 1 can be determined based on the detection result of various sensors such as a sheet passing detection sensor that the finisher serving as the post-processing apparatus generally includes.

In a case where the acquired adhesive necessity information represents the page position indicating, for example, that the sheet loaded on the processing tray 304 (refer to FIG. 26) is not the upmost sheet (for example, front cover part) loaded on the processing tray 304 within the sheets constituting the sheet bundle (YES in ACT 802), the processor 151 determines that it is necessary to coat the adhesive and controls the rotation of the motor M in a way as shown in FIG. 30 (*d*), to start to feed the roll tape 33 to feed the double-sided adhesive sheet 31 for a length to the second transfer contact surface forming roller 37 (ACT 803). In this way, the double-sided adhesive sheet 31 can be fed to an area (given area) between the first transfer contact surface forming roller 36 and the second transfer contact surface forming roller 37.

Next, the processor 151 starts the tape stamping operation of the tape head 52 as shown in FIG. 30 (*b*) to press the upper surface of the upmost sheet (target sheet) within the sheets loaded on the processing tray 304 (ACT 804). In this way, the part of the double-sided adhesive sheet 31 carried on the mount tape 32 corresponding to the given area is coated on the given position of the upper surface of the target sheet as the cut adhesive sheet part G.

Figure 49:
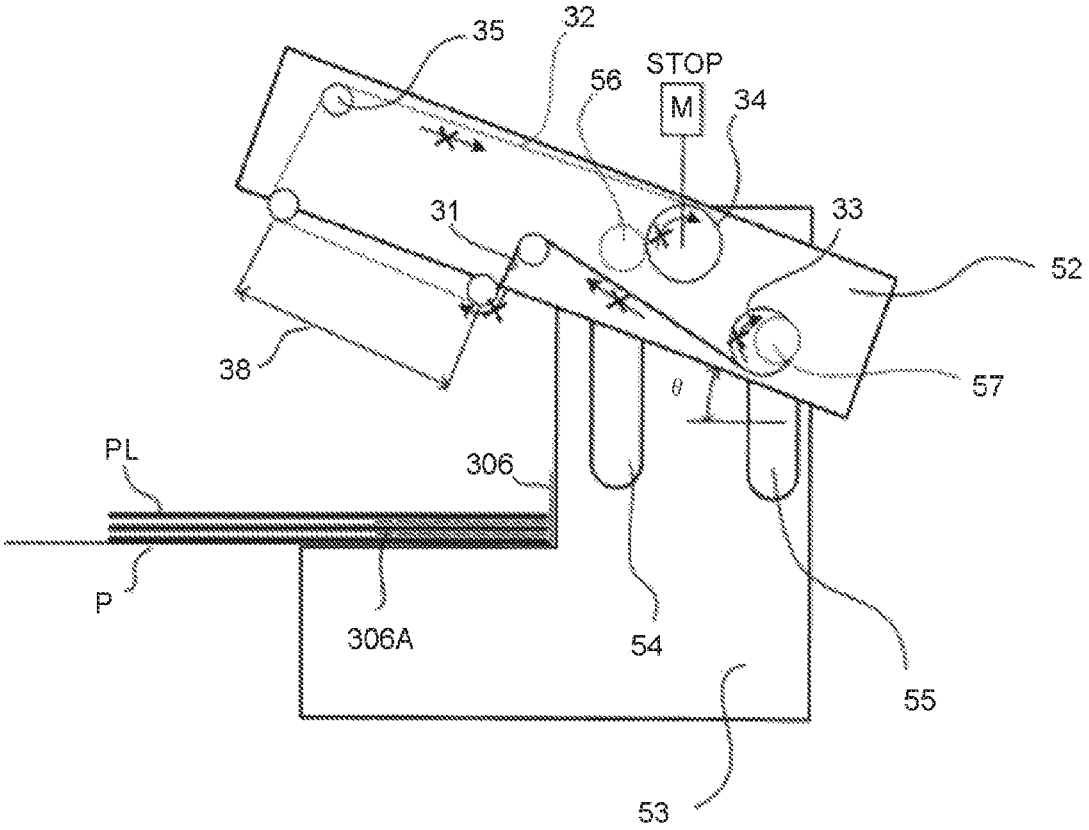
FIG. 49 is a diagram illustrating an operation of prohibiting the feeding of a roll tape 33.

On the other hand, in a case where the acquired adhesive necessity information indicates, for example, that the sheet loaded on the processing tray 304 is the upmost sheet (for example, front cover part) loaded on the processing tray 304 within the plurality of sheets constituting the sheet bundle (NO in ACT 802), the processor 151 determines that it is not necessary to coat the adhesive and stops the rotation of the motor M as shown in FIG. 49 so as not to feed the roll tape 33 (ACT 805). In this way, the double-sided adhesive sheet 31 is not fed to the area (given area) between the first transfer contact surface forming roller 36 and the second transfer contact surface forming roller 37, and the mount tape 32 is in such a state in which the surface part of the mount tape 32 where the double-sided adhesive sheet 31 is already peeled off through the former adhesive coating operation is exposed.

Figure 50:
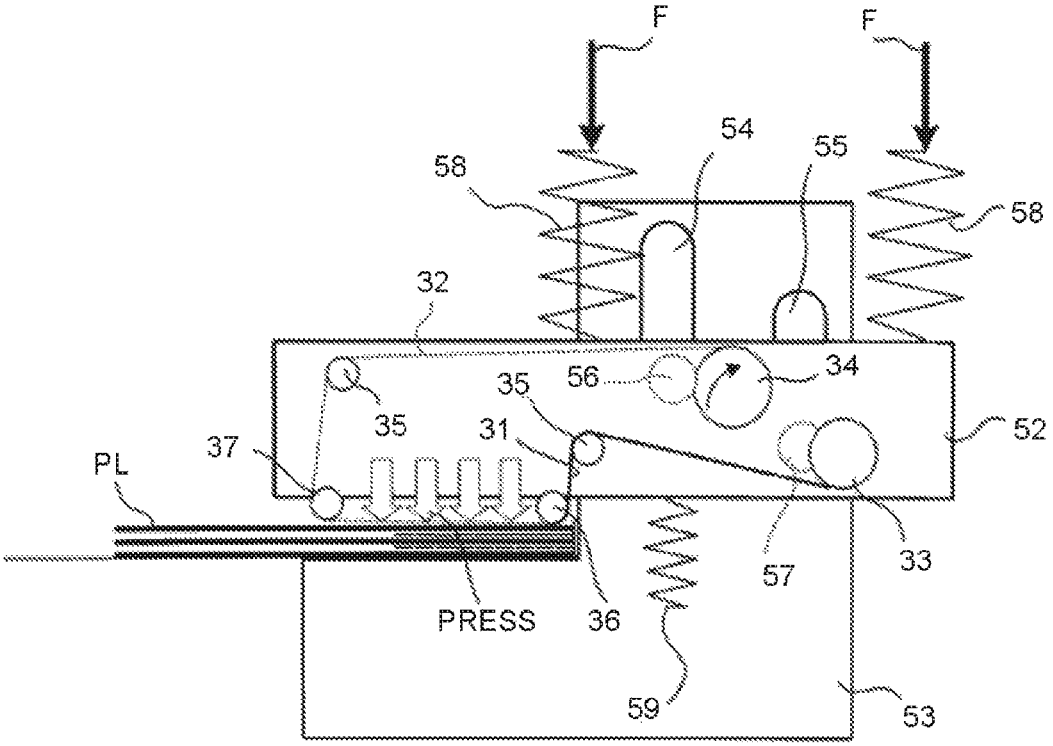
FIG. 50 is a diagram illustrating a pressing operation without coating the double-sided adhesive sheet 31.

Next, the processor 151 starts the tape stamping operation of the tape head 52 as shown in FIG. 50 to press the upper surface of the upmost sheet PL (target sheet) within the sheets loaded on the processing tray 304 (ACT 804). In this way, only the pressing operation is carried out without coating the double-sided adhesive sheet 31 on the upper surface of the upmost sheet PL (target sheet) within the sheets loaded on the processing tray 304.

The processor 151 determines, based on the page information acquired from the MFP 100 and the like, whether or not there is a sheet (a sheet supposed to be adhered on the upper surface of the pressed upmost sheet) to be further loaded following the upmost sheet pressed on the processing tray 304 (ACT 806). Herein, if there is a next sheet supposed to be adhered (YES in ACT 806), the flow returns to carry out the processing in ACT 801. On the other hand, if there is no next sheet supposed to be adhered (NO in ACT 806), it is determined that the previously pressed upmost sheet is the front cover of the sheet bundle to be bound, and then the processing is ended.

If the adhesive is coated on the upper surface of the front cover of the sheet bundle to be bound, there is a problem that the adhesive is exposed at the surface of the front cover of the sheet bundle after the sheet binding processing is completed. This problem also occurs in a case where the adhesive coating processing is carried out on the target sheet though the next sheet supposed to be loaded on the target sheet is not loaded on the target sheet as scheduled due to a sheet jam and the like. In accordance with the eighth embodiment, the mechanism for carrying out adhesive coating is also used to carry out pressing operation without coating adhesive, in this way, such a problem is prevented, and the size of the whole apparatus can be reduced greatly.

As stated above, in accordance with the eighth embodiment, for example, there is provided a sheet post-processing apparatus the constitutions of which are as follows.

(1) A sheet binding apparatus for binding a sheet bundle with adhesive, comprising:

a first reel;

a second reel;

a tape, of which one end is wound on the first reel and the other end is wound on the second reel, configured to carry, on a base tape, adhesive that is peeled off from the base tape and coated on a target sheet if being pressed against the target sheet;

a rotation driving mechanism configured to rotate the first reel and the second reel in a first rotation direction to wind the tape fed from the first reel on the second reel;

a pressing mechanism, which is positioned at the side of the tape which does not face the target sheet, configured to press a given area of the tape facing the target sheet against the target sheet;

an adhesive necessity information acquisition section configured to acquire information indicating whether the sheet to be pressed by the pressing mechanism is a sheet to be subjected to adhesive coating processing or a sheet to be merely subjected to pressing processing instead of the adhesive coating processing; and a control section configured to control, based on the information acquired by the adhesive necessity information acquisition section, the pressing mechanism to press the sheet to be subjected to adhesive coating processing in a state in which the part of the tape where the adhesive is carried is fed to a given area, and to press the sheet to be merely subjected to pressing processing instead of the adhesive coating processing in a state in which the part of the tape where the adhesive is carried is not fed to the given area by the rotation driving mechanism.

Herein, the "first rotation direction" of each of the first reel and the second reel refers to a rotation direction to feed the part of the base tape where the adhesive is carried towards the given area.

Thus, whether or not the first reel and the second reel are rotated in the same rotation direction does not matter as long as the part of the base tape where the adhesive is carried can be fed towards the given area as a result.

(2) The sheet binding apparatus according to (1), wherein the sheet to be merely subjected to pressing processing instead of the adhesive coating processing is a sheet equivalent to the front cover of the sheet bundle to be bound.

(3) The sheet binding apparatus according to (1), wherein the sheet to be merely subjected to pressing processing instead of the adhesive coating processing is a sheet onto which a next sheet supposed to be overlapped on the sheet surface scheduled to be subjected to adhesive coating processing is not fed.

A Ninth Embodiment

Next, the ninth embodiment is described.

The ninth embodiment is a modification of the eighth embodiment described above. Hereinafter, the components in the present embodiment having the same functions as those in the eighth embodiment are applied with the same reference numerals, and therefore, the detailed descriptions thereof are not repeated.

In addition to the motor M for feeding the mount tape 32 in the direction shown in FIG. 29(*a*) to feed the double-sided adhesive sheet 31 to the given area, the sheet binding apparatus of the finisher according to the ninth embodiment further comprises a motor M2 (refer to FIG. 51) for feeding back the mount tape 32 to retract the double-sided adhesive sheet 31 which is already fed to the given area from the given area. Herein, though a constitution is exemplified in which two different dedicated motors are arranged for the feeding and feeding back of the mount tape 32, the present invention is not limited to this. For example, the feeding and feeding back of the mount tape 32 can be realized through a single motor by adopting a clutch and a gear train.

Figure 52:
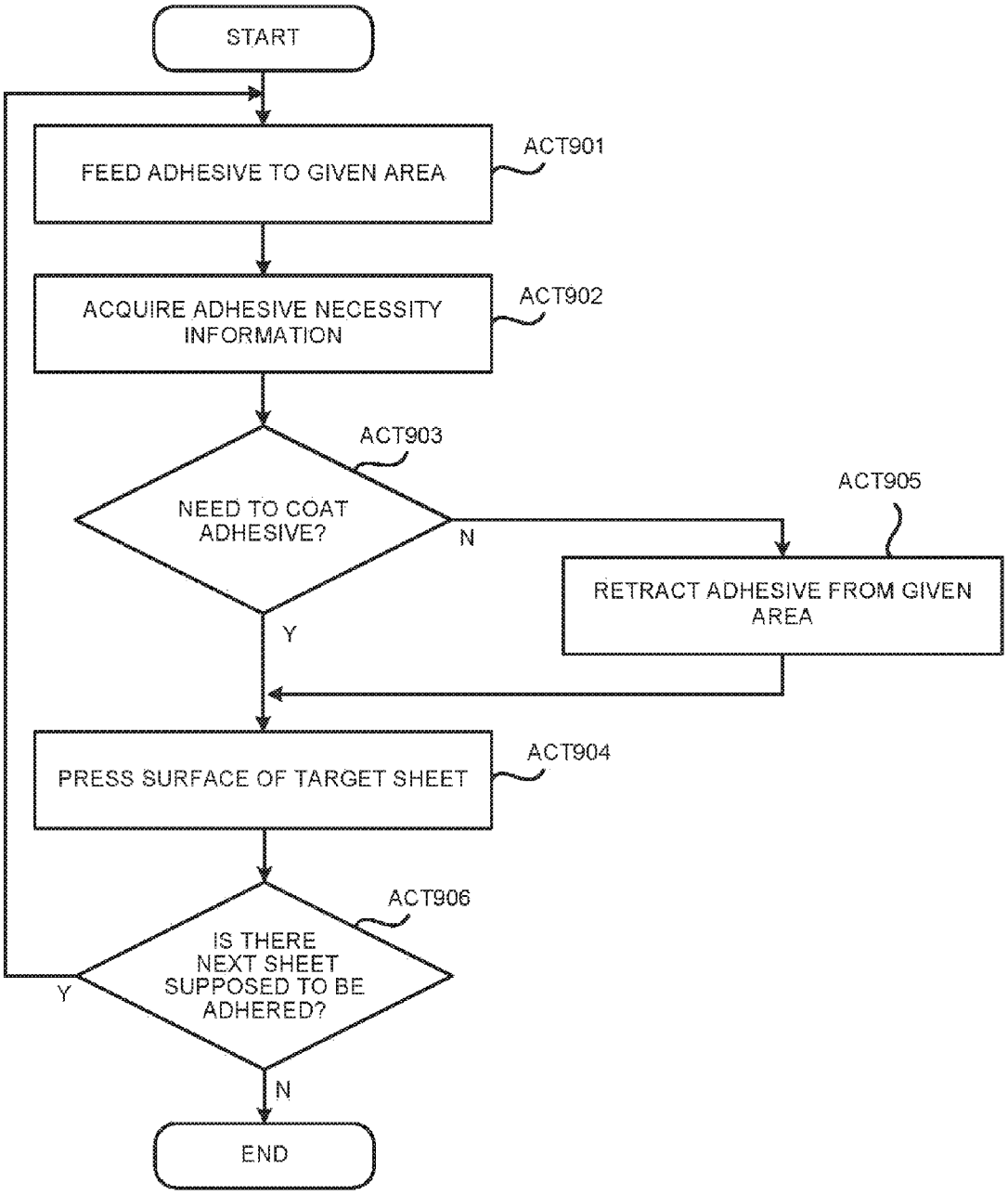
FIG. 52 is a flowchart illustrating the operations (sheet binding method) of the sheet binding apparatus according to the ninth embodiment.

FIG. 52 is a flowchart illustrating the operations (sheet binding method) of the sheet binding apparatus according to the ninth embodiment. As to the sheet binding operations in the ninth embodiment, the processing in ACT 902-ACT 904 and ACT 906 is the same as that in the eighth embodiment. As described below, in the present embodiment, every time the pressing processing on the sheet is completed, the operation of feeding the double-sided adhesive sheet 31 to the given area is automatically executed through the processor 151 in order to coat the adhesive on a next sheet.

If the sheet binding processing is started, the processor 151 first rotates and drives the motor M to feed the double-sided adhesive sheet 31 to the given area (ACT 901). Specifically, the processor 151 drives the motor M to rotate the winding shaft 34 and the winding shaft of the roll tape 33 in the first rotation direction to wind the tape fed from the winding shaft of the roll tape 33 on the winding shaft 34 (FIG. 29(*a*)).

Similar to the eighth embodiment, the processor 151 acquires the adhesive necessity information (ACT 902). In a case where the adhesive necessity information acquired in ACT 902 represents the page position indicating, for example, that the sheet loaded on the processing tray 304 is not the upmost sheet (for example, front cover part) loaded on the processing tray 304 within the sheets constituting the sheet bundle (YES in ACT 903), as shown in FIG. 30 (*b*), the processor 151 starts the tape stamping operation of the tape head 52 to press the upper surface of the upmost sheet (target sheet) within the sheets loaded on the processing tray 304 (ACT 904). In this way, the part (the double-sided adhesive sheet automatically fed after the former sheet pressing processing) of the double-sided adhesive sheet 31 carried on the mount tape 32 corresponding to the given area is coated on the given position of the upper surface of the target sheet as the cut adhesive sheet part G.

Figure 51:
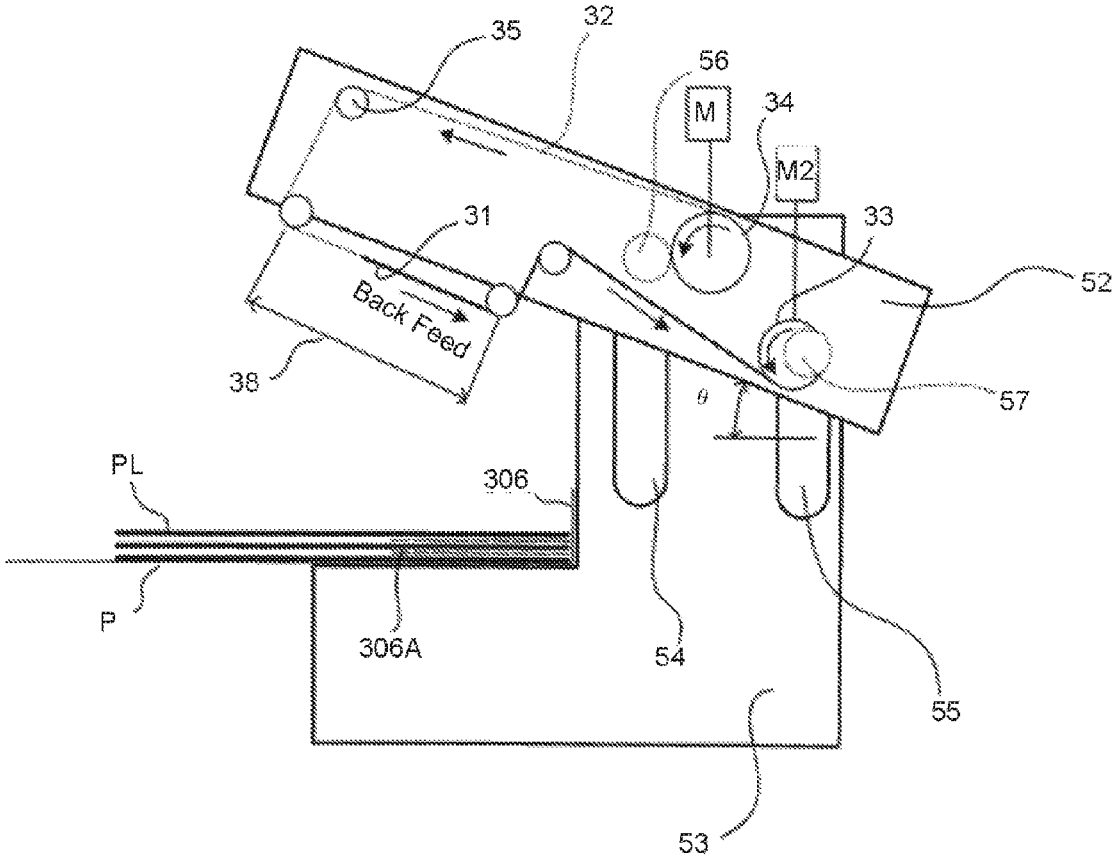
FIG. 51 is a diagram illustrating a sheet binding apparatus of a finisher according to a ninth embodiment.

On the other hand, in a case where the acquired adhesive necessity information indicates, for example, that the sheet loaded on the processing tray 304 is the upmost sheet (for example, front cover part) loaded on the processing tray 304 within the sheets constituting the sheet bundle (NO in ACT 903), as shown in FIG. 51, the processor 151 drives the motor M2 to rotate the winding shaft 34 and the winding shaft of the roll tape 33 in a second rotation direction opposite to the first rotation direction to wind the tape fed from the winding shaft 34 on the winding shaft of the roll tape 33. In this way, the fed double-sided adhesive sheet 31 on the mount tape 32 is fed back (retracted) from the given area (ACT 905). In this way, the double-sided adhesive sheet 31 is not fed to the space (given area) between the first transfer contact surface forming roller 36 and the second transfer contact surface forming roller 37, and the surface of the mount tape 32 where the double-sided adhesive sheet 31 is peeled off is exposed.

Next, the processor 151 starts the tape stamping operation of the tape head 52 as shown in FIG. 50 to press the upper surface of the upmost sheet PL (target sheet) within the sheets loaded on the processing tray 304 (ACT 904). In this way, only the pressing operation is carried out without coating the double-sided adhesive sheet 31 on the upper surface of the upmost sheet PL (target sheet) within the sheets loaded on the processing tray 304.

The processor 151 determines, based on the page information acquired from the MFP 100 and the like, whether or not there is a next sheet (a sheet supposed to be adhered on the upper surface of the pressed upmost sheet) to be further loaded following the upmost sheet pressed on the processing tray 304 (ACT 906). Herein, if there is a next sheet supposed to be adhered (YES in ACT 906), the flow returns to carry out the processing in ACT 901. On the other hand, if there is no next sheet supposed to be adhered (NO in ACT 906), it is determined that the previously pressed upmost sheet is the front cover of the sheet bundle to be bound, and then the processing is ended.

As stated above, in accordance with the ninth embodiment, for example, there is provided a sheet post-processing apparatus the constitutions of which are as follows.

(1) A sheet binding apparatus for binding a sheet bundle with adhesive, comprising:

a first reel;

a second reel;

a tape, of which one end is wound on the first reel and the other end is wound on the second reel, configured to carry, on a base tape, adhesive that is peeled off from the base tape and coated on a target sheet if being pressed against the target sheet;

a rotation driving mechanism configured to rotate the first reel and the second reel in either of a first driving mode in which the first reel and the second reel are rotated in a first rotation direction to wind the tape fed from the first reel on the second reel and a second driving mode in which the first reel and the second reel are rotated in a second rotation direction opposite to the first rotation direction to wind the tape fed from the second reel on the first reel;

a pressing mechanism, which is positioned at the side of the tape which does not face the target sheet, configured to press a given area of the tape facing the target sheet against the target sheet;

an adhesive necessity information acquisition section configured to acquire information indicating whether the sheet to be pressed by the pressing mechanism is a sheet to be subjected to adhesive coating processing or a sheet to be merely subjected to pressing processing instead of the adhesive coating processing; and a control section configured to control, based on the information acquired by the adhesive necessity information acquisition section, the pressing mechanism to press the sheet to be subjected to adhesive coating processing in a state in which the part of the tape where the adhesive is carried is fed to the given area through the first driving mode, and to press the sheet to be merely subjected to pressing processing instead of the adhesive coating processing in a state in which the part of the tape where no adhesive is carried is fed to the given area through the second driving mode.

(2) The sheet binding apparatus according to (1), wherein the sheet to be merely subjected to pressing processing instead of the adhesive coating processing is a sheet equivalent to the front cover of the sheet bundle to be bound.

(3) The sheet binding apparatus according to (1), wherein the sheet to be merely subjected to pressing processing instead of the adhesive coating processing is a sheet onto which a next sheet supposed to be overlapped on the sheet surface scheduled to be subjected to adhesive coating processing is not fed.

In addition, it goes without saying that each embodiment separately described above can be implemented not only through the constitution single body described in each of the embodiments, but also through a combination between any embodiments in these embodiments in a range in which no technical contradiction is caused.

For example, the pasting head disclosed in the third-seventh embodiments may be set as, for example, the movable constitution described the first and the second embodiments, and the control on the pasting target positions described in the first and the second embodiments may be realized.

Further, it goes without saying that the constitution described in the fifth embodiment for retracting the pasting target positions on the sheet in a direction orthogonal to the sheet conveyance direction to positions which cannot be contacted with the sheet conveyance roller may also be applied to other embodiments besides the fifth embodiment.

Of course, the binding strength adjustment based on the pasting method described in the third embodiment may also be carried out in the first and the second embodiments and the fifth-seventh embodiments by adopting the constitution of the pasting head as stated in the third embodiment.

Moreover, in each embodiment described above, the constitution of the pasting head is not limited to the disclosed specific constitution. For example, if the mechanism capable of moving in the paper surface direction with respect to the paper surface described in the fourth embodiment is adopted, in the first and the second embodiments and the fifth-seventh embodiments, the binding strength and the binding position can be controlled by adjusting the pasting target area (the size or shape).

As stated above, in each embodiment described above, any embodiments can be freely combined in a range in which no technical contradiction is caused.

In each embodiment described above, though a case of carrying out pasting processing on the upper surface of the sheet is exemplified, the present invention is not limited to this. The pasting processing can be carried out on either the upper surface of the sheet or the lower surface of the sheet, as long as the paste is coated between each sheet of the sheet bundle to be bound in a rule described in each embodiment as a result.

Further, in each embodiment described above, though it is expressed as "coating" the paste, it is not limited to "coating" the paste on the sheet, and the paste may also be sprayed to the sheet. In addition, for example, a case of pasting tape-type paste and a case of carrying out stamp-type pasting are also included. That is, the processing method is not limited as long as the paste can be coated on the surface of the sheet through the processing.

In addition, the "sheet" in each embodiment described above is not limited to paper. For example, a sheet-like medium such as an OHP film sheet and the like that can be bound through paste may be used.

Furthermore, in a computer constituting the sheet binding apparatus and the post-processing apparatus provided with the sheet binding apparatus, the program for executing each operation described above can be provided as a sheet binding program. In the present embodiment, the program is pre-recorded in a storage area arranged in the apparatus to achieve the functions of the present invention. However, the present invention is not limited to this; the same program may be downloaded to the apparatus from a network. Alternatively, the same program stored in a computer-readable recording medium may be installed in the apparatus. The form of the recording medium is not limited as long as the recording medium can store programs and is readable by a computer. Specifically, for example, an inner storage device installed inside the computer such as the ROM and RAM; a portable storage medium such as a CD-ROM or flexible disk, a DVD disk, a magnetic optical disk and an IC card; a database for holding a computer program; other computer and the database thereof; and a transmission medium on a line and the like can be listed as the recording medium. Further, the function realized by an installed or downloaded program can also be realized through the cooperation with an OS (Operating System) installed in the apparatus.

An execution module may also be used for dynamically generating all or part of the programs.

Further, it goes without saying that at least one part of the various processing realized by executing the program through the CPU or MPU in each embodiment described above can be executed by the ASIC 802 in a circuit manner.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A sheet binding apparatus for binding a sheet bundle with adhesive, comprising:

a first reel;

a second reel;

a tape, of which one end is wound on the first reel and the other end is wound on the second reel, configured to carry, on a base tape, adhesive that is peeled off from the base tape and coated on a target sheet if being pressed against the target sheet;

a rotation driving mechanism configured to rotate the first reel and the second reel in a first rotation direction to wind the tape fed from the first reel on the second reel;

a pressing mechanism, which is positioned at the side of the tape which does not face the target sheet, configured to press a given area of the tape facing the target sheet against the target sheet; and a controller configured to acquire information indicating whether the sheet to be pressed by the pressing mechanism is a sheet to be subjected to adhesive coating processing or a sheet to be merely subjected to pressing processing instead of the adhesive coating processing, the controller configured to control, based on the information acquired, the pressing mechanism to press the sheet to be subjected to the adhesive coating processing in a state in which the part of the tape where the adhesive is carried is fed to a given area, and to press the sheet to be merely subjected to pressing processing instead of the adhesive coating processing in a state in which the part of the tape where the adhesive is carried is not fed to the given area by rotating the first reel in a second direction opposite to the first rotation direction to wind the tape fed from the second reel on the first reel by the rotation driving mechanism; wherein the sheet to be merely subjected to pressing processing instead of the adhesive coating processing is a sheet onto which a next sheet supposed to be overlapped on the sheet surface scheduled to be subjected to adhesive coating processing is not fed.

2. The sheet binding apparatus according to claim 1, wherein the sheet to be merely subjected to pressing processing instead of the adhesive coating processing is a sheet equivalent to the front cover of the sheet bundle to be bound.

3. The sheet binding apparatus according to claim 1, wherein the next sheet is not fed by jamming the next sheet.

4. The sheet binding apparatus according to claim 1, wherein the rotation driving mechanism is a motor.

5. A sheet binding apparatus for binding a sheet bundle with adhesive, comprising:

a first reel;

a second reel;

a tape, of which one end is wound on the first reel and the other end is wound on the second reel, configured to carry, on a base tape, adhesive that is peeled off from the base tape and coated on a target sheet if being pressed against the target sheet;

a rotation driving mechanism configured to rotate the first reel and the second reel in either of a first driving mode in which the first reel and the second reel are rotated in a first rotation direction to wind the tape fed from the first reel on the second reel and a second driving mode in which the first reel and the second reel are rotated in a second rotation direction opposite to the first rotation direction to wind the tape fed from the second reel on the first reel;

a pressing mechanism, which is positioned at the side of the tape which does not face the target sheet, configured to press a given area of the tape facing the target sheet against the target sheet; and a controller configured to acquire information indicating whether the sheet to be pressed by the pressing mechanism is a sheet to be subjected to adhesive coating processing or a sheet to be merely subjected to pressing processing instead of the adhesive coating processing, the controller configured to control, based on the information acquired, the pressing mechanism to press the sheet to be subjected to adhesive coating processing in a state in which the part of the tape where the adhesive is carried is fed to the given area through the first driving mode, and to press the sheet to be merely subjected to pressing processing instead of the adhesive coating processing in a state in which the part of the tape where no adhesive is carried is fed to the given area through the second driving mode; wherein the sheet to be merely subjected to pressing processing instead of the adhesive coating processing is a sheet onto which a next sheet supposed to be overlapped on the sheet surface scheduled to be subjected to adhesive coating processing is not fed.

6. The sheet binding apparatus according to claim 5, wherein the sheet to be merely subjected to pressing processing instead of the adhesive coating processing is a sheet equivalent to the front cover of the sheet bundle to be bound.

7. The sheet binding apparatus according to claim 5, wherein the next sheet is not fed by jamming the next sheet.

8. The sheet binding apparatus according to claim 5, wherein the rotation driving mechanism is a motor.

* * * * *